US006959712B2

(12) United States Patent
Bereman et al.

(10) Patent No.: US 6,959,712 B2
(45) **Date of Patent: *Nov. 1, 2005**

(54) METHOD OF MAKING A SMOKING COMPOSITION

(75) Inventors: Robert D. Bereman, Apex, NC (US); Patrick Rainey, Raleigh, NC (US)

(73) Assignee: Vector Tobacco Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 10/871,863

(22) Filed: Jun. 18, 2004

(65) Prior Publication Data

US 2005/0000532 A1 Jan. 6, 2005

Related U.S. Application Data

(63) Continuation of application No. 10/007,724, filed on Nov. 9, 2001, now Pat. No. 6,789,548.

(60) Provisional application No. 60/247,163, filed on Nov. 10, 2000, and provisional application No. 60/322,132, filed on Sep. 11, 2001.

(51) Int. Cl.[7] ..... A24B 15/00

(52) U.S. Cl. ..... 131/352; 131/290

(58) Field of Search ..... 131/331, 334, 131/352, 360, 361, 363, 290; 432/66–67, 214–215

(56) References Cited

U.S. PATENT DOCUMENTS

| | | | |
|---|---|---|---|
| 1,519,470 | A | 12/1924 | Wilson et al. |
| 2,759,859 | A | 8/1956 | Lahr |
| 2,967,118 | A | 1/1961 | Gary et al. |
| 3,121,433 | A | 2/1964 | Plunkett et al. |
| 3,251,365 | A | 5/1966 | Keith II, et al. |
| 3,292,636 | A | 12/1966 | Mays |
| 3,300,528 | A | 1/1967 | Ryoichi et al. |
| 3,338,246 | A | 8/1967 | Mays |
| 3,380,458 | A | 4/1968 | Touey et al. |
| 3,428,054 | A | 2/1969 | Scarabello et al. |
| 3,572,348 | A | 3/1971 | Norman et al. |
| 3,650,279 | A | 3/1972 | Gansloser |
| 3,703,901 | A | 11/1972 | Norman et al. |
| 3,893,464 | A | 7/1975 | Norman et al. |
| 4,022,223 | A | 5/1977 | Rainer et al. |

(Continued)

FOREIGN PATENT DOCUMENTS

| | | |
|---|---|---|
| CN | 1035039 A | 8/1989 |
| CN | 1006443 B | 1/1990 |

(Continued)

OTHER PUBLICATIONS

*A Chromatographic Analysis for Polynuclear Aromatic Hydrocarbons in Small Quantities of Cigarette Smoke Condensatel* by R.F. Severson, M.E. Snook, O.T. Chartyk and R.F. Arrendale, Beiträge zur Tabakforschung, Band 8, Heft 5, März 1976.

(Continued)

*Primary Examiner*—Steven P. Griffin
*Assistant Examiner*—Carlos Lopez
(74) *Attorney, Agent, or Firm*—Knobbe Martens Olson & Bear LLP

(57) ABSTRACT

The present invention relates to smoking articles such as cigarettes, and in particular to catalytic systems containing metallic or carbonaceous particles that reduce the content of certain harmful or carcinogenic substances, including polyaromatic hydrocarbons, tobacco-specific nitrosamines, carbazole, phenol, and catechol, in mainstream cigarette smoke and in side stream cigarette smoke.

20 Claims, 9 Drawing Sheets

U.S. PATENT DOCUMENTS 4,055,191 A 10/1977 Norman et al.
4,177,822 A 12/1979 Bryant, Jr. et al.
4,201,234 A 5/1980 Neukomm
4,215,708 A 8/1980 Bron
4,216,784 A 8/1980 Norman et al.
4,235,251 A 11/1980 Bryant, Jr. et al.
4,236,533 A 12/1980 de Clara
4,246,910 A 1/1981 Rainer et al.
4,248,251 A 2/1981 Bryant, Jr. et al.
4,256,609 A 3/1981 Dale et al.
4,257,430 A 3/1981 Collins et al.
4,266,561 A 5/1981 Litzinger
4,317,460 A 3/1982 Dale et al.
4,357,950 A 11/1982 Berger
4,359,481 A 11/1982 Smits et al.
4,516,590 A 5/1985 Teng
4,517,995 A 5/1985 Lyles
4,561,454 A 12/1985 Guess
4,729,389 A 3/1988 Anderson
4,753,250 A 6/1988 Bitter et al.
4,807,809 A 2/1989 Pryor et al.
4,819,667 A 4/1989 Drazic
4,830,028 A 5/1989 Lawson et al.
4,845,647 A 7/1989 Dils et al.
4,875,910 A 10/1989 Dunnigan et al.
4,879,049 A 11/1989 De Mon et al.
4,889,142 A 12/1989 Rosenthal
4,920,990 A 5/1990 Lawrence et al.
4,976,247 A 12/1990 Schmied et al.
5,011,980 A * 4/1991 Sano et al. ..... 560/245
5,022,964 A 6/1991 Crane et al.
5,025,812 A 6/1991 Fagg et al.
5,056,537 A 10/1991 Brown et al.
5,060,672 A 10/1991 Irimi et al.
5,065,775 A 11/1991 Fagg
5,074,320 A 12/1991 Jones, Jr. et al.
5,074,321 A 12/1991 Gentry et al.
5,076,294 A 12/1991 Kramer
5,095,922 A 3/1992 Johnson et al.
5,158,099 A 10/1992 Rosen et al.
5,159,942 A 11/1992 Brinkley et al.
5,168,884 A 12/1992 Baldwin et al.
5,175,276 A 12/1992 McNair, Jr. et al.
5,211,684 A 5/1993 Shannon et al.
5,220,930 A 6/1993 Gentry
5,250,101 A 10/1993 Hidaka et al.
5,261,425 A 11/1993 Raker et al.
5,278,113 A 1/1994 Ono et al.
5,285,798 A 2/1994 Banerjee et al.
5,310,548 A 5/1994 Tsuru et al.
5,357,984 A 10/1994 Farrier et al.
5,388,177 A 2/1995 Ono et al.
5,392,793 A 2/1995 Molloy
5,409,021 A 4/1995 Safaev et al.
5,421,854 A 6/1995 Kodas et al.
5,465,739 A 11/1995 Perfetti et al.
5,679,364 A 10/1997 Levy
5,713,376 A 2/1998 Berger
5,727,573 A 3/1998 Meier et al.
5,746,230 A 5/1998 Arterbery et al.
5,779,847 A 7/1998 Groeger
5,803,081 A 9/1998 O'Donnell, Jr. et al.
5,810,020 A 9/1998 Northway et al.
5,829,453 A 11/1998 White et al.
5,845,647 A 12/1998 O'Donnell, Jr, et al.
5,888,479 A 3/1999 Carlin
5,909,736 A 6/1999 Stavridis et al.
5,944,025 A 8/1999 Cook et al.
5,979,461 A 11/1999 Bensalem et al.
6,058,940 A 5/2000 Lane
6,110,968 A 8/2000 Bucala et al.
6,113,964 A 9/2000 Potter et al.
6,119,699 A 9/2000 Sung
6,119,701 A 9/2000 Cerami et al.
6,135,121 A 10/2000 Williams
6,145,511 A 11/2000 Teufel et al.
6,153,119 A 11/2000 Sung
6,164,288 A 12/2000 Lesser et al.
6,171,684 B1 1/2001 Kahlbaugh et al.
6,202,649 B1 3/2001 Williams
6,273,093 B1 8/2001 Oliver et al.
6,286,516 B1 9/2001 Bowen et al.
6,311,695 B1 11/2001 Williams
6,789,548 B2 * 9/2004 Bereman ..... 131/352

FOREIGN PATENT DOCUMENTS

CN 1123118 A 5/1996
CN 1161838 A 10/1997
EP 0000625 B1 2/1979
EP 0058490 B1 8/1982
EP 0058490 B2 8/1982
EP 0110693 B1 10/1988
EP 0370335 A2 5/1990
EP 0378774 A3 7/1990
EP 0378774 A2 7/1990
EP 0404580 B1 12/1990
EP 0404580 B2 12/1990
EP 0434332 A2 6/1991
EP 0434339 A2 6/1991
EP 0514151 A2 11/1992
EP 0589298 A1 3/1994
EP 0626998 B1 12/1994
EP 0525347 B1 5/1997
EP 0589298 B1 4/1999
EP 0626998 B1 10/2001
FR 1180320 12/1958
GB 841074 7/1960
GB 2 042 364 1/1980
GB 2082438 3/1982
JP 53136597 A2 11/1978
JP 57065331 A2 4/1982
JP 58174340 A2 10/1983
JP 59029036 A2 2/1984
JP 61068135 A2 4/1986
JP 61068139 A2 4/1986
JP 61227842 A2 10/1986
JP 62091241 A2 4/1987
JP 62097641 A2 5/1987
JP 63250340 A2 10/1988
JP 1030573 A2 2/1989
JP 3130292 A2 6/1991
JP 8309184 A2 11/1996
JP 11225734 A2 8/1999
JP 0056308 A2 2/2000
WO WO 98/28994 7/1998
WO WO 98/36650 8/1998
WO WO 98/38351 9/1998
WO WO 98/56923 12/1998
WO WO 98/58555 12/1998
WO WO 99/01418 1/1999
WO WO 99/33438 7/1999
WO WO 99/53778 10/1999
WO WO 00/02464 1/2000
WO WO 00/25610 5/2000
WO WO 00/25611 5/2000
WO WO 00/56842 9/2000
WO WO 01/35770 A1 5/2001
WO WO 01/65954 A1 9/2001

OTHER PUBLICATIONS

*A High–Performance Liquid Chromatographic Determination of Major Phenolic Compounds in Tobacco Smoke* by Charles H. Risner and Shelia L. Cash, Journal of Chromatographic Science, vol. 28, May 1990.

*A Rapid Method for the Determination of Benzo[a]Pyrene, benzo[a]Anthracene and Chrysene in Cigarette Smoke* by Klimisch and E. Kircheim, Chromatographia, vol. 9, No. 3, Mar. 1976.

*Analysis of Polycyclic Aromatic Hydrocarbons, Phenols and Aromatic Amines in Particulate Phase Cigarette Smoke Using Simultaneous Distallationand Extraction As A Sole Sample Clean–Up Step* by J.B. Forehand, G.L. Dooly, S.C. Moldoveanu, Hjournal of Chromatography A, (2000) pp. 111–124.

*Analysis of Polycyclic Hydrocarbons* by E.W. Robb, G.C. Guvenator, III., M.D. Edmonds and A. Bavley, Beiträge zur Tabakforschung, Band 3, Heft 4, Oct. 1965.

*Carcinogenic Agents In Cigarette Smoke and the Influence of Nitrate on Their Formation* by John D. Adams, Suk Jong Lee and Dietrich Hoffmann, IRL Press Ltd., Oxford, England, vol. 5 No. 2, pp. 221–223, 1984.

*Determination of Benzo[A]pyrene in Mainstream Tobacco Smoke*, Health Canada, Dec. 1999.

*Determination of Polycyclic Aromatic Hydrocarbons, Polycyclic Aromatic Sulfur and Oxygen Heterocycles in Cigarette Smoke Condensate* by E.R. Schmid, G. Bachlechner, K. Varmuza and H. Klus, Originalarbeiten.

*Determination of Seventeen Polycyclic Aromatic Hydrocarbons in Tobacco Smoke Condensate* by G. Gmeiner, G. Stehlik and H. Tausch, Journal of Chromatography A, 767 (1997) pp. 163–169.

*Effect of Air–Curing on the Chemical Composition of Tobacco* by Anna Wiernik, Alex Christakopoulos, Lennart Johansson and inger Wahlberg, Svenska Tobaks AB, Recent Advances in Tobacco Science, vol. 21, pp. 39 et seq., Symposium Proceedings 49$^{th}$ Meeting Tobacco Chemists' Research Conference, Sep. 24–27, 1995, Lexington, Ky.

*Ein Experimenteller Beltrag zur Tabakrauchkanzerogenese* by Von E.L. Wynder und D. Hoffmann, Nr. 13, 29, März 1963 pp. 623–628.

*Gas Chromatographic Quantitation of Polynuclear Aromatic Hydrocarbons in Tobacco Smoke* by R.F. Severson, M.E. Snook, R.F. Arrendale and O.T. Chortyk, Analytical Chemistry, vol. 48, No. 13, Nov. 1976.

*Gaschromatographic Determination of Polycyclic Aromatic Hydrocarbons, Aza–arenes, Aromatic Amines in the Particle and Vapor Phase of Mainstream and Sidestream Smoke of Cigarettes* by Gernot Grimmer, Klaus–Werner Naujack and Gerhard Dettbarn, Toxicology Letters, 35 (1987) pp. 117–124.

International Search Report for PCT/US01/47307.

*Isolation, Identation, and Quantitation of the Polynuclear Aromatic Hydrocarbons in Tobacco Smoke* by Ray F. Severson, Maurice E. Snook, Howard C. higman, Orestes T. Chortyk and Frank J. Akin, Carcinogenesis, vol. 1, Polynuclear Aromatic Hydrocarbons: Chemistry, Metabolism and Carcinogenesis, edited by R.I. Freudenthal and P.W. Jones, Raven Press, New York 1976.

Jorgen Lam, Acta Pathol. Microbiol. Scan., "Demonstration of 3:4–Benzpyrene, Other Aromatic Hydrocarbons, and Nitrogen in the Products Formed by Pyrolysis of Tobacco Extract"; 40, 369 (1957).

*On–Line Generation of Cyanogen Chloride As A Replacement Reagent for Cyanogen Bromide in the Total Alkaloids Determination* by William R. Harvey and Betty M. Handy, Tobacco Science, pp. 131–133.

*Polynuclear Hydrocarbons in Tobacco and Tobacco Smoke Part III. The Inhibition of the Formation of 3:4–Benzopyrene in Cigarette Smoke* by H.R. Bentley and J.G. Burgan.

*Present Status of Laboratory Studies on Tobacco Carcinogenesis* by Ernest L. Wynder and Dietrich Hoffmann.

*Quantitation of Polycyclic Aromatic Hydrocarbons* by R.E. Allen and L.J. Deutsch, Polycyclic Aromatic Hydrocarbons, pp. 348–362.

*Quantitative determination of Naphthalenes in Tobacco Smoke by Gas Chromatography* by R.F. Arrendale, R.F. Severson and M.F. Snook, Beiträge zur Tabakforschung International, vol. 10, No. 2, pp. 2–7, Jul. 1980.

*The Determination of Benzo[a]Pyrene and Benz[a]Anthracene in Mainstream and Sidestream Smoke of the Kentucky Reference Cigarette 1R4F and a Cigarette which Heats but Does Not Burn Tobacco: A Comparison* by Charles H. Risner, , Beiträge zur Tabakforschung International, vol. 15, No. 1, Aug. 1991.

*The Reduction of the Tumorigenicity of Cigarette Smoke Condensate by Addition of Sodium Nitrate to Tobacco* by Dietrich Hoffmann and Ernest L. Wynder, Cancer Research 27, pp. 172–174, Jan. 1967.

Zur Frage der Behandlung des Zigarettenpapieres und des Tabaks Zwecks verminderung von polycyklischen Kohlenwasserstoffen in deren Rauch by Constantin Pyriki, Walter Molden.

* cited by examiner

HPLC SPECTRUM OF STANDARDS, FROM LEFT TO RIGHT: 1,6-DIAMINOPYRENE, 1,8-DIAMINOPYRENE, 4-AMINOPYRENE, 1-AMINOPYRENE AND 6-AMINOCHRYSENE

PEAKS FROM LEFT TO RIGHT; HYDROQUINONE, RESORCINOL, CATECHOL, PHENOL, O-CRESOL

METHOD OF MAKING A SMOKING COMPOSITION

This application is a continuation of U.S. application Ser. No. 10/007,724 filed Nov. 9, 2001, now U.S. Pat. No. 6,789,548, which claims the benefit of U.S. Provisional Application No. 60/247,163 filed on Nov. 10, 2000 and U.S. Provisional Application No. 60/322,132 filed Sep. 11, 2001.

FIELD OF THE INVENTION

The present invention relates to smoking articles such as cigarettes, and in particular to catalytic systems containing metallic or carbonaceous particles that reduce the content of certain harmful or carcinogenic substances, including polyaromatic hydrocarbons, tobacco-specific nitrosamines, carbazole, phenol, and catechol, in both mainstream cigarette smoke and side stream cigarette smoke.

BACKGROUND OF THE INVENTION

It is widely known that tobacco smoke contains mutagenic and carcinogenic compounds that cause substantial morbidity and mortality to smokers. Such compounds include polyaromatic hydrocarbons (PAHs), tobacco-specific nitrosamines (TSNAs), carbazole, phenol, and catechol.

The carcinogenic potential of polyaromatic hydrocarbons (PAHs) is well known. PAHs are a group of chemicals where constituent atoms of carbon and hydrogen are linked by chemical bonds in such a way as to form two or more rings, or "cyclic" arrangements. For this reason, these are sometimes called polycyclic hydrocarbons or polynuclear aromatics. Examples of such chemical arrangements are anthracene (3 rings), pyrene (4 rings), benzo(a)pyrene (5 rings), and similar polycyclic compounds.

Such compounds have been identified in all situations where combustion of organic materials is taking place, and where pyrolysis is incomplete. Several industrial sources of these compounds are known: incomplete pyrolysis of coke in metallurgy, in aluminum pot rooms, and of fuel oil in heat generating equipment, to name but a few. It is also known that internal combustion engines (diesel or gasoline engines) are a major source of these pollutants. Incomplete combustion of the most simple hydrocarbon, methane, often referred to as natural gas, has also been found to be a source of 3,4-benzopyrene emissions. PAHs have also been identified in tobacco smoke. Several of these PAHs are known to be carcinogens for lung tissue and others are suspected of similar effects, operating by genotoxic mechanisms, and their presence in tobacco smoke has further been linked with the synergism observed in smokers exposed to high levels of respirable dusts in uncontrolled workplace situations.

Tobacco specific nitrosamines (TSNAs) are electrophilic alkylating agents that are potent carcinogens. They are formed by reactions involving free nitrate during processing and storage of tobacco, and by combustion of tobacco containing nicotine and nornicotine in a nitrate rich environment. It is also known that fresh-cut, green tobacco contains virtually no tobacco specific nitrosamines. See, for example, U.S. Pat. Nos. 6,202,649 and 6,135,121 to Williams; and Wiernik et al., "Effect of Air-Curing on the Chemical Composition of Tobacco," Recent Advances in Tobacco Science, Vol. 21, pp. 39 et seq., Symposium Proceedings 49th Meeting Tobacco Chemists' Research Conference, Sep. 24–27, 1995, Lexington, Ky. In contrast, cured tobacco products obtained according to conventional methods are known to contain a number of nitrosamines, including the two most harmful carcinogens N'-nitrosonomicotine (NNN) and 4-(N-nitrosomethylamino)-1-(3-pyridyl)-1-butanone (NNK). Of these two, NNK is significantly more dangerous than NNN. It is widely accepted that such nitrosamines are formed post-harvest, during the conventional curing process, and in the combustion process.

Carbazole, phenol, and catechol are all compounds produced in cigarette smoke. Carbazole is a heterocyclic aromatic compound containing a dibenzopyrrole system and is a suspected carcinogen. The phenolic compounds in cigarette smoke are due to the pyrolysis of the polyphenols chlorogenic acid and rutin, two major components in flue-cured leaf. Currently, the literature identifies catechol, phenol, hydroquinone, resorcinol, o-cresol, m-cresol, and p-cresol as the seven phenolic compounds in tobacco smoke. Catechol is the most abundant phenol in tobacco smoke (80–400 $\mu$g/cigarette) and has been identified as a co-carcinogen with benzo[a]pyrene (also found in tobacco smoke). Phenol has been shown to be toxic and is identified as a tumor promoter in the literature.

The most common method for removing harmful components from tobacco smoke is the use of a mechanical filter device. Various filters for reducing or removing undesirable components from tobacco have been proposed and constructed. In general, a porous filter may be provided as a mechanical trap for harmful components, interposed between the smoke stream and the mouth. This type of filter, often composed of cellulose acetate, mechanically or adsorptively traps a certain fraction of the components present in smoke.

Cigarette filter devices may contain a variety of granular or particulate adsorbents in addition to any porous materials, e.g., cellulose acetate tow, present in the device. Activated carbon, or charcoal, is the most widely preferred granular adsorbent. Other types of adsorbents include, for example, kaolin clay as disclosed in U.S. Pat. No. 4,729,389. U.S. Pat. No. 3,650,279 discloses a cigarette filter composed of a powdered aluminum silicate mineral that may be prepared by rendering the mineral electropositive and then cationizing it by absorbing macromolecular cations (such as methylene blue and $FeSO_4$) thereon. U.S. Pat. No. 3,428,054 discloses a cigarette filter composed of mineral particles, such as slag, and absorptive powdered clay, such as kaolinite, bound together by a non-toxic binder. U.S. Pat. No. 3,251,365 discloses a cigarette filter composed of powdered clay, such as kaolin, into which from 1 to 13 percent by weight of iron or zinc oxide may be incorporated. U.S. Pat. No. 2,967,118 relates to a specially prepared kaolin clay powder which has been acid activated for use in filters. U.S. Pat. No. 4,022,223 teaches the use of alumina and activated alumina as base materials in absorptive filter compositions.

An improvement in the effectiveness afforded by mechanical-type filters or filters containing adsorptive materials may be provided by including means for chemically trapping or reacting undesirable components present in smoke. For example, U.S. Pat. No. 5,076,294 provides a filter element containing an organic acid, such as citric acid, which reduces the harshness of the smoke. Inclusion of L-ascorbic acid in a filter material to remove aldehydes is disclosed in U.S. Pat. No. 4,753,250. U.S. Pat. No. 5,060,672 also describes a filter for specifically removing aldehydes, such as formaldehyde, from tobacco smoke by providing a combination of an enediol compound, such as dihydroxyfumaric acid or L-ascorbic acid, together with a radical scavenger of aldehydes, such as oxidized glutathione or urea, or a compound of high nucleophilic activity, such as lysine, cysteine, 5,5-dimethyl-1,3-cyclohexanedione, or thioglycolic acid. U.S. Pat. No. 5,465,739, the contents of which is incorporated herein by reference in its entirety, discloses cigarettes incorporating a filter element containing an acidic material having a pKa at 25° C. of less than about 3, such as phosphoric acid. U.S. Pat. No. 5,409,021 discloses a double or triple chamber cigarette filter containing lignin, which is effective in reducing levels of tobacco-specific nitrosamines.

While the filters present on most available cigarettes are effective in reducing levels of certain undesirable components in tobacco smoke, filters still allow a significant amount of undesirable compounds to pass into the mouth. Moreover, while filters may be preferred to reduce the amount of undesired components in mainstream smoke, which is the smoke that is drawn through the mouth end of a smokable article or device and inhaled by the smoker, filters do not reduce the amount of undesirable components in sidestream smoke. Sidestream smoke is the smoke that is given off from the end of a burning tobacco product between puffs and is not directly inhaled by the smoker. Sidestream smoke gives rise to passive inhalation on the part of bystanders, and is also referred to as second-hand smoke.

One approach to removing undesired components from tobacco smoke is the use of catalysts. Palladium catalyst systems have been proposed for cigarettes. The following patents describe such systems: U.S. Pat. No. 4,257,430 to Collins et al.; U.S. Pat. No. 4,248,251 to Bryant et al.; U.S. Pat. No. 4,235,251 to Bryant et al.; U.S. Pat. No. 4,216,784 to Norman et al.; U.S. Pat. No. 4,177,822 to Bryant et al.; and U.S. Pat. No. 4,055,191 to Norman et al., each of which is incorporated by reference in its entirety. Early attempts at incorporating catalytic systems into mass-produced cigarettes have met with limited success. Therefore, a catalytic system that reduces the levels of certain carcinogenic or otherwise undesirable components from tobacco smoke, and which is amenable to use in mass-produced cigarettes, is desirable.

DETAILED DESCRIPTION OF THE PREFERRED EMBODIMENTS

Introduction

Figure 1:
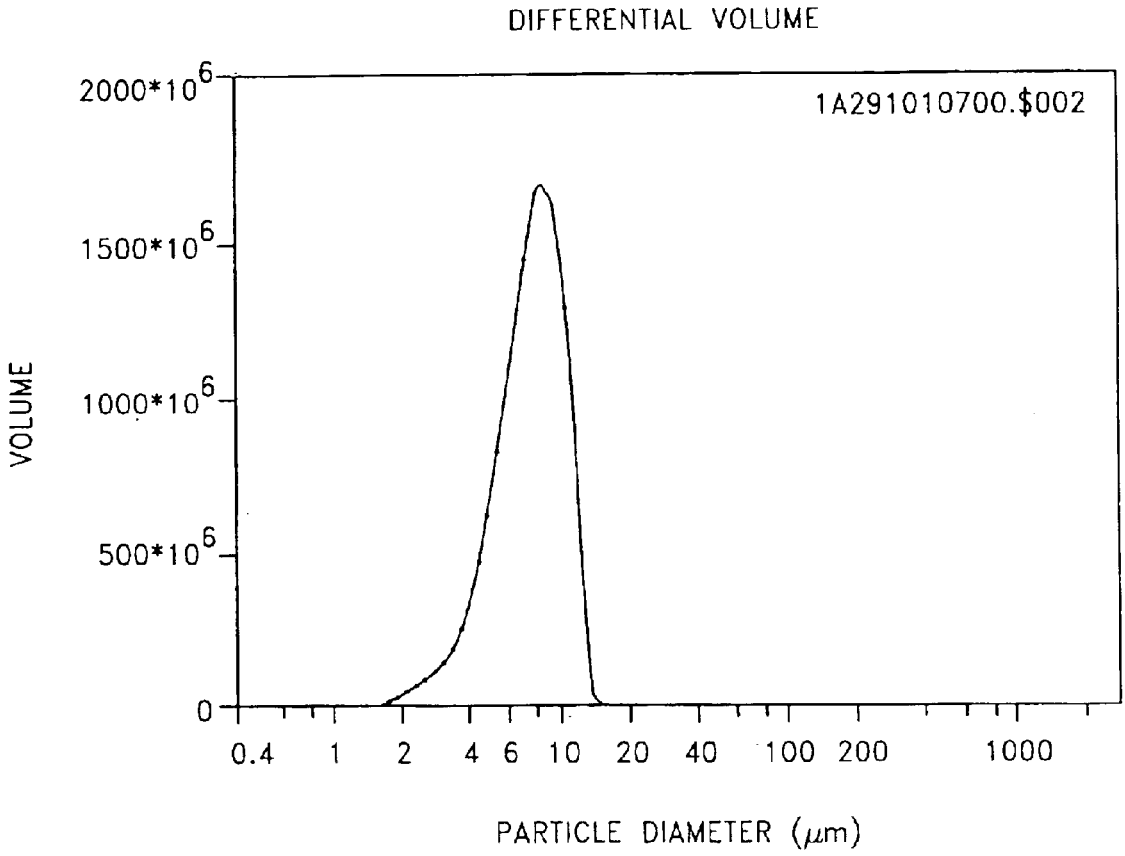
FIG. 1 provides a typical catalyst chromatogram providing palladium particle diameters ($\mu$m) in a typical reducing solution after reaction.

The following description and examples illustrate the preferred embodiments of the present invention. Those of skill in the art will recognize that there are numerous variations and modifications of this invention that are encompassed by its scope. Accordingly, the description of preferred embodiments should not be deemed to limit the scope of the present invention.

While various methods have been provided for removing PAHs, TSNAs, phenolic compounds, and other undesirable components from automotive and industrial exhaust gases, no satisfactory method has been proposed for selectively removing such components from smoke from a smokable material, for example, tobacco in a cigarette or cigar, or pipe tobacco. There is, therefore, a need for an improved smokable material that has reduced levels of certain PAHs, TSNAs, phenolic compounds, and certain other undesirable components in both its mainstream and sidestream smoke. Further, there is a need for a method of substantially reducing certain PAHs, TSNAs, phenolic compounds, and other undesired components in tobacco smoke while retaining satisfactory flavor. Moreover, there is a need for a method of reducing the level of exposure to carcinogenic and other undesirable components of a smoker or an individual exposed to sidestream smoke. Such improved smokable materials are preferably simple to manufacture and convenient to use.

The preferred embodiments relate to smoking articles such as cigarettes, cigars, or pipe tobacco, and in particular to cigarettes having reduced content of various PAHs, the TSNA 4-(N-nitrosomethylamino)-1-(3-pyridyl)-1-butanone (NNK), phenolic compounds including catechol and phenol, carbazole, and certain other undesired components in cigarette smoke, including both mainstream and sidestream smoke. The tobacco products of preferred smoking articles include a catalytic system including metallic or carbonaceous particles and a source of nitrate or nitrite. While not wishing to be limited to any particular mechanism, it is believed that the nitrate or nitrite source forms nitric oxide radicals during combustion of the smokable material, and it is believed that the metallic or carbonaceous particles catalyze the conversion of nitrate or nitrite to nitric oxide radical. The nitric oxide radicals are believed to act as a trap for other radicals that are responsible for formation of PAHs and other carcinogenic compounds.

While the compositions and methods of preferred embodiments generally refer to tobacco, particularly in the form of cigarettes, it is to be understood that such compositions and methods encompass any smokable material or smokable composition, as will be apparent to one skilled in the art.

The Catalyst System

In preferred embodiments, a catalyst system including catalytic metallic and/or carbonaceous particles and a nitrate or nitrite source is incorporated into the smokable material so as to reduce the concentration of certain undesirable components in the resulting smoke. In embodiments wherein the particles are metallic, the particles are preferably prepared by heating an aqueous solution of a metal ion source and a reducing agent, preferably a reducing sugar or a metal ion source with hydroxide. Preferably, after the metallic particles are formed in solution, the nitrate or nitrite source is added to the solution, and the solution is applied to the smokable material. However, embodiments in which the particles and the nitrate or nitrite source are added separately to the smokable material are also contemplated.

Metallic Particles

In preferred embodiments, particles of a catalytic metallic substance are applied to the smokable materials. The term "metallic", as used herein, is a broad term and is used in its ordinary sense, including without limitations, pure metals, mixtures of two or more metals, mixtures of metals and non-metals, metal oxides, metal alloys, mixtures or combinations of any of the aforementioned materials, and other substances containing at least one metal. Suitable catalytic metals include the transition metals, metals in the main group, and their oxides. Many metals are effective in this process, but preferred metals include, for example, Pd, Pt, Rh, Ag, Au, Ni, Co, and Cu.

Many transition and main group metal oxides are effective, but preferred metal oxides include, for example, AgO, ZnO, and $Fe_2O_3$. Zinc oxide and iron oxide are particularly preferred based on physical characteristics, cost, and carcinogenic behavior of the oxide. A single metal or metal oxide may be preferred, or a combination of two or more metals or metal oxides may be preferred. The combination may include a mixture of particles each having different metal or metal oxide compositions. Alternatively, the particles themselves may contain more than one metal or metal oxide. Suitable particles may include alloys of two or more different kinds of metals, or mixtures or alloys of metals and nonmetals. Suitable particles may also include particles having a metal core with a layer of the corresponding metal oxide making up the surface of the particle. The metallic particles may also include metal or metal oxide particles on a suitable support material, for example, a silica or alumina support. Alternatively, the metallic particles may include particles including a core of support material substantially encompassed by a layer of catalytically active metal or metal oxide. In addition to the above-mentioned configurations, the metallic particles may in any other suitable form, provided that the metallic particles have the preferred average particle size.

The particles may be prepared by any suitable method as is known in the art. When preparing metallic particles, suitable methods include, but are not limited to, wire electrical explosion, high energy ball milling, plasma methods, evaporation and condensation methods, and the like. However, in preferred embodiments, the particles are prepared via reduction of metal ions in aqueous solution, as described below.

While any suitable metal, metal oxide, or carbonaceous particle (as described below) is preferred, it is particularly preferred to use a metal, metal oxide, or carbonaceous particle that has a relatively low level of transfer to cigarette or other smoke condensate produced upon combustion of the smokable material. For example, palladium has a lower level of transfer than silver. Also, metal oxides tend to have relatively low levels of transfer. However, in certain embodiments it may be preferred to use a metal, metal oxide, or carbonaceous particle having a relatively high level of transfer to smoke condensate. In providing a compound that effectively catalyzes the decomposition of nitrate salts, it is also generally preferred that the metal, metal oxide, or carbonaceous particle have a relatively low specific heat.

Carbonaceous Particles

In certain embodiments, particles of a catalytic carbonaceous substance are applied to the smokable materials. The term "carbonaceous", as used herein, is a broad term and is used in its ordinary sense, including without limitations, graphitic carbon, fullerenes, doped fullerenes, carbon nanotubes, doped carbon nanotubes, other suitable carbon-containing substances, and mixtures or combinations of any of the aforementioned substances.

The carbonaceous particles may be prepared by any suitable method as is known in the art. When preparing graphitic particles suitable methods may include, but are not limited to, milling techniques, and the like.

Fullerenes include, but are not limited to, buckminster fullerene ($C_{60}$), as well as $C_{70}$ and higher fullerenes. The structure of fullerenes and carbon nanotubes may permit them to be doped with other atoms, for example, metals such as the alkali metals, including potassium, rubidium and cesium. These other atoms may be included within the carbon cage or carbon nanotube, as is observed for certain atoms when enclosed within endohedral fullerene. Atoms may also be incorporated into a crystal structure, e.g., the bct structure of A4C60 (wherein A=K,Rb,Cs, and C=buckminster fullerene) or the bcc structure of A6C60 (wherein A=K,Rb,Cs, and C=buckminster fullerene). Fullerenes may also be dimerized or polymerized. Certain fullerenes, such as $C_{70}$ fullerenes, are known radical traps and as such may be suitable for use in a catalyst system without the presence of nitrate or other radical trap generators.

Fullerenes are preferably prepared by condensing gaseous carbon in an inert gas. The gaseous carbon is obtained, for example, by directing an intense pulse of laser at a graphite surface. The released carbon atoms are mixed with a stream of helium gas, where they combine to form clusters of carbon atoms. The gas containing clusters is then led into a vacuum chamber where it expands and is cooled to a few degrees above absolute zero. The clusters are then extracted. Other suitable methods for preparing fullerenes as are known in the art may also be used.

Carbon nanotubes may be prepared by electric arc discharge between two graphite electrodes. In the electric arc discharge method, material evaporates from one electrode and deposits on the other in the form of nanoparticles and nanotubes. Purification is achieved by competitive oxidation in either the gas or liquid phase. Carbon nanotubes may also be catalytically grown. In catalytic methods, filaments containing carbon nanotubes are grown on metal surfaces exposed to hydrocarbon gas at temperatures typically between 500–1100° C. Other techniques for forming carbon nanotubes include laser evaporation techniques, similar to those used to form fullerenes. However, any suitable method for forming carbon nanotubes may be used.

Particle Size

The particles of preferred embodiments preferably have an average particle size of greater than about 0.5 micron (0.5 $\mu$m), more preferably greater than about 0.6, 0.7, 0.8, 0.9, 1, 1.1, 1.2, 1.3, 1.4, 1.5, 1.6, 1.7, 1.8, 1.9, or 2 $\mu$m. The preferred size may depend on the metallic or carbonaceous substance. Particle sizes can be as large as 150 $\mu$m or more, more preferably 150, 140, 130, 120, 110, 100, 90, 80, 70, 60, 50, 40, 30, 20, 19, 18, 17, 15, 14, 13, 12, 11, 10, 9, 8, 7, 6, 5, 4, 3 $\mu$m or less in diameter. In other embodiments, preferred particle size may be less than about 0.5 $\mu$m (500 nm), or 400, 300, 200, 100, 90, 80, 70, 60, 50, 40, 30, 20, 10, 9, 8, 7, 6, 5, 4, 3, 2, 1 nm or less. In preferred embodiments, the particles are of a substantially uniform size distribution, that is, a majority of the metallic particles present have a diameter generally within about ±50% or less of the average diameter, preferably within about ±45%, 40%, 35%, 30% or less of the average diameter, more preferably within ±25% or less of the average diameter, and most preferably within ±20% or less of the average diameter. The term "average" includes both the mean and the mode.

While a uniform size distribution may be generally preferred, individual particles having diameters above or below the preferred range may be present, and may even constitute the majority of the particles present, provided that a substantial amount of particles having diameters in the preferred range are present. In other embodiments, it may be desirable that the particles constitute a mixture of two or more particle size distributions, for example, a portion of the mixture may include a distribution on nanometer-sized particles and a portion of the mixture may include a distribution of micron-sized particles. The particles of preferred embodiments may have different forms. For example, a particle may constitute a single, integrated particle not adhered to or physically or chemically attached to another particle. Alternatively, a particle may constitute two or more agglomerated or clustered smaller particles that are held together by physical or chemical attractions or bonds to form a single larger particle. The particles may have different atomic level structures, including but not limited to, for example, crystalline, amorphous, and combinations thereof. In various embodiments, it may be desirable to include different combinations of particles having various properties, including, but not limited to, particle size, shape or structure, chemical composition, crystallinity, and the like.

Nitrate or Nitrite Source

Any suitable source of nitrate or nitrite may be preferred. Preferred nitrate or nitrite sources include the nitrate or nitrite salts of metals selected from Groups Ia, Ib, IIa, IIb, IIIa, IIIb, IVa, IVb, Va, Vb, and the transition metals of the Periodic Table of Elements.

In preferred embodiments, the nitrate or nitrite source includes a nitrate of lithium, sodium, potassium, rubidium, cesium, magnesium, calcium, strontium, yttrium, lanthanum, cerium, neodymium, samarium, europium, gadolinium, terbium, dysprosium, erbium, scandium, manganese, iron, rhodium, palladium, copper, zinc, aluminum, gallium, tin, bismuth, hydrates thereof and mixtures thereof. Preferably, the nitrate salt may be an alkali or alkaline earth metal nitrate. More preferably, the nitrate or nitrite source may be selected from the group of calcium, magnesium, and zinc with magnesium nitrate being the most preferred salt. In a particularly preferred embodiment, $Mg(NO_3)_2$-$6H_2O$ may be preferred as a nitrate source. While nitrate and nitrite salts are generally preferred, any suitable metal salt or organometallic compound, or other compound capable of releasing nitric oxide may be preferred.

While not wishing to be limited to any particular mechanism, it is believed that the nitrate or nitrite source forms nitric oxide radicals and that this reaction process is catalyzed by the metallic or carbonaceous particles in the combustion zone of tobacco. The nitric oxide radicals are believed to act as a trap for other organic radicals that are responsible for formation of PAHs and other carcinogenic compounds.

The temperature at which a particular nitrate or nitrite source decomposes to form nitric oxide may vary. Since a temperature gradient exists across the combustion zone of a tobacco rod, the choice and concentration of the nitrate or nitrite source may be selected so as to provide optimum production of nitric oxide during combustion. Certain nitrates and nitrites alone, especially those of the Group Ia metals, function as effective combustion promoters, accelerating the bum rate of the smokable material and decreasing the total smoke yield, but not necessarily decreasing the quantity of PAHs within the smoke. The nitric oxide yield of such nitrates may also be relatively low.

In certain embodiments, it may be preferred that the metal ion source and the nitrate or nitrite source constitute the same compound, for example, palladium(II) nitrate.

Catalyst Preparation

In preferred embodiments, metallic particles may be prepared from an aqueous solution. For example, metal particles may be prepared from an ion source containing one or more metal ion sources and one or more reducing sugars. Suitable metal ion sources include any ionic or organometallic compound that is soluble in aqueous solution and is capable of yielding metal ions that may be reduced to particles of a catalytic metal or utilized to form a metal oxide. In a particularly preferred embodiment, the catalytic source includes a metal such as palladium, and the palladium ion source includes water-soluble palladium salts. Illustrative non-limiting examples of suitable palladium salts include simple salts such as palladium nitrate, palladium halides such as palladium di or tetrachloride diammine complexes such as dichlorodiamminepalladium(II) ($Pd(NH_3)_2Cl_2$), and palladate salts, especially ammonium salts such as ammonium tetrachloropalladate(II) and ammonium hexachloropalladate(IV).

One form of palladium that may be especially preferred is ammonium tetrachloropalladate(II), $(NH_4)_2PdCl_4$. Ammonium tetrachloropalladate is generally preferred over ammonium hexachloropalladate because under typical conditions for preparing the metallic particles, a higher metal ion to metal conversion may be observed for ammonium tetrachloropalladate(II).

In a preferred embodiment, an aqueous solution of reducing agent is prepared, to which the metal ion source is added. In preferred embodiments, the reducing agent may be a reducing sugar, however other suitable reducing agents may be preferred. Although any compound capable of reducing the metal ion can be employed, as a practical matter the reducing agent is preferably non-toxic and preferably does not form toxic byproducts when pyrolyzed during smoking. In addition, the reducing agent is preferably water-soluble.

Preferred reducing agents are the reducing sugars, including organic aldehydes, including hydroxyl-containing aldehydes such as the sugars, for example glucose, mannose, galactose, xylose, ribose, and arabinose. Other sugars containing hemiacetal or keto groupings may be employed, for example, maltose, sucrose, lactose, fructose, and sorbose. Pure sugars may be employed, but crude sugars and syrups such as honey, corn syrup, invert syrup or sugar, and the like may also be employed. Other reducing agents include alcohols, preferably polyhydric alcohols, such as glycerol, sorbitol, glycols, especially ethylene glycol and propylene glycol, and polyglycols such as polyethylene and polypropylene glycols. In alternative embodiments, other reducing agents may be preferred such as carbon monoxide, hydrogen, or ethylene.

The solution is preferably heated before the metal ion source is added to the solution, and maintained at an elevated temperature afterwards so as to reduce the time for conversion of the metal ions to metallic particles. In a preferred embodiment, a reducing sugar such as low invert sugar may be preferred as the reducing agent. In certain embodiments, it may be desirable to have an excess or deficiency of reducing agent present in solution. Generally, it is preferred to prepare an aqueous solution containing from about 5 wt. % to about 20 wt. % of the reducing sugar, preferably about 6 wt. % to about 16 or 17 wt. %, more preferably from about 7, 8, 9, 10, or 11 wt. % to about 12, 13, 14, or 15 wt. %. When the reducing agent is invert sugar, it is preferred to prepare a 11 wt. % to about 12 wt. % solution. The amount of reducing agent preferred may vary depending on the type of reducing agent preferred and the amount of metal ion source to be added to the solution.

It may be preferred to prepare the solution in a glass-lined vessel equipped with a heating jacket. In certain embodiments, however, it may be preferred to prepare the solution in another kind of vessel constructed of or lined with another type of material, for example, plastic, stainless steel, ceramic, and the like. It is generally preferred to conduct the reaction in a closed vessel. In certain embodiments, it may be desirable to conduct the reaction under reduced pressure or elevated pressure, or under an inert atmosphere, such as nitrogen or argon.

In preparing the aqueous solution of the reducing sugar, it is preferred to use deionized ultrafiltered water. While in preferred embodiments the metallic particles are prepared from aqueous solution, in other embodiments it may be desirable to use another suitable solvent system, for example, a polar solvent such as ethanol, or a mixture of ethanol and water. Additional components may be present in the solution as well, provided that they do not substantially adversely impact the catalytic activity of the metallic particles.

After adding the reducing sugar to the deionized ultrafiltered water, the solution is preferably heated with constant mixing so as to avoid hot spots in the solution. Although in certain embodiments it may be desirable to prepare the particles from a room temperature solution, or even a solution cooled below room temperature, it is generally preferred to heat the solution so as to speed the reaction between the reducing sugar and the metal ion source once it is added to the solution. The solution may be heated to any suitable temperature, but boiling of the solution and decomposition of the reducing sugar is preferably avoided. In a preferred embodiment wherein low invert sugar is the reducing sugar, the solution is typically heated up to about 95° C. or more, preferably from above room temperature to about 90° C., more preferably from about 50° C., 55° C., 60° C., or 65° C. to about 85° C., and most preferably from about 70° C. or 75° C. to about 80° C.

The metal ion source is added to the heated aqueous solution of reducing agent, which is stirred while the metal ions react with the reducing sugar to produce metallic particles. It is generally preferred to add sufficient metal ion source so as to produce a solution containing from less than about 3000 ppm to more than about 5000 ppm metal. Preferably, sufficient metal ion source is added to produce a solution containing from about 3250, 3500, or 3750 ppm to about 4250, 4500, 4750 ppm metal, more preferably from about 3800, 3850, 3900, or 3950 ppm to about 4050, 4100, 4150, or 4200 ppm metal, and most preferably about 4000 ppm metal.

The reaction time for conversion of metal ion to metal particles may vary depending upon the reducing agent and metal ion source preferred, but generally ranges from about 30 minutes or less to about 24 hours or more, and typically ranges from about 1 or 2 hours up to about 3, 4, or 5 hours. In a preferred embodiment, wherein ammonium tetrachloropalladate is the metal ion source, a substantial conversion of palladium ion to palladium metal may be achieved after 3 hours for a solution heated to a temperature of about 75° C. Although in certain embodiments a lower conversion may be acceptable, it is generally desirable to achieve a conversion of metal ion to metal of at least 50%, preferably at least 60%, more preferably at least 70%, and most preferably at least 75, 80, 85% or more.

The metallic particles produced in this manner generally have diameters of about 1 $\mu$m or less. In certain other embodiments metallic particles having individual diameters and average diameters below about 20 nm or above about 1 $\mu$m may be produced. The size of the metallic particles may be conveniently determined using conventional methods of X-ray diffraction or other particle size determination methods, for example, laser scattering.

After a sufficient conversion of metal ion to metal or metal oxide is achieved, and the metallic particles are formed, the nitrate or nitrite source is added to the suspension. Any suitable compound that yields nitrate or nitrite ion in aqueous solution may be preferred. Preferably, the nitrate or nitrite source is an alkali metal or alkaline earth metal nitrate or nitrite. In a particularly preferred embodiment, the nitrate or nitrite source is magnesium nitrate, $Mg(NO_3)_2$-$6H_2O$. It is generally preferred to add a sufficient amount of nitrate or nitrite source so as to produce a solution containing from less than about 70 ppm to more than about 100 ppm nitrogen (in the form of nitrate or nitrite). Preferably, sufficient nitrate or nitrite source is added to produce a solution containing from about 75, 80, or 85 ppm to about 90 or 95 ppm nitrogen, more preferably from about 80 ppm nitrogen.

Generally, it is preferred that the suspension of metallic particles not be excessively concentrated or dilute, so as to facilitate efficient application of the suspension to the smokable material.

While it is generally preferred to prepare a suspension of particles as described above by reduction of metal ion in solution, followed by addition of the nitrate or nitrite source, in other embodiments it may be preferred to use a different method to prepare the particles. If the metallic or carbonaceous particles are not prepared in solution, the particles may be mixed with an appropriate liquid to form a suspension. Because of their high surface area, it may be difficult to sufficiently wet the surface of the particles so as to form a uniform suspension. In such cases, any suitable method may be preferred to facilitate forming the suspension, including, but not limited to, mechanical methods such as sonication or heating, or chemical methods such as the use of small quantities of surfactants, provided the surfactants do not interfere with the catalytic activity of the particles. Once the suspension is formed, addition of the nitrate or nitrite source may proceed as described above.

While it is generally preferred to apply the metallic or carbonaceous particles and nitrate or nitrite source to the smokable material in the form of a suspension, other methods of applying the particles and nitrate or nitrite source are also contemplated. For example, if the particles are in dry form, they may be added to the smokable material as a powder. It may be advantageous to moisten the smokable material with a suitable substance, for example, water, prior to application of the powder in order to provide better adhesion of the particles to the smokable material.

When the carbonaceous or metallic particles are added to the smokable material in powder form, the nitrate or nitrate source in solid form may also be applied to the smokable material in powder form, either in a separate step before or after the addition of the particles, or simultaneously with the particles, for example, in admixture with the particles. Suitable methods as are well known in the art may be used to prepare a suitable solid form of nitrate or nitrate source. In particularly preferred methods, the solid form of nitrate or nitrite source is prepared by freeze drying or spray drying methods, both of which may yield extremely small particle sizes. It is generally preferred that the nitrate or nitrite source be in the form of particles having an average diameter on the order of the preferred average diameters for the particles. The nitrate or nitrite source may also be provided as a solution applied to the smokable material as a separate step from adding the particle powder, preferably before adding the particle in dry form to the smokable material.

Optimization of the Catalyst System

There are many aspects to consider when attempting to optimize the catalyst system, the first of which is the conversion of the palladium salt to palladium metal in the aqueous reducing solution. This conversion requires a chemical reduction reaction in an aqueous solution. Earlier work was directed to the conversion of the palladium salt to palladium metal in a casing solution. It was suggested from the patent literature that the reducing agent for this reaction in the casing solution was fructose—a known reducing sugar. One origin of fructose in the casing solution is from low invert sugar. In order to try to repeat this earlier research with casing solutions and produce a more consistent/controllable reaction, all of the components in the casing solution were eliminated that were considered non-essential to the reduction reaction (e.g. propylene glycol, licorice, cocoa, and the like), while the components thought to be essential (e.g. water, palladium salt and low invert sugar) were retained in the same ratios as found in the casing solution, namely 93 g water to 1 g palladium salt to 8 g low invert sugar per pound of tobacco, respectively. Another component that was in the original casing solution but is considered non-essential to the reduction reaction was $Mg(NO_3)2\text{-}6H_2O$. This component was present in early formulations, however nitrate analysis of the tobacco verified that $Mg(NO_3)2\text{-}6H_2O$ decomposes to a certain degree when mixed in aqueous solutions containing palladium metal. It was also found through early testing that carcinogen reduction in cigarettes was not reproducible when the $Mg(NO_3)2\text{-}6H_2O$ was allowed to be in contact with palladium metal for extended periods of time. Upon removal of the $Mg(NO_3)2\text{-}6H_2O$ from the reacting solution, and instead the addition of it prior to catalyst application on the tobacco, consistent and reproducible carcinogen reductions in experimental cigarettes were obtainable.

One feature of the preferred reduction reaction is the percent conversion of palladium salt to palladium metal in the aqueous solution containing low invert sugar as a reducing agent. At a temperature of approximately 70–75° C., the percent conversion typically increases steadily with time and after the first three hours of the reaction more than 60–70% of the salt has typically been converted to the metal. Most of the palladium salt is typically converted to metal within the first hour (approximately 50%). Longer reaction times (for example, above three hours) generally only increase the percent conversion modestly. Given the task of balancing maximum conversion with an acceptable production schedule, three hours is generally preferred as the minimum time for this reaction to occur before application of the catalyst solution to the tobacco.

To increase production rates and lower production costs, it is desirable to increase the percent conversion of palladium salt to palladium metal. An immediate benefit of increasing the percent conversion is the capacity to use less total palladium salt in the reaction as an increase in percent conversion with less salt could in fact produce equivalent amounts of palladium metal in the reaction. This results in lower consumption of the most expensive reagent in the reaction.

Several possibilities exist to increase the percent conversion of this reaction. The reduction reaction is based on an aldehyde being oxidized and releasing electrons to the Pd II nucleus, thereby producing metallic palladium.

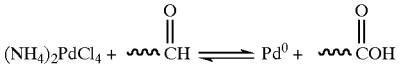

In a particularly preferred catalyst system as described above, it is believed that the aldehyde source is the reducing sugar fructose. In theory, any compound containing an aldehyde functional group can reduce the palladium salt to palladium metal, however to apply the resulting mixture to tobacco it is preferred that the reducing agent is non-toxic. As discussed previously in regard to the particularly preferred catalystsystem, low invert sugar is used as the "reducing agent" for this reaction and it is believed that the fructose component of low invert sugar is the active reducing agent. Interestingly, pure fructose when supplied as a reducing agent for the palladium reduction has been shown not to be very effective, even when the fructose is in 10 molar excess. This observation suggests that there is an additional "co-reducing agent" or possibly a catalyst for the reducing agent contained within the low invert sugar solution. Due to the complex mixture associated with low invert sugar it will continue to be a challenge to discover exactly what the reducing agent or agents are when utilizing low invert sugar as a reactant. Nevertheless, the particularly preferred system performs remarkably well given the fact that the mechanism for palladium reduction is not well understood in this system.

Application of Catalyst to Smokable Material

After the nitrate or nitrite source has been added to the suspension containing metallic or carbonaceous particles, it is applied to the smokable material. If the smokable material is tobacco, it is preferred to apply the suspension to cut filler prior to addition of the top flavor. If a top flavor is not applied, then it is preferred to apply the suspension to the cut filler as a final step, for example, before it is formed into a tobacco rod. The catalytic particles may be applied before, during or after application of a casing solution, however in a preferred embodiment the catalytic particles are applied after application of the casing solution. Casing solutions are pre-cutting solutions or sauces added to tobacco and are generally made up of a variety of ingredients, such as sugars and aromatic substances. Such casing solutions are generally added to tobacco in relatively large amounts, for example, one part casing solution to five parts tobacco.

The particles and nitrate or nitrite source are preferably well dispersed throughout the tobacco so as to provide uniform effectiveness throughout the entire mass of smokable material and throughout the entire period during which the material is smoked. In the case of cigarette tobacco wherein a blend of various tobaccos is preferred, the suspension may be applied to one or more of the blend constituents, or all of the blend constituents, as desired. Preferably, the suspension is applied to all of the blend constituents so as to ensure substantially uniform coverage of the particles and nitrate or nitrite source.

For certain types of suspensions of particles, a degradation in performance may be observed if an excessive period of time is allowed to elapse before the suspension is applied to the smokable product. This degradation in performance may be due to various factors, including loss of particles from the suspension due to their accumulation on the interior surfaces of the reaction vessel, or an undesirable increase in particle size over time. When the suspension includes palladium particles, the suspension is generally applied to the cut filler within about ten hours after the desired degree of metal ion conversion is reached and the nitrate or nitrite source is added to the suspension. The suspension is preferably applied within about 9, 8, 7, or fewer hours, more preferably within about 6, 5, or 4 hours, and most preferably within 3, 2, or 1 hours or less. However, in certain embodiments, including those utilizing palladium particles, it may be possible to apply the suspension after a delay of longer than ten hours while maintaining acceptable catalytic performance.

It is preferred to apply the suspension to the smokable material in the form of a fine mist, such as is produced using an atomizer. In a particularly preferred embodiment, the suspension is applied to tobacco, preferably cut filler, in a rotating tumbler equipped with multiple spray heads. Such a method of application ensures an even coating of the metallic particles on the tobacco product. The tobacco may be heated during or after application of the solution so as to facilitate evaporation of excess solvent.

It is preferred to add a sufficient quantity of the metallic or carbonaceous particle suspension to the smokable material such that the smokable material contains from about 500 ppm or less to about 1500 or more ppm of the metal or carbon in the form of catalytic particles. Preferably, the smokable material contains from about 500 ppm to about 1000, 1100, 1200, 1300, or 1400 ppm of the metal or carbon in the form of catalytic particles, more preferably 500, 600 or 700 to about 800, 900, or 1000 ppm, and most preferably about 800 ppm. It is generally preferred that the smokable material contains from about 0.4 to about 1.5 wt. % nitrogen (from nitrate or nitrite). Preferably, the smokable material contains from about 0.5 or 0.6 wt. % to about 1.0, 1.1, 1.2, 1.3, or 1.4 wt. % nitrogen, more preferably from about 0.6, 0.7, or 0.8 wt. % to about 0.9 wt. %, and most preferably about 0.9 wt. % nitrogen. In a preferred embodiment, one kilogram of tobacco constitutes 800 milligrams of metal or carbon in the form of catalytic particles, and 9 grams of nitrogen in the form of the nitrate or nitrite source.

Once the metallic or carbonaceous particles and nitrate or nitrite source have been applied, the smokable material may be further processed and formed into any desired shape or used loosely, for example, in cigars, cigarettes, or pipe tobacco, in any suitable manner as is well-known to those skilled in the art.

The Filter

In preferred embodiments wherein the smokable material to which the metallic or carbonaceous particles and nitrate or nitrite source have been applied is fashioned into a smokable article, a filter for the smokable article is provided. The filter can be provided in combination with cigarettes or cigars or other smokable devices containing divided tobacco or other smokable material. Preferably, the filter is secured to one end of the smokable article, positioned such that smoke produced from the smokable material passes into the filter before entering the smoker. Alternatively, the filter can be provided by itself, in a form suitable for attachment to a cigarette, cigar, pipe, or other smokable device utilizing the smokable material to which metallic or carbonaceous particles and nitrate or nitrate source have been applied according to preferred embodiments.

The filter according to preferred embodiments advantageously removes at least one undesired component from tobacco smoke or the smoke of any other smokable material. Undesired components in tobacco smoke may include permanent gases, organic volatiles, semivolatiles, and nonvolatiles. Permanent gases (such as carbon dioxide) make up 80 percent of smoke, and are generally unaffected by filtration or adsorption materials. The levels of organic volatiles, semivolatiles, and nonvolatiles may be reduced by filters of various designs. The filters according to preferred embodiments may advantageously remove undesired components including, but not limited to, tar, nicotine, carbon monoxide, nitrogen oxides, HCN, acrolein, nitrosamines, particulates, oils, various carcinogenic substances, and the like.

The filter preferably permits satisfactory or improved smoke flavor, nicotine content, and draw characteristics. The filter is preferably designed to be acceptable to the user, being neither cumbersome nor unattractive. Further, filters according to preferred embodiments may be made of inexpensive, safe and effective components, and may preferably be manufactured with standard cigarette manufacturing machinery.

The filter may incorporate one or more materials capable of absorbing, adsorbing, or reacting with at least one undesirable component of tobacco smoke. Such absorbing, adsorbing, or reacting materials may be incorporated into the filter using any suitable method or device. In a preferred embodiment, the absorbing, adsorbing, or reacting material may be contained within a smoke-permeable cartridge to be placed within the filter, or contained within a cavity within the filter. In another embodiment, the absorbing, adsorbing, or reacting material is deposited on and/or in the filter material.

Application methods may include forming a paste of the absorbing, adsorbing, or reacting material in a suitable liquid, applying the paste to the filter material, and allowing the liquid to evaporate. Alternatively, the absorbing, adsorbing, or reacting material may be mixed with an adhesive substance and applied to the filter material. All of the filter material may include the absorbing, adsorbing, or reacting material, or only a portion of the filter material may include the adsorbing or reacting material. The portion of the filter material containing the absorbing, adsorbing, or reacting material is generally referred to as a "a smoke-altering filter segment."

The cigarette filters of the preferred embodiments preferably include activated carbon (commonly referred to as charcoal) as an adsorbing material. The process by which activated carbon removes compounds is adsorption, which is a different process than absorption. Absorption is the process whereby absorbates are dispersed throughout a porous absorbent, while adsorption is a surface attraction effect. Both adsorption and absorption can be physical or chemical effects. The adsorptive effect associated with activated carbon is mainly a physical effect. In activated carbon filters, smoke compounds in the organic volatile and semivolatile phases diffuse through the carbon particles, move over the surface and then move into the activated carbon pores compelled by a phenomenon known as Van der Waal's forces. Although these forces are generally considered weak, at very short range (one or two molecular diameters), they are strong enough to attract and effectively hold smoke components.

Activated carbon may be obtained from a variety of sources, including, but not limited to, wood, coconut shells, coal, and peat. Wood generally produces soft and macroporous activated carbon (pores from 50 to 1,000 nm in diameter). Peat and coal materials generally produce activated carbon that is predominantly mesoporous (pores 2 to 50 nanometers in diameter). Activated carbon derived from coconut shells is generally microporous (pores of less than 2 nm in diameter), has a large surface area, and has a low ash and base metal content when compared to certain other types of activated carbon.

Preferred activated carbons are microporous and have a high density, which imparts improved structural strength to the activated carbon so that it can resist excessive particle abrasion during handling and packaging.

The filters of preferred embodiments may also contain various other adsorptive, absorptive, or porous materials in addition to activated carbon as described above. Examples of such materials, include, but are not limited to, cellulosic fiber, for example, cellulose acetate, cotton, wood pulp, and paper; polymeric materials, for example, polyesters and polyolefins; ion exchange materials; natural and synthetic minerals such as activated alumina, silica gel, and magnesium silicate; natural and synthetic zeolites and molecular sieves (see, for example U.S. Pat. No. 3,703,901 to Norman et al., incorporated herein by reference in its entirety); natural clays such as meerschaum; diatomaceous earth; activated charcoal and other materials as will be understood by those with skill in the art. The adsorptive, absorptive, or porous material may be any nontoxic material suitable for use in filters for smokable devices that are compatible with other substances in the smoking device or smoke to be filtered.

Typically, the filter element may include as the major component a porous material, for example, cellulose acetate tow or cellulosic paper, referred to below as a "filter material." The adsorptive or absorptive component, often a granular or particulate substance such as activated carbon, is generally dispersed within the porous filter material of the filter segment or positioned within a cartridge or cavity (for example, within a cavity of a triple filter, as discussed below).

The filter material may have the form of a non-woven web of fibers or a tow. Alternatively, the filter material may have a sheet-like form, particularly when the material is formed from a mixture of polymeric or natural fibers, such as cotton or wood pulp. Filter material in web or sheet-like form can be gathered, folded, crimped, or otherwise formed into a suitable (for example, cylindrical) configuration using techniques which will be apparent to one skilled in the art. See, for example, U.S. Pat. No. 4,807,809 to Pryor et al., which is incorporated herein by reference in its entirety.

In preferred embodiments, the filter material constitutes cellulose acetate tow or cellulose paper. Cellulose acetate tow is the most widely preferred filter material in cigarettes worldwide. Cellulose paper filter materials generally provide better tar and nicotine retention than do acetate filters with a comparable pressure drop, and have the added advantage of superior biodegradability. Cellulose and cellulose acetate reduce the amount of chemicals in the semi-volatile phase and the nonvolatile phase, which is composed of solid particulates (commonly referred to as "tar"). These compounds are reduced in direct proportion to the amount of cellulose or cellulose acetate in the filter. Increasing density of the cellulose or cellulose acetate generally means increasing the pressure drop, which increases the filter retention and therefore decreases tar delivery. Filters retain generally less than 10 percent of vapor phase components.

In certain embodiments, it may be preferred to use a polymeric material such as cellulose acetate as the filter material rather than a material such as cellulose paper. Polymeric materials may be preferred in embodiments wherein superior chemical inertness or structural integrity during use are desired attributes of the filter, for example, when certain smoke altering components reactive to cellulose paper are present in the filter, or when components reactive to cellulose paper are generated within the filter. Cellulose acetate tow (such as that available from Celanese Acetate of Charlotte, N.C.) is the most commonly preferred polymeric material, however suitable polymeric materials may include other synthetic addition or condensation polymers, such as polyamides, polyesters, polypropylene, or polyethylene.

The polymeric material may be any nontoxic polymer suitable for use in filters for smokable devices that are compatible with other substances in the smoking device or smoke to be filtered, and which possess the desired degree of inertness. The polymeric material is preferably in fibrous tow form, but may optionally be in other physical forms, for example, crimped sheet. The polymeric material may constitute a single polymer or a mixture of different polymers, for example, two or more of components such as homopolymers, copolymers, terpolymers, functionalized polymers, polymers having different molecular weights, polymers constituting different monomers, polymers constituting two or more of the same monomers in different proportions, oligomers, and nonpolymeric components. The polymer may also be subjected to suitable pre-treatment or post-treatment steps, for example, functionalization of the polymer, coating with suitable materials, and the like.

When polymeric fibers are the filter material, they can make up all or a portion of the composition of the filter material of the filter. Alternatively, the filter material can be a mixture or blend of polymer fibers, or a mixture or blend of polymer fibers and nonpolymeric fibers, for example, cellulose fibers obtained from wood pulp, purified cellulose, cotton fibers, or the like. A mixture of filter materials may be preferred in certain embodiments where it is desired to reduce materials costs, as polymeric materials may be more expensive than natural fibers. Any suitable proportion of polymeric material may be present, from 100% by weight polymeric material down to 80, 60, 50, 40, 30, 25, 20, 15, or 10% by weight or less polymeric material.

As discussed above, in certain embodiments it may be desirable to coat the filter material with one or more substances that may react chemically with an undesirable component of the smoke. Such substances may include natural or synthetic polymers, or chemicals known in the art to provide for a treated filter material capable of altering the chemistry of tobacco smoke. One method for coating the filter material is to prepare a solution or dispersion of the substance with a suitable solvent. Suitable solvents may include, for example, water, ethanol, acetone, methyl ethyl ketone, toluene, or the like.

The solution or dispersion can be applied to the surface of the filter material using gravure techniques, spraying techniques, printing techniques, immersion techniques, injection techniques, or the like. Most preferably, the filter material is essentially insoluble in the preferred solvent, and as such does not substantially affect the general structure of the filter material. After the solution or dispersion is applied to the surface of the filter material, the solvent is removed, typically by air-drying at room temperature or heating, for example, in a convection or forced-air oven. The amount of solution or dispersion which is applied to the filter material is typically sufficient to cover the outer surface of the filter material, but not sufficient to fill the void spaces between the fibers of filter material.

Typically, the amount of solution or dispersion applied to the filter material is sufficient to deposit at least about 5 percent, preferably at least about 8 percent, more preferably at least about 10 percent, and most preferably at least about 15 percent of the substance, based on the weight of the filter material prior to treatment.

When the substance is a polymer, the polymer can be synthetic polymer or a natural polymer. Synthetic polymers are derived from the polymerization of monomeric materials (for example, addition or condensation polymers) or are isolated after chemically altering the substituent groups of a polymeric material. Natural polymers are isolated from organisms (for example, plants such as seaweed), usually by extraction.

Exemplary synthetic polymers that may be applied to filter materials include, but are not limited to, carboxymethylcellulose, hydroxypropylcellulose, cellulose esters such as cellulose acetate, cellulose butyrate and cellulose acetate propionate (for example, from Eastman Chemical Corp. of Kingsport, Tenn.), polyethylene glycols, water dispersible amorphous polyesters with aromatic dicarboxylic acid functionalities (for example, Eastman AQs from Eastman Chemical Corp. of Kingsport, Tenn.), ethylene vinyl alcohol copolymers (for example, from Mica Corp. of Shelton, Conn.), partially or fully hydrolyzed polyvinyl alcohols (for example, the Airvols from Air Products and Chemicals of Allentown, Pa.), ethylene acrylic acid copolymers (for example, Envelons from Rohm and Haas of Philadelphia, Pa. and Primacors from The Dow Chemical Co. of Wilmington, Del.), polysaccharides (for example, Keltrol from CP Kelco of San Diego, Calif.), alginates (for example, from International Specialty Products of Wayne, N.J.), carrageenans (for example, Viscarin GP109 and Nutricol GP120F konjac flour from FMC) and starches (for example, Nadex 772, K-4484 and N-Oil from National Starch & Chemical Co.).

Typically, natural or synthetic polymers tend to coat the surface of the filter material very efficiently, and have a high viscosity, making high coating levels unnecessary and sometimes difficult. Typically, certain natural or synthetic polymers can be applied to the filter material at levels of at least about 0.001 percent, preferably at least about 0.01 percent, more preferably at least about 0.1 percent, and most preferably at least about 1 percent, based on the weight of the filter material prior to treatment. Typically, the amount of certain natural or synthetic polymers applied to the filter material does not exceed about 10 percent, and normally does not exceed about 5 percent, based on the weight of the filter material prior to treatment.

The natural or synthetic polymeric material which is applied to the filter material can vary, depending upon factors such as the chemical functionality, hydrophilicity or hydrophobicity desired. If desired, more than one type of natural or synthetic polymer can be applied to the filter material in a single dispersion or solution. If desired, the filter material can have at least one type of natural or synthetic polymer dissolved or dispersed in a suitable solvent applied thereto and the solvent removed, after which the resulting coated filter material has at least one other natural or synthetic polymer applied in similar fashion. If multiple applications are conducted in this way, it is desirable that the solvent or solvents do not substantially dissolve any natural or synthetic polymer already coated onto the filter material.

Filters of preferred embodiments may include more than one segment. One configuration of such filters is the dual filter, wherein the filter constitutes two different segments, with one segment adjacent to the mouth and the other segment of the filter adjacent to the tobacco rod. A common type of dual filter is one wherein a cellulose acetate segment is situated on the mouth side of the filter, and a cellulose paper segment is situated on the side of the filter adjacent to the tobacco rod. Activated charcoal may be incorporated into the cellulose paper segment of the filter to assist in removal of undesired components from tobacco smoke.

Another filter configuration, referred to as a triple filter, has three segments, including a segment adjacent to the mouth, a segment adjacent to the tobacco rod, and a segment situated between the two other segments. The different segments may be prepared from different materials, or may be materials having the same composition but different physical form, for example, crimped sheet or tow, or may be materials having the same composition and physical form, but wherein one segment contains an additional component not present in another segment. A common triple filter configuration includes two segments selected from one or both of cellulose acetate and cellulose, one adjacent to the mouth and one adjacent to the filter, with a segment in between containing a smoke altering component. Examples of smoke altering components include activated carbon or other absorbents, or components imparting flavor to the smoke.

One variety of triple filter is the cavity filter. The cavity filter is composed of two segments separated by a cavity containing one or more smoke altering components. The cavity may contain an adsorbent material as described above, optionally in combination with other suitable components such as activated charcoal.

Dual and triple filters may be symmetrical (all filter segments are the same length) or asymmetrical (two or more segments are of different lengths). Filters may be recessed, with an open cavity on the mouth side, reinforced by an extra stiff plug wrap paper.

When the filter element contains a solid material in a form other than tow or sheet, it may be incorporated into the filter element using any suitable method or device, such as those described above for incorporating an absorbing, adsorbing, or reacting material into the filter element. Liquids may be incorporated into the porous filter material by immersing the filter material in the liquid, spraying the liquid onto the filter material, or combining the liquid with another component, for example, a component capable for forming a gel or a solid, then applying the liquid-containing substance to the porous filter material using methods well known to those skilled in the art.

The form of the filter material and the configuration of the filter material, as well as the filtration efficiency for particulate matter and vapor phase components of each segment of the filter element may be varied so as to yield the desired balance of performance characteristics for the filter element, as will be recognized by those skilled in the art. Filter materials in tow form can be processed and manufactured into filter rods using known techniques. Filter materials in sheet-like or web form can be formed into filter rods using techniques described in U.S. Pat. No. 4,807,809 to Pryor et al., and U.S. Pat. No. 5,074,320 to Jones, Jr. et al. Filter materials also can be formed into rods using a rod-making unit (for example, from Molins Tobacco Machinery, Ltd. of Bucks, United Kingdom).

The porous filter material may contain various additional minor components. These components may include pigments, dyes, preservatives, antioxidants, defoamers, solvents, lubricants, waxes, oils, resins, adhesives, and other materials, as are known in the art.

In a preferred embodiment, the smoking article is provided with a cavity filter composed of two cellulose acetate segments separated by a cavity containing activated charcoal, wherein the filter segments are wrapped in a paper plug wrap. The plug wrap may be provided with perforations in the cellulose acetate segment adjacent to the tobacco rod if air dilution is desired, for example, for low or ultra-low tar cigarettes. The cellulose acetate segment adjacent to the tobacco rod is preferably about 9 mm in length, the mouth end segment is preferably 11 mm in length, and the cavity is preferably 5 mm in length. The cavity is preferably substantially filled. Substantially filled generally refers to a cavity segment wherein more than about 95 vol. % is filled with packed particles, preferably more than about 96, 97, 98, or 99 vol. % is filled with packed particles, and most preferably about 100 vol. % is filled with packed particles. However, in certain embodiments it may be desirable for the cavity to be less than substantially filled, for example, less than about 95, 94, 93, 92, 91, 90, 85, 80, 75, 70, 65, 60, 55, 50, 45, 40, 35, 30, 25, 20, 15, 10, or 5 vol. % or less. In a preferred embodiment, the cavity is substantially filled with one type of activated charcoal. However, in certain other embodiments the activated charcoal may constitute a mixture of activated charcoals (for example, charcoals of varying particle size or source), or the activated charcoal may be mixed or combined with one or more inert ingredients, such as magnesium silicate (available as CAVIFLEX™ and SEL-X-4™ from Baumgartner, Inc. of Melbane, N.C.), inert carbon, or semolina. Most preferably, the cavity segment contains 0.1 g of a single type of activated charcoal as the sole component in a 5 mm long cavity segment of filter. In various embodiments various types of activated charcoal or carbon prepared from different starting materials, having different surface area and particle size, or having different properties may be preferred. Suitable activated carbons, including specialty activated carbons, may be obtained from Calgon Carbon Corporation of Pittsburgh, Pa.

Additives

Additional components, as are known in the art, may also be added to the smokable material, or may be contained within the filter, the tobacco rod, or other components of the smoking articles of preferred embodiments. Nonlimiting examples of such components include tobacco extracts, lubricants, flavorings, and the like. These additional components preferably do not react with the metallic or carbonaceous particles or nitrate or nitrite source on the smoking material in such a way as to substantially reduce their effectiveness in reducing PAHs or other undesirable components in smoke during use. To the extent that such reactions do occur, they can be compensated for by alterations in the concentration of the metallic or carbonaceous particles, the nitrate or nitrite source, and/or the additional components.

The filter element optionally can include a tobacco or flavor extract in intimate contact with the filter material. If desired, the tobacco or flavor extract can be spray dried and/or subjected to heat treatment. The filter element prior to smoking may include less than about 10% tobacco or flavor extract to more than 50% percent tobacco or flavor extract, based on the total dry weight of the filter element and extract. In some embodiments, the tobacco Filter elements typically include a lubricating substance in intimate contact with the filter material. Normally, prior to smoking the cigarette, the filter element includes at least about 0.1 percent lubricating substance, based on the weight of the filter material of that segment. The lubricating substance can be a low molecular weight liquid (for example, glycerine) or a high molecular weight material (for example, an emulsifier).

Flavorants such as menthol can be incorporated into the cigarette using techniques familiar to the skilled artisan. If desired, flavor additives such as organic acids can be incorporated into the cigarette as additives to cut filler. See, for example, U.S. Pat. No. 4,830,028 to Lawson et al. The metallic or carbonaceous particles and nitrate or nitrite source are preferably applied to the cut filler prior to addition of flavorants or flavor extract is between 15%, 20%, 25% or 30% and 35%, 40%, or 45%, of the total dry weight of the filter element and the extract.

The Smokable Material

The metallic or carbonaceous particles and nitrate or nitrite source may be applied to any suitable smokable material. Examples of preferred smokable materials are the tobaccos that include but are not limited to Oriental, Virginia, Maryland, and Burley tobaccos, as well as the rare and specialty tobaccos. The tobacco plant may be a variety produced through conventional plant breeding methods, or may be a genetically engineered variety. Low nicotine and/or low TSNA tobacco varieties, including genetically engineered varieties, are especially pre ferred. The tobacco may be cured using any acceptable method, including, but not limited to, flue-curing, air-curing, sun-curing, and the like, including curing methods resulting in low nitrosamine levels, such as the curing methods disclosed in U.S. Pat. Nos. 6,202,649 and 6,135,121 to Williams.

Generally, the tobacco material is aged. The cured or uncured tobacco may be subjected to any suitable processing step, including, but not limited to, microwave or other radiation treatment, treatment with ultraviolet light, or extraction with an aqueous or nonaqueous solvent.

The tobacco can be in the form of tobacco laminae, processed tobacco stems, reconstituted tobacco material, volume expanded tobacco filler, or blends thereof. The type of reconstituted tobacco material can vary. Certain suitable reconstituted tobacco materials are described in U.S. Pat. No. 5,159,942 to Brinkley et al. Certain volume expanded tobacco materials are described in U.S. Pat. No. 5,095,922 to Johnson et al. Blends of the aforementioned materials and tobacco types can be employed. Exemplary blends are described in U.S. Pat. No. 5,074,320 to Jones, Jr. et al. Other smokable materials, such as those smokable materials described in U.S. Pat. No. 5,074,321 to Gentry et al., and U.S. Pat. No. 5,056,537 to Brown et al., also can be employed.

The smokable materials generally are employed in the form of cut filler as is common in conventional cigarette manufacture. For example, the smokable filler material can be employed in the form of pieces, shreds or strands cut into widths ranging from about 1/5 inch (5 mm) to about 1/60 inch (0.04 mm), preferably from about 1/20 inch (1.3 mm) to about 1/40 inch (0.6 mm). Generally, such pieces have lengths between about 0.25 inch (6 mm) and about 3 inches (76 mm). In certain embodiments, however, it may be preferred to use cut filler having widths more than about 1/5 inch (5 mm) or less than about 1/60 inch (0.04 mm), and lengths less than about 0.25 inch (6 mm) or more than about 3 inches (76 mm).

The smokable material can have a form (for example, a blend of smokable materials, such as a blend of various types of tobacco in cut filler form) having a relatively high nicotine content. Such a smokable material typically has a dry weight nicotine content above about 2.0%, 2.25%, 2.5%, 2.75%, or 3.0% or more. Such smokable materials are described in U.S. Pat. No. 5,065,775 to Fagg.

Alternatively, the smokable material can have a form having a relatively low or negligible nicotine content. Such a smokable material typically has a dry weight nicotine content below about 1.5%, 1.25%, 1.0%, 0.75%, 0.5%, 0.1%, 0.05% or less. Tobacco having a relatively low nicotine content is described in U.S. Pat. No. 5,025,812 to Fagg et al.

As used herein, the term "dry weight nicotine content" in referring to the smokable material is meant the mass alkaloid nicotine as analyzed and quantitated by spectroscopic techniques divided by the dry weight of the smokable material analyzed. See, for example, Harvey et al., *Tob. Sci.*, Vol. 25, p. 131 (1981).

In a preferred embodiment, the smokable material constitutes a tobacco product obtained from tobacco plants that are substantially free of nicotine and/or tobacco-specific nitrosamines (TSNAs). Tobaccos that may be substantially free of nicotine or TSNAs may be produced by interrupting the ability of the plant to synthesize nicotine using genetic engineering. Copending provisional application Ser. No. 60/297,154 filed Jun. 8, 2001, filed Jun. 8, 2001 and WO9856923 to Conkling et al. (both incorporated herein by reference in their entirety) describe tobacco that is substantially free of nicotine and TSNAs that is made by exposing at least one tobacco cell of a selected variety to an exogenous DNA construct having, in the 5' to 3' direction, a promoter operable in a plant cell and DNA containing a portion of a DNA sequence that encodes an enzyme in the nicotine synthesis pathway. The DNA is operably associated with the promoter, and the tobacco cell is transformed with the DNA construct, the transformed cells are selected, and at least one transgenic tobacco plant is regenerated from the transformed cells. The transgenic tobacco plants contain a reduced amount of nicotine and/or TSNAs as compared to a control tobacco plant of the same variety. In preferred embodiments, DNA constructs having a portion of a DNA sequence that encodes an enzyme in the nicotine synthesis pathway may have the entire coding sequence of the enzyme, or any portion thereof.

In a preferred embodiment, the smokable material constitutes a tobacco product obtained from tobacco plants that have reduced nicotine content and/or TSNAs such as those described in copending provisional application Ser. No. 60/229,198, filed Aug. 30, 2000 (incorporated herein by reference in its entirety).

Tobacco products having specific amounts of nicotine and/or TSNAs may be created through blending of low nicotine/TSNA tobaccos such as those described above with conventional tobaccos. Some blending approaches begin with tobacco prepared from varieties that have extremely low amounts of nicotine and/or TSNAs. By blending prepared tobacco from a low nicotine/TSNA variety (for example, undetectable levels of nicotine and/or TSNAs) with a conventional tobacco (for example, Burley, which has 30,000 parts per million (ppm) nicotine and 8,000 parts per billion (ppb) TSNA; Flue-Cured, which has 20,000 ppm nicotine and 300 ppb TSNA; and Oriental, which has 10,000 ppm nicotine and 100 ppb TSNA), tobacco products having virtually any desired amount of nicotine and/or TSNAs can be manufactured. Tobacco products having various amounts of nicotine and/or TSNAs can be incorporated into tobacco use cessation kits and programs to help tobacco users reduce or eliminate their dependence on nicotine and reduce the carcinogenic potential.

For example, a step 1 tobacco product can constitute approximately 25% low nicotine/TSNA tobacco and 75% conventional tobacco; a step 2 tobacco product can constitute approximately 50% low nicotine/TSNA tobacco and 50% conventional tobacco; a step 3 tobacco product can constitute approximately 75% low nicotine/TSNA tobacco and 25% conventional tobacco; and a step 4 tobacco product can constitute approximately 100% low nicotine/TSNA tobacco and 0% conventional tobacco. A tobacco use cessation kit can include an amount of tobacco product from each of the aforementioned blends to satisfy a consumer for a single month program. That is, if the consumer is a one pack a day smoker, for example, a single month kit provides 7 packs from each step, a total of 28 packs of cigarettes. Each tobacco use cessation kit may include a set of instructions that specifically guide the consumer through the step-by-step process. Of course, tobacco products having specific amounts of nicotine and/or TSNAs may be made available in conveniently sized amounts (for example, boxes of cigars, packs of cigarettes, tins of snuff, and pouches or twists of chew) so that consumers could select the amount of nicotine and/or TSNA they individually desire. There are many ways to obtain various low nicotine/low TSNA tobacco blends using the teachings described herein and the following is intended merely to guide one of skill in the art to one possible approach.

To obtain a step 1 tobacco product, which is a 25% low nicotine/TSNA blend, prepared tobacco from an approximately 0 ppm nicotine/TSNA tobacco can be mixed with conventional Burley, flue-cured, or Oriental in a 25%/75% ratio respectively to obtain a Burley tobacco product having 22,500 ppm nicotine and 6,000 ppb TSNA, a flue-cured product having 15,000 ppm nicotine and 225 ppb TSNA, and an Oriental product having 7,500 ppm nicotine and 75 ppb TSNA. Similarly, to obtain a step 2 product, which is 50% low nicotine/TSNA blend, prepared tobacco from an approximately 0 ppm nicotine/TSNA tobacco can be mixed with conventional Burley, flue-cured, or Oriental in a 50%/50% ratio respectively to obtain a Burley tobacco product having 15,000 ppm nicotine and 4,000 ppb TSNA, a flue-cured product having 10,000 ppm nicotine and 150 ppb TSNA, and an Oriental product having 5000 ppm nicotine and 50 ppb TSNA. Further, a step 3 product, which is a 75%/25% low nicotine/TSNA blend, prepared tobacco from an approximately 0 ppm nicotine/TSNA tobacco can be mixed with conventional Burley, flue-cured, or Oriental in a 75%/25% ratio respectively to obtain a Burley tobacco product having 7,500 ppm nicotine and 2,000 ppb TSNA, a flue-cured product having 5,000 ppm nicotine and 75 ppb TSNA, and an Oriental product having 2,500 ppm nicotine and 25 ppb TSNA.

It is appreciated that tobacco products are often a blend of many different types of tobaccos, which were grown in many different parts of the world under various growing conditions. As a result, the amount of nicotine and TSNAs may differ from crop to crop. Nevertheless, by using conventional techniques one can easily determine an average amount of nicotine and TSNA per crop used to create a desired blend. By adjusting the amount of each type of tobacco that makes up the blend one of skill can balance the amount of nicotine and/or TSNA with other considerations such as appearance, flavor, and smokability. In this manner, a variety of types of tobacco products having varying level of nicotine and/or nitrosamine, as well as, appearance, flavor and smokability can be created. Such types of tobacco products may behave in similar manners when the metallic or carbonaceous particles and nitrate or nitrite source of preferred embodiments are applied thereto.

While in the preferred embodiments the metallic or carbonaceous particles and nitrate or nitrite source are applied to a smokable material including tobacco, any other smokable materials may preferred in other embodiments. For example, the metallic or carbonaceous particles and nitrate or nitrite source may be applied to smokable plant materials as are commonly preferred in various herbal smoking materials. Mullein and Mugwort are commonly preferred base materials in blends of herbal smoking materials. Some other commonly preferred plant materials that are also smokable materials include Willow bark, Dogwood bark, Pipsissewa, Pyrola, Kinnikinnik, Manzanita, Madrone Leaf, Blackberry, Raspberry, Loganberry, Thimbleberry, and Salmonberry.

The catalyst systems of preferred embodiments may be applied to any smokable material in order to reduce the amounts of certain undesired components in the smoke produced by burning the smokable material. However, the degree of reduction in the level of one or more of such undesired components, as well as the resulting amount of such undesired components may vary depending upon the type of smokable material used.

The Wrapping Material

The wrapping material which circumscribes the charge of smokable material can vary. Examples of suitable wrapping materials are cigarette paper wrappers available from Schweitzer-Mauduit International in Alpharetta, Ga. Cigarette paper wraps the column of tobacco in a cigarette and can be made from flax, wood, or a combination of fibers. Certain properties such as basis weight, porosity, opacity, tensile strength, texture, ash appearance, taste, brightness, good gluing, and lack of dust are selected to provide optimal performance in the finished product, as well as to meet runnability standards of the high-speed production processes preferred by cigarette manufacturers.

A more porous paper is one that allows air to easily pass into a cigarette. Porosity is measured in Coresta units and can be controlled to determine the rate and direction of airflow through the cigarette. The higher the number of Coresta units, the more porous the paper. Tar and nicotine yields are commonly controlled without altering the flavor of the cigarette through the choice of paper. The use of highly porous papers can help create lower tar levels in the cigarette. Higher paper porosity increases the combustibility of a cigarette by adding more air to the process, which increases the heat and the burning rate. A higher burn rate may lower the number of puffs that a smoker takes per cigarette. Papers having porosities up to 200 Coresta units or higher are generally preferred, however different kinds of cigarettes may use papers of preferred porosities. For example, American-blend cigarettes typically use 40 to 50 Coresta unit papers. Flue-cured tobacco cigarettes, which burn slower, generally use higher porosities, ranging from 60 to 80 Coresta unit papers. Higher porosities may be obtained by electronically perforating (EP) the paper.

Cigarette papers are available that are prepared from various base fibers. Flax and wood are commonly preferred base fibers. In addition to 100% flax and 100% wood papers, papers are also available with flax and wood fibers mixed in various ratios. Wood based papers are widely preferred because of their low cost, however certain consumers prefer the taste of flax based papers.

Suitable cigarette papers may be obtained from RFS (US) Inc., a subsidiary of privately-held PURICO (IOM) Limited of the United Kingdom, which is the current owner of P. H. Glatfelter Company's Ecusta mill which manufactures tobacco papers. In preferred embodiments, a paper having a porosity of about 26 Coresta EP to 90 Coresta EP is preferred. Suitable papers include Number 409 papers having a porosity of 26 Coresta and 0.85% citrate content, and Number 00917 papers having a porosity of 26 Coresta EP. However, in certain embodiments, it may be preferred to use a paper having a lower air permeability, for example, a paper that has not been subjected to electronic perforation and which has a low inherent porosity, for example, less than 26 Coresta.

In preferred embodiments, the cigarette paper is suitable for use in "self-extinguishing" cigarettes. Examples of cigarette papers suitable for use in self-extinguishing cigarettes include, for example, papers saturated with a citrate or phosphate fire retardant or incorporating one or more fire retardant bands along the length of the paper. Such papers may also be thicker papers of reduced flammability.

Wrapping materials described in U.S. Pat. No. 5,220,930 to Gentry may be preferred in certain embodiments. More than one layer of circumscribing wrapping material can be employed, if desired. See, for example, U.S. Pat. No. 5,261,425 to Raker et al. Other wrapping material includes plug wrap paper and tipping paper. Plug wrap paper wraps the outer layer of the cigarette filter plug and holds the filter material in cylindrical form. Highly porous plug wrap papers are preferred in the production of filter-ventilated cigarettes.

Tipping paper joins the filter element with the tobacco rod. Tipping papers are typically made in white or a buff color, or in a cork pattern, and are both printable and glueable at high speeds. Such tipping papers are used to produce cigarettes that are distinctive in appearance, as well as to camouflage the use of activated carbon in the filter element. Pre-perforated tipping papers are commonly preferred in filter-ventilated cigarettes.

In the case of cigars, reconstituted tobacco wrapper is often wrapped around the outside of machine-made cigars to provide a uniform, finished appearance. The wrapper material can incorporate printed veins to give the look of natural tobacco leaf. Such wrapper material is manufactured utilizing tobacco leaf by-products. Reconstituted tobacco binder holds the "bunch" or leaves of tobacco in a cylindrical shape during the production of machine-made cigars. It is also manufactured utilizing tobacco leaf by-products.

An extremely small amount of a sideseam adhesive is preferred to secure the ends of the cigarette paper wrapper around the tobacco rod (and filter element, if present). Any suitable adhesive may be used. In a preferred embodiment, the sideseam adhesive is an emulsion of ethylene vinyl acetate copolymer in water.

The cigarette wrapper may include extremely small amounts of inks containing oils, varnishes, pigments, dyes, and processing aids, such as solvents and antioxidants. Ink components may include such materials as linseed varnish, linseed oil polymers, white mineral oils, clays, silicas, natural and synthetic pigments, and the like, as are known in the art.

Smoking Articles

The smoking articles of the preferred embodiments may have various forms. Preferred smoking articles may be typically rod-shaped, including, for example, cigarettes and cigars. In addition, the smoking article may be tobacco for a pipe. For example, the smoking article can have the form of a cigarette having a smokable material (for example, tobacco cut filler) wrapped in a circumscribing paper wrapping material. Exemplary cigarettes are described in U.S. Pat. Nos. 4,561,454 to Guess. In a preferred embodiment, the smoking article is a cigarette having a smokable filter material or tobacco rod.

In another preferred embodiment, a cigarette is provided which yields relatively low levels of "tar" per puff on average when smoked under FTC smoking conditions (for example, an "ultra low tar" cigarette).

In another preferred embodiment, a cigarette is provided having a smokable filler material or tobacco rod having a relatively low or negligible nicotine content, and a filter element.

In another preferred embodiment, a cigarette is provided having a smokable filler material or tobacco rod having a relatively low TSNA content, and a filter element.

The amount of smokable material within the tobacco rod can vary, and can be selected as desired. Packing densities for tobacco rods of cigarettes are typically between about 150 and about 300 mg/cm$^3$, and are preferably between about 200 and about 280 mg/cm$^3$, however, higher or lower amounts may be preferred for certain embodiments.

Typically, a tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or can be treated (for example, by mechanical or other perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette.

The mainstream cigarette smoke may be diluted with air from the atmosphere via the natural porosity of the cigarette wrapper and/or tipping material, or via perforations, openings, or vents in the cigarette wrapper and/or tipping material. Air dilution means may be positioned along the length of the cigarette, typically at a point along the filter element which is at a maximum distance from the extreme mouth-end thereof. The maximum distance is dictated by factors such as manufacturing constraints associated with the type of tipping employed and the cigarette manufacturing apparatus and process. For example, for a filter element having a 27 mm length, the maximum distance may be between about 23 mm and about 26 mm from the extreme mouth-end of the filter element. In a preferred aspect, the air dilution means is positioned toward the extreme mouth-end of the cigarette relative to the smoke-altering filter segment. For example, for a filter element having a 27 mm length including a smoke-altering filter segment of 12 mm length and a mouth-end segment of 15 mm, a ring of air dilution perforations can be positioned either 13 mm or 15 mm from the extreme mouth-end of the filter element.

As used herein, the term "air dilution" is the ratio (generally expressed as a percentage) of the volume of air drawn through the air dilution means to the total volume of air and smoke drawn through the cigarette and exiting the extreme mouth-end portion of the cigarette. For air diluted or ventilated cigarettes, the amount of air dilution can vary. Generally, the amount of air dilution for an air-diluted cigarette is greater than about 10 percent, typically greater than about 20 percent, and often greater than about 30 percent. Typically, for cigarettes of relatively small circumference (namely, about 21 mm or less) the air dilution can be somewhat less than that of cigarettes of larger circumference. The upper limit of air dilution for a cigarette typically is less than about 85 percent, more frequently less than about 75 percent. Certain relatively high air diluted cigarettes have air dilution amounts of about 50 to about 75 percent, often about 55 to about 70 percent.

Cigarettes of certain embodiments may yield less than about 0.9, often less than about 0.5, and usually between about 0.05 and about 0.3 FTC "tar" per puff on average when smoked under FTC smoking conditions (FTC smoking conditions include 35 ml puffs of 2 second duration separated by 58 seconds of smolder). Such cigarettes are "ultra low tar" cigarettes which yield less than about 7 mg FTC "tar" per cigarette. Typically, such cigarettes yield less than about 9 puffs, and often about 6 to about 8 puffs, when smoked under FTC smoking conditions. While "ultra low tar" cigarettes are generally preferred, in certain embodiments, however, cigarettes providing less than about 0.05 or more than about 0.9 FTC "tar" per puff are contemplated.

In certain embodiments, cigarettes yielding a low or negligible amount of nicotine are provided. Such cigarettes generally yield less than about 0.1, often less than about 0.05, frequently less than about 0.01, and even less than about 0.005 FTC nicotine per puff on average when smoked under FTC smoking conditions. In other embodiments, a cigarette delivering higher levels of nicotine may be desired. Such cigarettes may deliver about 0.1, 0.2, 0.3, or more FTC nicotine per puff on average when smoked under FTC smoking conditions.

Cigarettes yielding a low or negligible amount of nicotine may yield between about 1 mg and about 20 mg, often about 2 mg to about 15 mg FTC "tar" per cigarette; and may have relatively high FTC "tar" to FTC nicotine ratios of between about 20 and about 150.

Cigarettes of the preferred embodiments may exhibit a desirably high resistance to draw, for example, a pressure drop of between about 50 and about 200 mm water pressure at 17.5 cc/sec of air flow. Typically, pressure drop values of cigarettes are measured using instrumentation available from Cerulean (formerly Filtrona Instruments and Automation) of Milton Keynes, United Kingdom. Cigarettes of preferred embodiments preferably exhibit resistance to draw values of about 70 to about 180, more preferably about 80 to about 150 mm water pressure drop at 17.5 cc/sec of airflow.

Cigarettes of preferred embodiments may include a smoke-altering filter segment. The smoke-altering filter segment may reduce one or more undesirable components in the smoke, and/or may provide an enhanced tobacco smoke flavor, a richer smoking character, enhanced-mouthfeel and increased smoking satisfaction, as well as improvement of the perceived draw characteristics of the cigarette.

EXAMPLES

Preparation of Suspension of Palladium Particles in Solution of Magnesium Nitrate 12 g of low invert sugar is added to 94 ml of deionized ultrafiltered water and the mixture is heated to a temperature between 70° C. and 80° C. with constant mixing in a glass-lined vessel equipped with a heating jacket. 0.977 g of $(NH_4)_2PdCl_4$ is added to the reaction mixture, which is stirred constantly for three hours while maintaining the temperature between 70° C. and 80° C. After three hours, conversion of 63–70% of the palladium ion to palladium metal is achieved. Particle size measurements conducted using X-Ray Diffraction (XRD) indicate the presence of crystalline particles of approximately 100 nm in diameter. Laser scattering measurements indicate the presence of particles of approximately 1 $\mu$m in diameter. While not wishing to be limited to any particular mechanism, it is believed that the crystalline particles of approximately 100 nm in diameter cluster together to form larger particles of approximately 1 $\mu$m in diameter.

After the allotted time, 19.88 g (70%) $Mg(NO_3)_2$-$6H_2O$ is added to the suspension of palladium particles. The suspension is then applied to approximately 0.45 kg (approximately one pound) of cut tobacco filler.

Palladium Particle Size Analysis

One way of determining if the catalyst is properly prepared is to determine the particle size of the palladium in each reaction vessel after the reaction has occurred and to ensure that the mean and mode fall within a predetermined range.

Into a 5 L reaction vessel equipped with a glass stirring mechanism and immersed thermocouple with digital temperature readout/control were placed suitable amounts of deionized-ultra filtered water and low invert sugar for producing 5 L of solution as described in the previous example. The solution was heated to 70° C. with constant stirring. Upon temperature stabilization at 70° C., a suitable amount of palladium salt in the form of $(NH_4)_2PdCl_4$ was added to the water/sugar solution.

Catalyst samples were taken from the reaction vessel at the first and third hours of the reaction and before the catalyst solution was sprayed on the tobacco. Catalyst samples (approximately 20 ml) were taken from a depth of 61 cm in the reaction vessel by using a clean elongated glass pipette. The samples were then placed into a centrifuge tube and agitated prior to analysis.

The percent conversion of the palladium salt to palladium metal was monitored using a Perkin-Elmer graphite furnace atomic absorption spectrometer. The particle size of the formed palladium metal particles was monitored by a Coulter LS230 light scattering instrument that detects particle sizes ranging from 0.04 μm to 2000 μm. The samples were pipetted into a Coulter LS 230 particle size analyzer until the obscuration percentage was above 8% and the Polarization Intensity Differential Scanning (PIDS) value was between 45 and 55%. Each sample was analyzed three times before the observation was made and the mean and mode were determined.

Table 1 below presents typical results for mean and mode of palladium particles in various catalyst batches prepared by the process described in previous examples and determined using an LS 230 Analyzer and the method described above. FIG. 1 provides a typical catalyst chromatogram providing palladium particle diameters (μm) in a typical reducing solution after reaction.

TABLE 1

Palladium Size Mean and Mode for Different Catalyst Samples

| Date | Catalyst number | Mean | Mode |
|---|---|---|---|
| Oct. 16, 2001 | 1A299010650 | 6.108 | 7.083 |
| Oct. 16, 2001 | 28289010430 | 6.279 | 7.083 |
| Oct. 17, 2001 | 28290011300 | 6.662 | 7.775 |
| Oct. 18, 2001 | 28291011020 | 9.630 | 10.290 |
| Oct. 18, 2001 | 2A91010700 | 7.558 | 8.536 |
| Oct. 19, 2001 | 1A292010450 | 7.758 | 8.536 |
| Oct. 19, 2001 | 28292010945 | 7.597 | 8.536 |
| Oct. 22, 2001 | 3A295011130 | 8.409 | 7.775 |
| Oct. 20, 2001 | 1A293010650 | 6.261 | 7.083 |
| Oct. 25, 2001 | 1 A298011150 | 7.868 | 8.536 |

The catalyst mean and mode preferably fall within the range of 4.04–14.74 μm for the mean and 6.55–12.33 μm for the mode in order for the catalyst batch to be released and sprayed. If either the mode or the mean is outside the range, the catalyst may be rejected, depending upon how far outside the range the value falls. However if the mean and the mode are both outside the predetermined ranges, the catalyst is generally rejected and is not sprayed onto the tobacco.

Optimization of Catalyst Addition Process

5 L of palladium catalyst solution prepared as described above was sprayed onto 40 lbs. (approximately 18 kg) of tobacco. A hand held spraying wand connected to a dual-head ceramic piston pump was used to transfer the palladium metal suspension onto the tobacco. The solution was applied to ten pounds (approximately 4.5 kg) of tobacco at a time using a ten pound tobacco tumbler in order to obtain even coverage on the tobacco. Forty pounds of tobacco can typically be adequately treated with 5 L of palladium metal suspension according to the formulation in the preceding example.

The wet tobacco was then placed onto the manufacturing feeder belts and fed through the tobacco dryer to bring the moisture level down to approximately 13.5%. The dried tobacco was then taken to a cigarette making machine and hand fed into the machine to make enough cigarette samples for chemical analysis. The treated cigarettes were conditioned and smoked on Borgwaldt smoking machines and the PAH/TSNA/Phenolic component(s) of the total particulate matter were extracted and analyzed to determine what change had taken place upon modification of the tobacco additive.

Instrumentation that utilizes the optical properties of materials on the micron and sub-micron scale was used to measure the particle size and size distribution of particles suspended in solution. When low invert sugar is used as the reducing agent, palladium metal particle sizes on the order of 7–9 microns are primarily formed. X-ray powder diffraction experiments performed on the palladium metal suggest that the size of the palladium particles is on the order of 100 nanometers. Thus, a discrepancy of over an order of magnitude exists when measuring the palladium particles via X-ray diffraction versus optical measurements.

Optical microscopy of palladium particles taken directly from the reacting solution suggests that the size discrepancy may be attributed to the fact that the low invert sugar contains "globules" (most probably entangled polysaccharides) that exist in the 7–9 micron size range at 70° C. The sugar globules were observed to have palladium crystallites either stuck to the outside or trapped between sugar globules. This suggests that the effective surface area for a specified amount of palladium may be significantly reduced due to adhesion or trapping of the palladium crystallites on or in the sugar globules. Therefore, it is preferred to maximize the surface area of the palladium metal in the catalyst system so as to provide the maximum reduction of carcinogens in tobacco smoke.

Several options for increasing the surface area of the palladium metal particles are available. The first option is to utilize surfactants in an attempt to break apart the large sugar particles that exist in the low invert sugar solution. Tetradodecylammonium bromide surfactant (TDABr) has been used to produce inverse microemulsions of nanometer scale palladium metal in organic solvents such as tetrahydrofuran (THF) and ethanol. The more common and less expensive surfactant cetyltrimethylammonium bromide (CTAB) may also be used, however any suitable surfactant may be used as instead of the specific surfactants enumerated herein. In the case of water/low invert sugar solutions, the surfactant may break apart the large sugar particles and thereby reduce the size of the palladium clusters. In a water/ethanol solution, ethanol may be used as the reducing agent, which requires higher temperatures, and CTAB or another surfactant may be utilized in order to form the inverse microemulsions required for the formation of nanoscale palladium particles. Ethanol or other alcohols may be used as reducing reagents in water, but such palladium salt solutions are generally dilute and high temperatures may be preferred.

Palladium Ion Conversion

The effectiveness of the catalyst is related to the distribution of the palladium metal over the tobacco itself. Given a specific amount of palladium, the effectiveness is related to both the particle size of the palladium metal and the percent conversion of the palladium starting material to palladium metal. The conversion reaction proceeds relatively slowly at low temperatures. When the temperature of the reaction is held at about 70° C., the reaction is essentially complete after 3 hours.

To study this reaction, the percent conversion and particle size of the palladium metal was observed in many different reactions. Some examples of variations among these experiments included changing the temperature of the reaction, using varying amounts of reactants along with varied concentrations, and allowing the reaction to proceed for various lengths of time.

Figure 2:
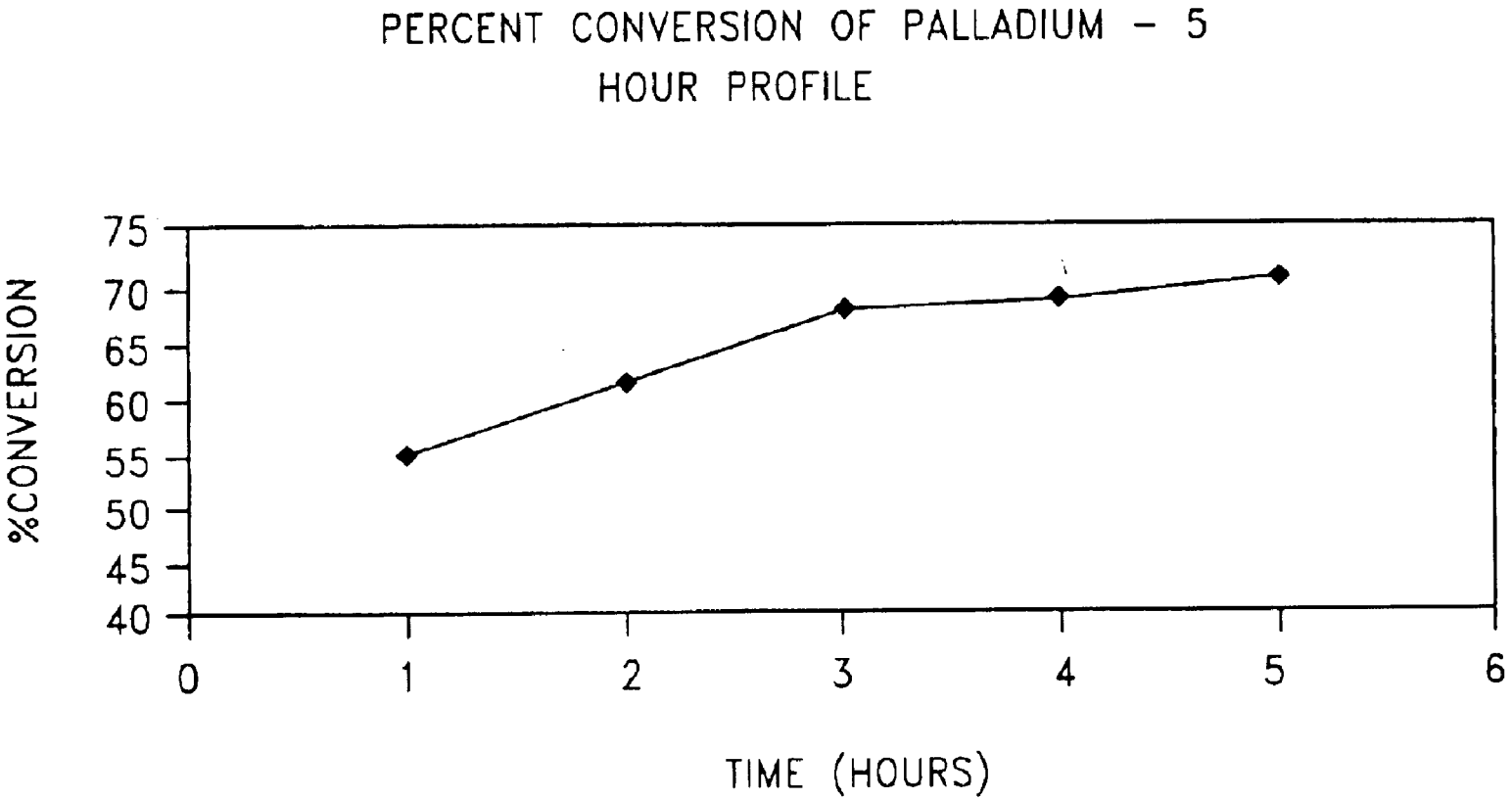
FIG. 2 shows the percent conversion of palladium ion to palladium in an aqueous solution of low invert sugar over a 5 hour reaction at 70° C. with samples analyzed every hour.

Catalyst samples prepared as described above were collected from a reaction vessel at 30 minute intervals, quenched in a dry ice/acetone bath and brought to room temperature. These samples were centrifuged at 3400 rpm for 10 minutes to precipitate the palladium metal. The supernatants were collected and centrifuged again. A one-milliliter aliquot of this solution underwent a series of dilutions in preparation for injection into the atomic absorption analyzer. The sample was analyzed for concentration of palladium ions on a Perkin-Elmer atomic absorption analyzer equipped with a graphite furnace and Zeeman background correction. The data was quantified to show a percent conversion of palladium ions into palladium metal. FIG. 2 shows the percent conversion of palladium over a 5 hour reaction at 70° C. with samples analyzed every hour. Based on the results shown in FIG. 2, the maximum conversion occurs at 5 hours with a 70% conversion of palladium ions into palladium metal by that time. There is a steady increase in percent conversion for the first three hours of the reaction, while the percent conversion levels off after the initial three hours. These results suggest that the reaction may yield higher percent conversions the longer the reaction is allowed to proceed.

Reduction in PAH Levels

Experiments were conducted to compare the levels of PAHs in smoke from cigarettes containing tobacco incorporating palladium particles and magnesium nitrate to those of comparable cigarettes not containing the catalyst system. A catalyst system was prepared as described in the first Example, and applied to a Southern Commercial tobacco blend. The tobacco was fashioned into unfiltered cigarettes (Hauni Baby cigarettes, Pd catalyst, not filtered; smoked cigarettes were selected based on a 5% tolerance level of the average of 200).

Catalyst-containing cigarettes and cigarettes without catalyst were smoked and the reduction in levels of certain PAHs, including phenanthrene, 2-methylanthracene, pyrene, chrysene, benzo[b/k]fluoranthene, and benzo[a]pyrene for the catalyst-containing cigarettes were measured using standard methodology well known in the art. Test results are presented in Table 2 below. The results demonstrate a substantial reduction in the levels of PAHs when the catalyst system is present, including a reduction of over 50% for 2-methylanthracene. The smallest reduction was about 29%, observed for benzo[b/k]fluoranthene.

TABLE 2

| Commercial Blend | | | |
|---|---|---|---|
| PAH | Effect on PAH level compared to cigarette without catalyst | % change | error |
| phenanthrene | reduced | 31.01 | 1.40 |
| 2-methylanthracene | reduced | 51.61 | 1.24 |
| pyrene | reduced | 39.18 | 1.02 |

TABLE 2-continued

| Commercial Blend | | | |
|---|---|---|---|
| PAH | Effect on PAH level compared to cigarette without catalyst | % change | error |
| chrysene | reduced | 41.44 | 1.22 |
| benzo[b/k]fluoranthene | reduced | 28.84 | 1.52 |
| benzo[a]pyrene | reduced | 38.38 | 0.93 |
| Cigarette Smoke Condensate (CSC) Amounts: | reduced | 18.75 | 0.83 |

The same catalyst system was applied to a tobacco blend containing 22% expanded tobacco that had been cased with a special casing that leaves out the invert sugar that is added in with the Pd solution. The catalyst solution was sprayed on the blend and production cigarettes were made. Reductions in PAH levels were again measured and compared to those for the cigarettes described above. The resulting reductions, provided in Table 3 below, were statistically different for all PAHs except naphthalene, dibenzofuran, anthracene, and benzo[a]pyrene. These data indicate that nature of the tobacco blend treated may affect the degree of reduction of certain PAHs in the resulting smoke.

TABLE 3

| 22% Expanded Tobacco Blend | | | |
|---|---|---|---|
| PAH | Effect on PAH level compared to cigarette without catalyst | % change | error |
| phenanthrene | reduced | 16.12 | 0.24 |
| 2-methylanthracene | reduced | 32.44 | 2.34 |
| pyrene | reduced | 20.70 | 0.48 |
| chrysene | reduced | 13.33 | 1.15 |
| benzo[b/k]fluoranthene | reduced | 16.47 | 1.45 |
| benzo[a]pyrene | reduced | 9.39 | 0.54 |
| Cigarette Smoke Condensate (CSC) Amounts: | reduced | 3.15 | 0.05 |

Determination of PAHs by Mass Spectrometry

Polycyclic aromatic hydrocarbons (PAHs) are a major group of compounds, with known carcinogenic and mutagenic activity. Reductions in these PAHs serve as a useful indication that the catalyst system is working in the treated product. However, there is no standardized method reported in the literature for the simultaneous separation and detection of multiple PAHs. In fact, there is a large variance found for reported methods used to analyze just one of the PAHs, namely benzo[a]pyrene. Shown in Table 4 are the average values found by several groups working with the Kentucky reference cigarette 1R4F.

TABLE 4

| Concentrations of B[a]P (ng/cig) - Kentucky Reference Cigarette 1R4F | | | | | |
|---|---|---|---|---|---|
| Tomkins et al. (1985) | Risner (1988) | Risner (1991) | Dumont et al. (1993) | Evans et al. (1993) | Gmeiner et al. (1997) |
| 6.6 | 6.4 | 9.2 | 8.5 | 5.3–8.2 | 7.9 |

A new Extraction Protocol, described below, was developed which involves various liquid extraction steps and the use of a vacuum manifold to separate the PAHs by silica SPE cartridges. Very reliable data was obtained from this method due to the control over flow rate and the selective removal of several hydrocarbons. Hydrocarbons can co-elute with the PAHs and can act to inflate the concentrations being quantified. The standard deviations obtained from this new method are very low.

Experiments were conducted to measure the levels of 17 different PAHs in cigarette smoke using the new Extraction Protocol. Cigarettes (40 per sample) were smoked following the FTC protocol. Samples were extracted from Cambridge pads using the Extraction Protocol described below. The Extraction Protocol enables 17 PAHs to be quantified, compared to conventional extraction methods that only focus on benzo(a)pyrene. The Extraction Protocol allows for high sample throughput and is highly reproducible. Table 5 provides data on selected PAH levels for a sample of Kentucky Reference cigarettes (IR4F) comparing a conventional liquid extraction method and a solid extraction method using the Extraction Protocol set forth below.

TABLE 5

PAH Concentrations and Standard Deviations of Marker PAHs (1R4F)

| Marker PAHs | Liquid (ng/cig) | Liquid Std. Dev. | Solid (ng/cig) | Solid Std. Dev. |
|---|---|---|---|---|
| phenanthrene | 149.42 | 2.26 | 123.17 | 1.29 |
| 2-methylanthracene | 66.15 | 0.87 | 75.50 | 0.56 |
| pyrene | 38.26 | 3.45 | 38.26 | 0.11 |
| chrysene | 15.74 | 0.37 | 17.51 | 1.26 |
| benzo[b/k]fluoranthene | 10.86 | 0.34 | 10.92 | 0.31 |
| benzo[a]pyrene | 9.49 | 0.18 | 9.55 | 0.22 |

The benefits of the solid extraction method in comparison to the liquid extraction method include: reduced solvent usage; greater sample throughput; fewer cigarettes required; less labor intensive; better reproducibility; higher recoveries; and selective removal of contaminants. Lower standard deviations are observed for the solid extraction, for example, acceptable standard deviations are normally below 10, but the standard deviations for the solid extraction method are below 2. The solid extraction method also permits faster sample throughput. Typically, a laboratory technician can extract four samples in approximately eight hours using the solid extraction method, compared to the liquid extraction method wherein only one sample could be extracted in eight hours.

Extraction Protocol

The following equipment and supplies are typically used in conducting the extraction protocol: (1) 10-mL test tube; Sample vials; Kimwipes; Glass pipettes; Pipette bulbs; Methylene Chloride; Hexanes; Buchner funnel with fritted disk; 50 ml, round bottom flask; Silica gel cartridges (200 mesh); (2) 250 ml round bottom flask; Silica gel (63–200 mesh); Extraction Standard; (3) 10 ml, graduated cylinder; Medium and Small cork rings; Small RB flask holders/stands; 100 ml graduated cylinder; Vacuum Manifold; 30 ml separatory funnel; (2) Spatulas; Roto-vap apparatus; Dry Ice; Acetone; Ultrasound Bath; 150 ml, Beaker; Scale; UV lamp; Pipette gun; Solvent reservoirs; Mortar and pestle; and Ether.

The Extraction Protocol is typically performed according to the following steps:

1.) Cigarettes (40 per sample) are smoked following the FTC protocol. Use 2 pads (20 cigarettes smoked per pad). Spike each pad with 100 μL of Extraction Standard. Cut the pads and place into a 250 ml beaker. Add 100 ml of acetone to beaker.

2.) Sonicate for 15 minutes and filter contents of beaker into 250 ml, round bottom flask fitted with Buchner funnel with fritted disk. Rinse tip of the Buchner funnel with acetone. Replace filter strips back into the 250 ml beaker.

3.) Roto-vap the sample at 35° C. down to approximately 1 ml of sample.

4.) Add an additional 100 ml of acetone to 250 ml beaker with sample.

5.) Repeat the sonication for 15 minutes and filter contents of beaker through the same Buchner funnel into the same 250 ml round bottom flask. Push the pads down to remove as much solvent from the pads as possible. Remove filter pad fibers from funnel, rinse 250 ml beaker with 5 ml of acetone, and transfer to fritted disk. Rinse the tip of the Buchner funnel with acetone into the 250 ml, round bottom flask.

6.) Roto-vap the sample to approximately 1 ml at 35° C.

7.) Transfer the sample to a mortar and pestle containing 1.2 g of silica (63–200 mesh activated) dropwise with Pasteur pipette. Rinse the round bottom flask with 1 ml of acetone and 5×1 ml of ether and transfer contents to silica by pipette. Continuously grind silica until a fine powder is produced.

8.) Once sample is completely dry, allow silica to sit for 30 minutes to allow for complete dryness.

9.) While sample is drying on silica, set up the vacuum manifold and rinse ports with approximately 0.5 ml acetone. Condition a silica gel cartridge by adding 100 ml of hexanes to the sample cartridge and adjusting flow rate to 5 ml/min. Pull column to dryness.

10.) After the cartridges have been conditioned, shut off the flow (not the vacuum), and drain the vacuum manifold.

11.) Just prior to loading sample onto column, add 8 ml hexanes to re-wet the column. Allow hexanes to completely saturate the column and run until the last drop has evacuated the column.

12.) Transfer sample to weigh paper and load sample onto column making sure to distribute the sample evenly across the top. Load sample onto column using 8×1 ml hexanes. Make sure to rinse the spatula, mortar, and pestle with the first 2 ml of hexanes. Tap column to expel air bubbles. Collect 8 ml in a test tube labeled F1.

13.) Pull an additional 3×4 ml of hexanes through column and collect in test tubes labeled F2, F3, and F4. Do not let the sample run dry between additions or washes. Rinse port with approximately 0.5 ml hexanes when switching ports.

14.) Check for fluorescence using Spectroline UV lamp in long wave UV mode at 365 nm. Record in notebook which fractions fluoresce.

15.) If fluorescence is in the final fraction (F4) add the fraction to a labeled 150 ml beaker, rinse the test tube with 1 ml of hexane, and place under column. Make a note of any other fractions with fluorescence in the sample notebook. For the blank, collect all four fractions in a 150 ml beaker.

16.) Elute column with 50 ml of hexanes using solvent reservoir.

17.) Mix 3 ml of methylene chloride and 30 ml of hexanes in a graduated cylinder. Elute 33 ml of the mixture through the column using solvent reservoir. Rinse port with a small amount of hexanes and collect in the previously used 150 ml beaker.

18.) Transfer the contents of the 150 ml beaker into a 250 ml, round bottom flask, rinsing the beaker with approximately 5 ml of hexanes. Roto-vap sample to dryness at 40° C.

19.) Bring sample up in 10 ml of hexanes by Pasteur pipette by rinsing the round bottom with 2×3 ml and 2×2 ml increments. Add each rinse to the 30 ml separatory funnel.

20.) Extract sample with 2.5 ml of nitromethane. Shake the separatory funnel 10 times and vent; 20 times and vent; 30 times and vent; and 40 times before venting. Collect bottom layer in a 50 ml round bottom flask.

21.) Repeat 5 times for a total volume of 15 ml of nitromethane.

22.) Roto-vap sample at 55° C. to dryness. Do not place parafilm over round bottom.

23.) Submit samples for analysis by gas chromatography/mass spectroscopy (GC/MS) according to standard protocols as are known in the art.

Carbazole samples may also be obtained by performing the following steps.

24.) Elute column with 100 ml of 4:1=hexanes:$MeCl_2$ using solvent reservoir.

25.) Roto-vap to dryness at 40° C.

26.) Submit labeled sample for carbazole analysis according to standard protocols as are known in the art.

The above-described Extraction Protocol may be performed with various modifications, as will be apparent to those skilled in the art. For example, solvents not enumerated herein may be satisfactorily substituted for hexanes, ether, acetone, and methylene chloride. Adsorbents other than silica gel may also be acceptable for use. The method may be performed using other equipment, different quantities of samples or reagents, different times, or different temperatures. While GS/MS is the preferred analytical method for determining PAH or carbazole levels, other analytical methods as are known in the art may also be used. Other components of cigarette smoke condensate, not enumerated herein, which are capable of extraction using the protocol may also be analyzed by a suitable analytical method after extraction using the protocol or acceptable variation thereof as described above.

Numerous methods for separation or analysis of PAHs in cigarette smoke condensate have been described in the published literature: Forehand et al., "Analysis of polycyclic aromatic hydrocarbons, phenols and aromatic amines in particulate phase cigarette smoke using simultaneous distillation and extraction as a sole sample clean-up step" Journal of Chromatography A, 2000. 898: p. 111–124; Gmeiner et al., "Determination of seventeen polycyclic aromatic hydrocarbons in tobacco smoke condensate" Journal of Chromatography A, 1997. 767: p. 163–169; Arrendale et al. "Quantitative Determination of Naphthalenes in Tobacco Smoke by Gas Chromatography" Beitrage zur Tabakforschung International, 1980. 10(2): p. 100–105; Severson et al., "Gas Chromatography Quantitation of Polynuclear Aromatic Hydrocarbons in Tobacco Smoke" Analytical Chemistry, 1976. 48: p. 1866–1872; Canada, "Determination of Benzo [a]pyrene in Mainstream Tobacco Smoke" Official Method, 1999. T-103; Schmidt et al., "Determination of polycyclic aromatic hydrocarbons, polycyclic aromatic sulfur and oxygen heterocycles in cigarette smoke condensate" Fresenius Z. Anal. Chem., 1985. 322(2): p. 213–19; Allen, "Quantitation of polycyclic aromatic hydrocarbons" Thin Layer Chromatogr.: Quant. Environ. Clin. Appl., [Symp], 1980. Meeting Date 1979: p. 348–62; Robb et al., "Analysis of polycyclic hydrocarbons" Beitr. Tabakforsch. Int., 1965. 3(4): p. 278–84; Risner, "The determination of benzo[a] pyrene and Benz[a]anthracene in mainstream and sidestream smoke of the Kentucky Reference cigarette 1R4F and a cigarette which heats but does not burn tobacco: a comparison" Beitr. Tabakforsch. Int., 1991. 15(I): p. 11–17; Grimmer et al., "Gas chromatographic determination of polycyclic aromatic hydrocarbons, aza-arenes, and aromatic amines in the particle and vapor phase of mainstream and sidestream smoke of cigarettes" Toxicol. Lett., 1987. 35(1): p. 117–24; Severson et al., "A chromatographic analysis for polynuclear aromatic hydrocarbons in small quantities of cigarette smoke condensate" Beitr. Tabakforsch. Int., 1976. 8(5): p. 273–82; Klimisch, "A rapid method for the determination of benzo[a]pyrene, benzo[a]anthracene and chrysene in cigarette smoke" Chromatographia (1976. 9(3): p. 119–22; Severson et al., "Isolation, identification, and quantitation of the polynuclear aromatic hydrocarbons in tobacco smoke" Carcinog.—Compr. Surv., 1976. 1: p. 253–70, the contents of each of which are incorporated herein by reference in their entireties.

Automated PAH Analysis

PAHs can be a particularly difficult group of compounds to deal with due to their hydrophobic nature, causing them to adsorb everywhere, leading to losses during the sampling and storage. Despite the advantages of the new internal extraction method described above, it is still prone to losses of sample due to multiple transfer steps. Also, the lack of a centralized control over flow rate can lead to variability in column performance. The need for a method that could address these issues led to research into automated Solid Phase Extraction (SPE). Benefits of using automated SPE include a reduction in analyst time and a reduction in extraction time for the automated method.

The development of an automated method first started with the selection of an extraction method. Two extraction methods were optimized and evaluated for possible automation. The first method was a scaled-down version of the extraction method described above with 2 gram silica cartridges and a nitromethane extraction serving as the clean-up step.

The second method was based on the work of Gmeiner et al. and does not use any evaporation steps. The only adjustment to Gmeiner's work was the use of a cyclohexyl cartridge instead of a C18 cartridge. The cycylohexyl cartridge was introduced by Moldoveanu at the 2001 Tobacco Science Research Conference and compared to the original work by Gmeiner et al. Moldoveanu demonstrated that the C18 cartridges were incapable of producing the 80–90% recoveries possible with their cyclohexyl counterparts. One difficulty with this second method, however, was that the hydrocarbons co-elute with the PAHs. The addition of a final nitromethane extraction step may remove the hydrocarbons.

The next step involved with automation is the selection of a robotic system. Three different systems from Prospekt, Gilson, and Zymark were compared. Of all three systems, the Zymark RapidTrace appeared to be the best option based upon preliminary information due to the ability to add modules as demand increases.

Despite the good performance of the internal extraction method described above, an automated method is desirable for numerous reasons. An automated method can increase sample throughput and reduce the human error involved in such laborious extraction techniques. The evaporation steps of the method also present a problem due to the volatility of several smaller ring PAHs. Evaporation steps can be minimized by an automated method and this is significant when considering the difficulty in quantifying compounds such as naphthalene. Finally, with the likelihood of ever-increasing regulatory pressures, automated SPE can provide formal documentation of how sample preparation is done, recording in electronic form, precise details of every step of every extraction, thereby eliminating any questions about the data collected.

Instrumentation for Performing Analyses

In conducting various analyses, the following instrumentation was used: three gas chromatography/mass spectrometers (GC/MS), one liquid chromatography/mass spectrometer (LC/MS), one liquid chromatograph, and two gas chromatographs (GC). Two of the GC/MS systems were Agilent 5973N mass selective detectors (MSD) with a 6890 Plus gas chromatograph. The other has an Agilent 5973N MSD and a 6890N gas chromatograph. All three instruments have electron ionization capability, and one also has positive and negative chemical ionization capabilities. All have programmable autosamplers and are run using the Agilent Chemstation software for GC/MS's. The LC/MS system is an Agilent 1 100MSD SL with an Agilent 1100 series high performance liquid chromatograph (HPLC). The HPLC consists of a binary pump with solvent selection valve, a vacuum degasser, a thermostated column-switching compartment, an autosampler, and a diode array UV-Vis spectrophotometer. The LC system is the same system as the one associated with the LC/MS except it has a well-plate autosampler, which allows samples to be processed in a well-plate format. This system also has a fluorescence detector in order to perform analyses on catechols and various other related compounds. The GCs are both Agilent 6890N systems. One has flame ionization detection (FID) only and the other has FID and nitrogen-phosphorous detection (NPD). The FID specifically detects carbon and is a robust and reliable way to detect various organic compounds, such as nicotine. The NPD is specific for compounds containing nitrogen or phosphorous.

The gas chromatograph/mass spectrometers (GC/MS) were composed of a 5973N mass selective detector (MSD) that is a quadrapole mass analyzer and a 6890 Plus gas chromatograph (GC). The instrument and the data analysis were run using the Agilent Chemstation software, all of which are controlled by a Hewlett Packard Vectra computer. The computer, GC, and MSD were all networked together using a LAN system. The GC and MSD also had a manual control panel on the front of the oven. A programmable autosampler was used to inject the samples. This autosampler holds two solvent vials to rinse the syringe needle before and/or after the sample injection. The high vacuum system consists of a performance turbomolecular pump. This allows for more versatility in sample analysis because higher flow rates of the carrier gas are possible. Also, the system pumps down from atmospheric pressure much faster than the standard diffusion pump that can decrease instrument down time for maintenance. The mass range is 1.6–800 amu in 0.1 amu steps, allowing a wide range of molecules to be analyzed. The user can either perform mass analysis in a scan mode, choosing any mass range encompassed by the instrument's capabilities, or selected ion monitoring (SIM) can be performed. SIM allows the user to enter up to 50 groups of masses, with up to 30 masses per group, to be analyzed, and these groups can be set up on a timed program to be switched automatically during the instrument run. SIM can improve sensitivity, but may result in the loss of capability to detect interfering compounds at the masses of interest. All of the instruments had electron ionization (EI) capability and can have positive and negative chemical ionization (CI) capabilities added. Of the three instruments, two have just EI, the other has the full complement of ionization capabilities.

The GC oven may accommodate a wide variety of GC capillary columns, such as a Rtx-5Sil MS column, that is 30.0 m×0.25 mm ID×0.5 $\mu$m film thickness. The oven program is as follows: initial temperature of 65° C. was ramped at 50° C./min to 95° C. and held for 0.00 minutes, then ramped at 17° C./min to 280° C. and held for 2.00 minutes, then a ramp of 10.00° C./min to 300° C. with a final ramp of 40° C./min with a hold of 8.00 min. The injector temperature is set at 300° C. with a flow rate of 1.00 ml/min of helium. The detector temperature (transfer line) is set at 280° C. A 1.0 $\mu$L injection is used.

The MSD source/quadrupole temperature is set at 230/150° C. The source is set to electron ionization mode. The acquisition mode is set to scan. The MS scan parameters are as follows: a solvent delay until 5.00 minutes then scanning from 40.0 to 450.0 amu.

PAHs may be analyzed using the GC/MS systems described above. The quantitation is done using an internal method calibration curve. There are ten deuterated PAHs present in the calibration curve, which act as the internal standards. Table 6 includes a list of all of the deuterated and non-deuterated PAHs that are present in the curve.

TABLE 6

Compounds in the Calibration Curve

| # | ID | Base Peak |
|---|---|---|
| 1) | D8-acenaphthalene | 160 |
| 2) | naphthalene | 128 |
| 3) | acenaphthylene | 152 |
| 4) | acenaphthene | 153 |
| 5) | dibenzofuran | 168 |
| 6) | D10-fluorene | 176 |
| 7) | fluorene | 166 |
| 8) | D10-phenanthrene | 188 |
| 9) | phenanthrene | 178 |
| 10) | D10-anthracene | 188 |
| 11) | anthracene | 178 |
| 12) | D8-carbazole | 175 |
| 13) | carbazole | 167 |
| 14) | D-10-fluorathrathene | 212 |
| 15) | 2-methylanthracene | 192 |
| 16) | 9-methylanthracene | 192 |
| 17) | fluoranthene | 202 |
| 18) | D10-pyrene | 212 |
| 19) | pyrene | 202 |
| 20) | 2,3-benzofluorene | 216 |
| 21) | D12-benzo[a]anthracene | 240 |
| 22) | 1,2-benzanthracene | 228 |
| 23) | D12-chrysene | 240 |
| 24) | chrysene | 228 |
| 25) | D12-benzo[a]pyrene | 264 |
| 26) | benzo[b/k]fluoranthene | 252 |
| 27) | benzo[e]pyrene | 252 |
| 28) | benzo[a]pyrene | 252 |
| 29) | indeno[1,2,3-cd]pyrene | 276 |
| 30) | dibenz[a,h]anthracene | 278 |
| 31) | benzo[ghi]perylene | 276 |

The internal standards are used to determine extraction efficiency and to calculate the concentration of the analytes. In order to calculate extraction efficiency, a 100% recovery standard is run with every sample set. This standard contains the deuterated compounds from the extraction spike mix spiked into solvent at the concentration expected to be found in the final sample after extraction. Once run on the instrument, this allows the data processor to know what 100% recovery from the extract should have been, and allows slight variations in concentration from the theoretical for the extraction spike mix to be taken into account. The responses from the sample versus the recovery standard are used to calculate the efficiency.

The internal standard quantitation method is a robust method that accounts for variations in both the extraction process and in the instrument runs. The internal standards are spiked into both the analyte curve and the extractions at the same amount. This allows a response ratio to be calculated. The ratio is the response of the analyte divided by the response of the internal standard. The curve that is generated is then concentration x-axis) versus response factor (y-axis). Since a relative response is measured, changes in instrument ionization conditions or extraction efficiencies should not affect the quantitation. For example, if the ratio of analyte to internal standard in a sample is one, and half the sample is spilled, the ratio will still be one, and the correct concentration value will be calculated based on the curve.

The extracted cigarette smoke condensate samples are submitted to the mass spectrometry facility where they are aliquotted into labeled vials to be run. There are also several instrument checks that are preformed in order to make sure the GC/MS system is operating properly. Before samples are run, an automatic instrument tune is performed to make sure the mass axis and peak widths are properly calibrated, and to make sure the instrument electronics are within acceptable ranges. The vacuum is checked to make sure there are no leaks. Once the samples are ready to run, a "primer" sample is run first to stabilize the instrument response. Then a solvent blank containing the solvent used to prepare the samples is injected to make sure there is no contamination in the solvent or the instrument. The midpoint of the curve is then run to make sure the instrument response has not shifted significantly from when the curve was run. The 100% recovery sample is injected next, followed by the samples. After each batch of samples is run, the 100% recovery standard is injected again, in order to compensate for any changes in the instrument over time.

Chemstation automatically quantitates the raw data after the instrument run is completed. A qualified mass spectrometrist then reviews the data to check for any interferents, contaminants, and to check the overall quality of the data. This data is then transferred into MS Excel where data manipulation, including conversion from pg/$\mu$L to ng/cigarette, and statistics are performed.

Levels of key PAHs from Kentucky Reference cigarettes (KRC-1R3F) are provided in ng/cigarette in Table 7a and in ng/mg CSC in Table 7b, as measured using GC/MS as described above. Levels of key PAHs from Kentucky Reference cigarettes (KRC-1R4F) are provided in ng/cigarette in Table 8a and in ng/mg CSC in Table 8b.

TABLE 7a

PAHs in Kentucky Reference Cigarettes (ng/cigarette)

| Key Compounds | KRC-1R3F-101601-01 ng/cigarette (average of 3 runs) | KRC-1R3F-101501-01 ng/cigarette (average of 2 runs) | KRC-1R3F-101701-01 ng/cigarette (average of 3 runs) | Average (n = 8) | Stdev | % CV |
|---|---|---|---|---|---|---|
| phenanthrene | 88.32 | 84.32 | 81.54 | 84.72 | 3.41 | 4.02 |
| 2-methylanthracene | 46.83 | 44.21 | 44.84 | 45.30 | 1.36 | 3.01 |
| pyrene | 25.97 | 24.89 | 24.71 | 25.19 | 0.68 | 2.71 |
| chrysene | 12.42 | 11.72 | 12.31 | 12.15 | 0.38 | 3.11 |
| benzo[a]pyrene | 6.68 | 6.45 | 6.49 | 6.54 | 0.12 | 1.86 |

TABLE 7b

PAHs in Kentucky Reference Cigarettes (ng/mg CSC)

| Key Compounds | KRC-1R3F-101601-01 ng/mg CSC (average of 3 runs) | KRC-1R3F-101601-01 ng/mg CSC (average of 2 runs) | KRC-1R3F-101601-01 ng/mg CSC (average of 3 runs) | Average | Stdev | % CV |
|---|---|---|---|---|---|---|
| phenanthrene | 6.04 | 5.95 | 5.85 | 5.95 | 0.09 | 1.59 |
| 2-methylanthracene | 3.20 | 3.12 | 3.22 | 3.18 | 0.05 | 1.66 |
| pyrene | 1.78 | 1.76 | 1.77 | 1.77 | 0.01 | 0.61 |
| chrysene | 0.85 | 0.83 | 0.88 | 0.85 | 0.03 | 3.31 |
| benzo[a]pyrene | 0.46 | 0.46 | I0.47 | 0.46 | 0.01 | 1.19 |

TABLE 8a

PAHs in Kentucky Reference Cigarettes (ng/cigarette)

| Key Compounds | KRC-1 R4F-101501-01 ng/cigarette (average of 2 runs) | KRC-1 R4F-101601-01 ng/cigarette (average of 3 runs) | KRC-1 R41-101401-01 ng/cigarette (average of 4 runs) | KRC-1 R4F-101701-03 ng/cigarette (average of 3 runs) | Average (n = 12) | Stdev | % CV |
|---|---|---|---|---|---|---|---|
| phenanthrene | 58.02 | 56.74 | 63.43 | 57.92 | 59.03 | 2.99 | 5.07 |
| 2-methylanthracene | 33.55 | 33.35 | 33.43 | 35.63 | 33.99 | 1.09 | 3.22 |

TABLE 8a-continued

| PAHs in Kentucky Reference Cigarettes (ng/cigarette) | | | | | | | |
|---|---|---|---|---|---|---|---|
| Key Compounds | KRC-1 R4F-101501-01 ng/cigarette (average of 2 runs) | KRC-1 R4F-101601-01 ng/cigarette (average of 3 runs) | KRC-1 R41-101401-01 ng/cigarette (average of 4 runs) | KRC-1 R4F-101701-03 ng/cigarette (average of 3 runs) | Average (n = 12) | Stdev | % CV |
| pyrene | 17.63 | 17.61 | 18.62 | 18.15 | 18.00 | 0.48 | 2.68 |
| chrysene | 8.57 | 8.28 | 8.70 | 8.85 | 8.60 | 0.24 | 2.80 |
| benzo[a]pyrene | 5.48 | 5.49 | 5.62 | 5.60 | 5.54 | 0.07 | 1.30 |

TABLE 8b

| PAHs in Kentucky Reference Cigarettes (ng/mg CSC) | | | | | | | |
|---|---|---|---|---|---|---|---|
| Key Compounds | KRC-1 R4F-101501-01 ng/mg CSC (average of 2 runs) | KRC-1 R4F-101601-01 ng/mg CSC (average of 3 runs) | KRC-1 R41-101401-01 ng/mg CSC (average of 4 runs) | KRC-1 R4F-101701-03 ng/mg CSC (average of 3 runs) | Average (n = 12) | Stdev | % CV |
| phenanthrene | 6.44 | 6.58 | 7.33 | 6.57 | 6.73 | 0.40 | 5.99 |
| 2-methylanthracene | 3.72 | 3.87 | 3.86 | 4.04 | 3.87 | 0.13 | 3.34 |
| pyrene | 1.96 | 2.04 | 2.15 | 2.06 | 2.05 | 0.08 | 3.90 |
| chrysene | 0.95 | 0.96 | 1.00 | 1.00 | 0.98 | 0.03 | 2.84 |
| benzo[a]pyrene | 0.61 | 0.64 | 0.65 | 0.64 | 0.63 | 0.02 | 2.76 |

Effect of Charcoal Filter on PAHs

A study was conducted to determine the most effective type of carbon to utilize in carbon filled filters for cigarettes, particularly 100% filled cavity filters. Carbon filled cavity filters have been used by a number of tobacco companies in the United States and abroad to help remove gasses and volatiles from cigarette smoke. FIG. 1 illustrates the effectiveness of a 100% filled cavity in removing a host of organics and HCN from cigarette smoke. Despite this, to date, no United States company has used a 100% filled charcoal filter. However, the carbon's effectiveness in removing neutral non-polar molecules, such as PAHs, from the mainstream gasses has not been investigated, nor has the potential of a more active form of carbon been studied.

Figure 3:
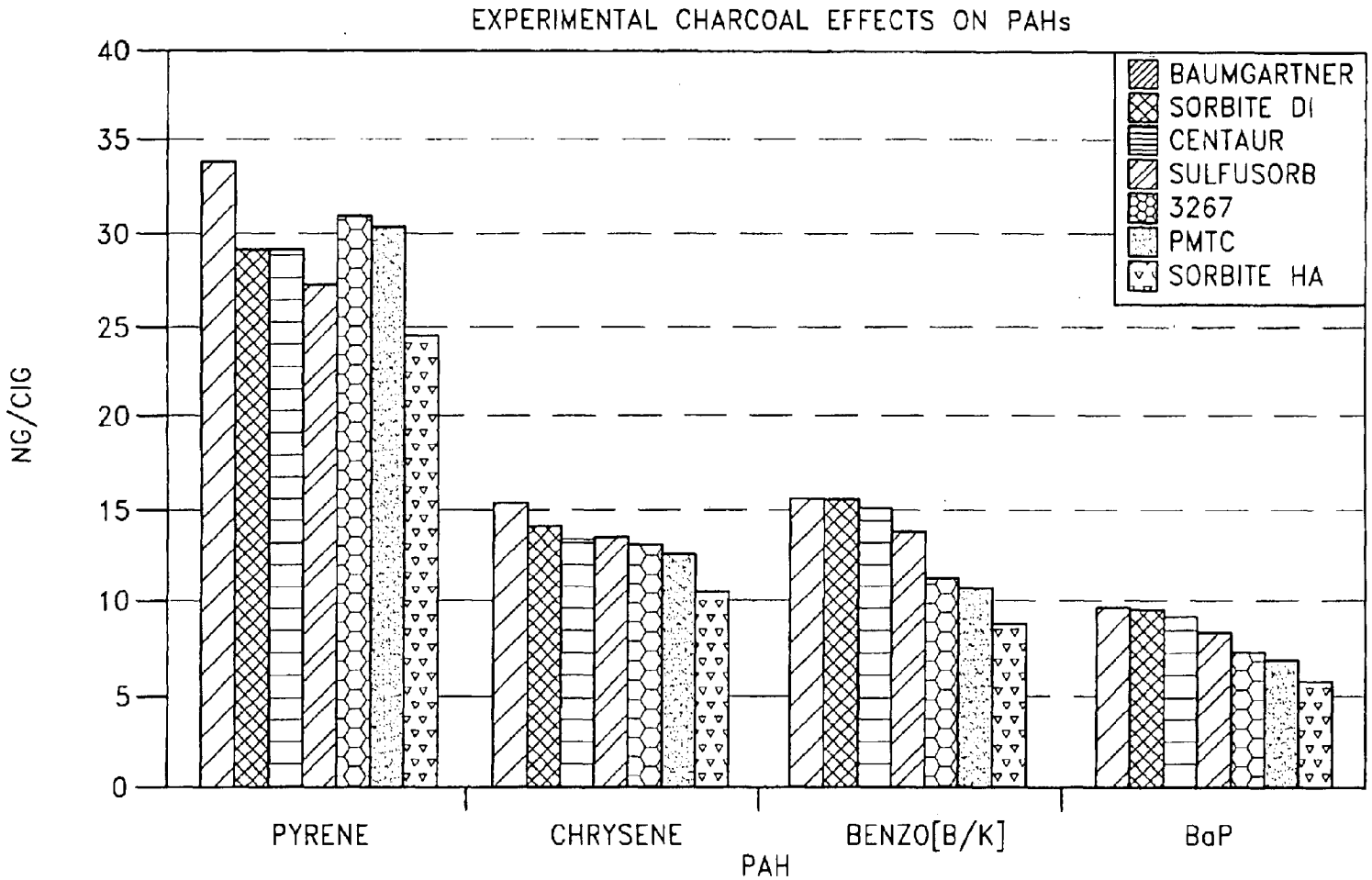
FIG. 3 provides PAH levels for various experimetal charcoals in a cavity filter.

King size cigarettes with a Baumgartner 100% filled charcoal cavity were prepared. The charcoal cavity was opened and the carbon removed. This cavity was then refilled with the different Calgon carbon samples, as listed in Table 9. For each carbon sample, 120 cigarettes were prepared, which allowed for analysis to be done in triplicate. Each of these samples was smoked using the FTC protocol. After smoking, the CSC was extracted from the Cambridge pads using the Extraction Protocol described above and samples were submitted for mass spectroscopy analysis for PAHs. The results of the analysis are provided in Table 9 and FIG. 3.

TABLE 9

| PAHs for Various Charcoal Types (Fresh) | | | | | | | |
|---|---|---|---|---|---|---|---|
| FIL. EXP. | Phen-anthrene | 2-methyl anthracene | pyrene | chrysene | benzo[b/k] fluoranthrene | benzo[a] pyrene | tar |
| Baumgartner 100% | 133.73 | 53.70 | 3.89 | 15.40 | 15.78 | 9.91 | .87 |
| SULFUSORB 12 | 99.89 | 48.36 | 7.24 | 13.58 | 13.87 | 8.68 | .83 |
| CENTAUR 499 | 101.71 | 50.22 | 7.54 | 13.47 | 15.24 | 9.52 | .12 |
| SORBITE DI | 110.20 | 55.16 | 9.15 | 14.08 | 15.77 | 9.84 | .40 |
| PMTC | 113.83 | 45.45 | 0.31 | 12.69 | 10.91 | 7.11 | 0.3 |
| 3267-79-03 | 127.55 | 45.96 | 1.04 | 13.22 | 11.45 | 7.54 | .63 |
| SORBITE HA | 89.31 | 36.92 | 4.47 | 10.62 | 8.93 | 5.93 | .83 |

In addition, four more samples were prepared approximately one month later for most of the carbon samples, as well as a new sample, SCCW 14×40. For each of these samples, 120 cigarettes were prepared, as described above, and each sample was then smoked according to the FTC protocol. The results of the analysis are provided in Table 10.

TABLE 10

PAHs for Various Charcoal Types (After Exposure to Atmosphere for 1 Month)

| FIL. EXP. | phen-anthrene | 2-methyl anthracene | pyrene | chrysene | benzo[b/k] fluoranthene | benzo[a] pyrene | tar |
|---|---|---|---|---|---|---|---|
| CA filter | 155.32 | 45.76 | 33.22 | 14.21 | 6.65 | 5.54 | 14.05 |
| Baumgartner | 105.45 | 32.41 | 25.31 | 10.51 | 6.47 | 4.83 | 10.72 |
| SULFUSORB 12 | 111.10 | 33.49 | 26.03 | 11.07 | 6.26 | 4.46 | 10.76 |
| PMTC | 93.92 | 30.99 | 24.71 | 10.43 | 6.28 | 4.84 | 10.95 |
| SORBITE HA | 114.19 | 32.36 | 26.39 | 11.00 | 6.64 | 4.45 | 10.20 |
| SCCW 14 × 40 | 117.53 | 32.79 | 25.58 | 10.67 | 6.46 | 4.30 | 10.32 |

Seven different charcoal types were studies to determine their potential effectiveness in removing PAHs, primarily benzo[a]pyrene, from cigarette smoke. As is seen in Table 9 and when compared to the commercially available carbon 100% filled carbon filter from Baumgartner, four of the Calgon carbon samples (Sulfusorb, PMTC, Sorbite HA, and 3267-79-03) were very effective in reducing all of the PAH levels. The other two carbons (Centaur and Sorbite DI) were effective for reducing some of the PAHs, but neither gave a significant reduction in the benzo[a]pyrene level.

These results suggest that Calgon Sorbite HA is a superior adsorbent than conventional activated charcoal for removing certain PAHs. To confirm the results, certain samples were retested. A different GC-MS quantitative method was used to obtain the results in Table 10 than was used to obtain the results in Table 9. The new method, used to obtain the results in Table 10, resulted in a decrease in all the PAH levels across the board, which can be seen by comparing the Baumgartner data in Table 9 and Table 10. These two samples should result in the same PAH levels, but Table 10 is significantly lower. Despite this change, it is possible to determine whether the experimental carbons are more effective than the commercially available one, by comparing them to a new Baumgartner sample analyzed with the new GC-MS method.

Table 10 shows that the PAH levels for all of the samples, including the commercially available Baumgartner filter, are statistically the same. It is believed that the experimental charcoals lost their increased activity over time and are no more effective than the industry standards charcoals after extended exposure to atmospheric conditions. When the first experiments were conducted, the experimental charcoal had just arrived from Calgon and was sealed in airtight containers. These containers were opened and the cigarette samples were prepared and smoked within a one week time frame. During the month between the first and second set of experiments, the charcoals were stored in their shipping containers, which were no longer airtight.

It can therefore be concluded that the use of any charcoal that considerably reduces PAH levels, especially benzo[a] pyrene, over that of conventional activated charcoal is only worthwhile if the production process, from production of the filter to delivery of the cigarette to consumer, is completed under a week. Any longer time frame and the added benefits of the new charcoal are lost. Thus, it is generally satisfactory to use the standard commercially available charcoal filter. However, if activated charcoals are available that retain their activity beyond that of the charcoals investigated, then it may be advantageous to use such charcoals. Alternatively, different adsorbent materials may be added to the filter cavity besides charcoal or in addition to charcoal, which may result in lowering the PAH levels below those observed for conventional activated charcoal.

Reduction in Carbazole Levels

Experiments were conducted to compare the levels of carbazole in smoke from cigarettes containing tobacco incorporating palladium particles and magnesium nitrate to those of comparable cigarettes not containing the catalyst system. Carbazole is used as a surrogate for azaarene compounds, which are potent carcinogens. A catalyst system was prepared as described in the first Example, and applied to third blend of tobacco. The quantification for carbazole in the cigarette smoke condensate showed that the carbazole is reduced over 29% when the catalyst system is used, as shown in Table 11.

TABLE 11

Commercial Blend (Not Filtered)

| Carbazoles In HRC REFERENCE | Carbazoles In PG EXPERIMENTAL | Reduced |
|---|---|---|
| 379.89 ng/cig[a] HRC060101 | 266.21 ng/cig[a] PG-21-070-01 | 29.92% |
| 386.03 ng/cig HRC060501 | — | — |

[a]data obtained with no recovery corrected

Reduction in NitroPAHs Levels

Exposure of PAHs to $NO_2$ and nitric acid impurity in $NO_2$ may result in degradation of PAHs and formation of nitroarenes (or nitroPAHs) with increased mutagenicity. The suggested $NO_3$ radical-initiated reaction mechanism is as follows.

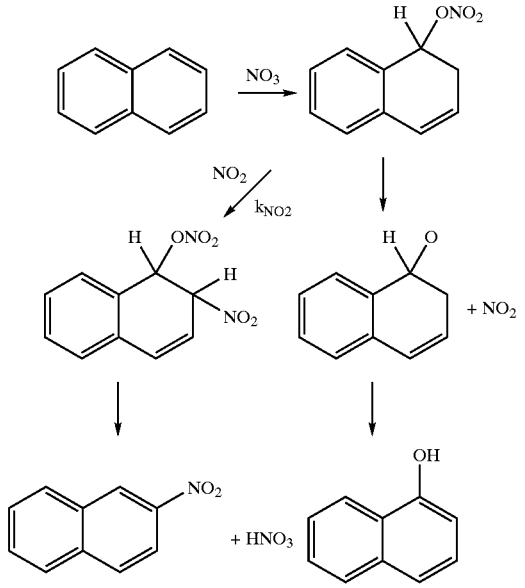

-continued

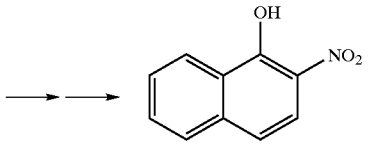

The catalyst system described in the examples above incorporates magnesium nitrate, which may lead to the formation of nitroarenes or nitroPAHs as described above. Five nitroarenes, which have been categorized as Reasonably Anticipated to be Human Carcinogens on the 9th Report on Carcinogens Revised January 2001 by U.S. Department of Health and Human Services, were selected as indicators, although other nitroarenes such as nitronaphthalene, nitromethylnaphthalene and nitroacenaphthene might have higher yields. These nitroarenes include 1-nitropyrene, 4-nitropyrene, 6-nitrochrysene, 1,6-dinitropyrene and 1,8-dinitropyrene.

HPLC-FL (High Performance Liquid Chromatography-Fluorescence) was used as separation and detection equipment. A double endcapped XDB Zobax Eclipse C 18 column (46 mm×150 mm, 3.5 $\mu$m) was used. Mobile phase consisted of two solvent systems, A and B. A was 100% Acetonitrile and B was a 25 mM $Na_2HPO_4$ aqueous solution. The mobile phase gradient was 50% A+50% B for the first 5 minutes and 40% A+60% B for the remaining 9 minutes. Fluorescence detection used $E_x$=360, $E_m$=430 for 1-nitropyrene, 4-nitropyrene and 6-nitrochrysene and $E_x$=369, $E_m$=442 for 1,6-dinitropyrene and 1,8-dinitropyrene.

Nitroarenes on pad (90 mm diameter Cambridge glass fiber) were extracted by 40 ml×2 acetone, 15 min×2 shaking at 150 rmp. After evaporating the solvent at 30° C. to dryness, the extracts were brought up into methylene chloride 1 ml×5. The methylene chloride solution was then driven through a 1.5 g SCX cartridge conditioned with at least 10 ml methylene chloride at a natural flow rate. The sample flask was rinsed with 1 ml×5 methylene chloride and the rinse was used to rinse the loaded SCX cartridges also. All solution coming off the cartridge was collected. The cartridge was sucked dry. The collected solution was evaporated down to dryness. The residue was brought up to 2 ml by methylene chloride. Then, 10 mg zinc dust, 20 $\mu$l acetic acid and 20 $\mu$l water had been added into the solution and the reaction proceeded for 30 min. The reaction mixture was filtered by a 1 cm long, 0.55 cm diameter silica gel column. The clear solution thus obtained was then driven through a 500 mg SCX cartridge (preconditioned with 3 ml methylene chloride), again at natural flow rate. After loading, the cartridge was sucked dry again before eluting the cartridge with 6 ml of 30% TEA (tetra-ethyl-amine) methanol solution. The elutes were collected in a 10 ml volumetric flask and then diluted with methanol to 10 ml for HPLC-FL detection.

Figure 4:
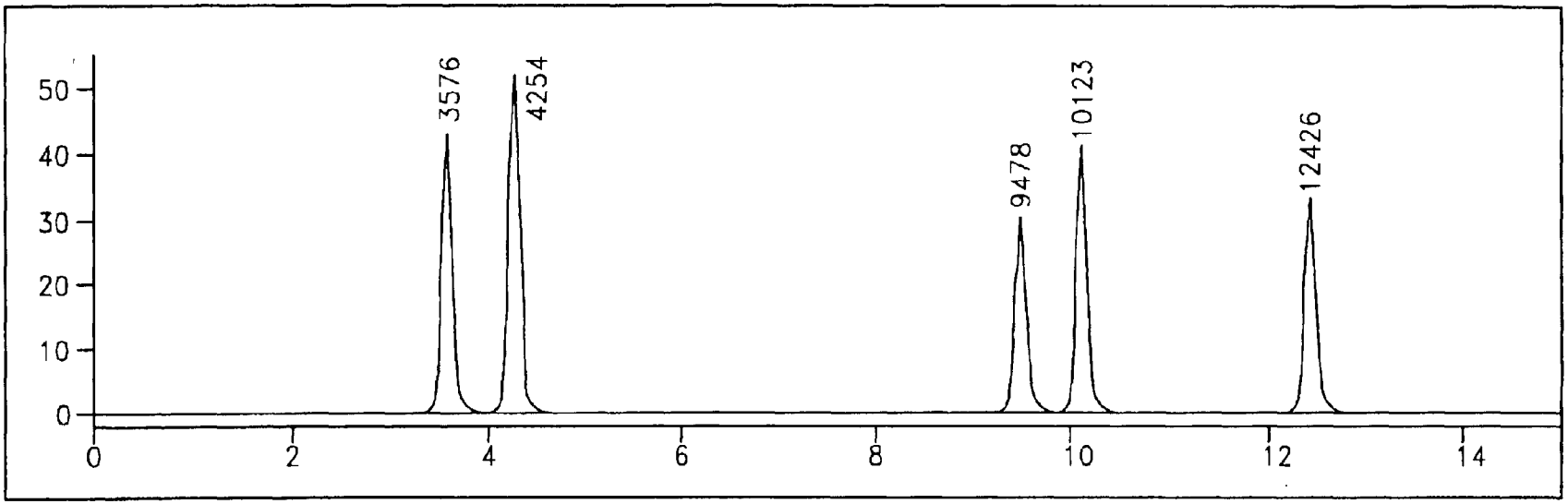
FIG. 4 provides a HPLC spectrum of nitroPAH standards, from left to right: 1,6-diaminopyrene, 1,8-diaminopyrene, 4-aminopyrene, 1-aminopyrene and 6-aminochrysene.

HPLC-FL was selected as the separation and detection system, because nitroarenes are generally not thermally stable in a GC injection system and a fluorescence detector has low detection limit (1–10 pg in air matrix). However, nitroarenes do not have a fluorescence emission. Therefore, in order to be able to be detected by fluorescence detector, nitroarenes have to be reduced to corresponding aminoarenes that have strong fluorescence emissions. Aminoarenes are basic. Their basicity depends greatly upon the amino groups they have on their parent rings. Usually, the more amino groups the compound has, the stronger its basicity. Among the five compounds selected as described above, 1,6-diaminopyrene and 1,8-diaminopyrene have stronger basicity than 1-aminopyrene, 4-aminopyrene and 6-aminochrysene. To avoid the peak broadening, coeluting, and tilting effect caused by the binding of the basic compounds with the weak acidic OH groups on silica substrates of the HPLC C18 separation column, the double endcapped C18 column and 25 mM $Na_2HPO_4$ aqueous mobile phase were applied. FIG. 4 shows the spectrum of all five standards we separated under our developed HPLC-FL condition. Table 12 presents the parameters of five peaks in FIG. 4. The standard curve, which is linear, had been set up afterwards for quantification.

TABLE 12

Peak Parameters of Standards

| Standards | $T_{rt}$ | $W_{h/2}$ | $F_T$ | N |
|---|---|---|---|---|
| 1,6-diaminopyrene | 3.576 | 0.117 | 1.139 | 5207 |
| 1,8-diaminopyrene | 4.254 | 0.119 | 1.126 | 7102 |
| 4-aminopyrene | 9.478 | 0.132 | 1.114 | 28355 |
| 1-aminopyrene | 10.123 | 0.139 | 1.074 | 29554 |
| 6-aminochrysene | 12.426 | 0.176 | 1.057 | 27492 |

$T_{rt}$: Retention time;
$W_{h/2}$: Peak width at half height;
$F_t$: USP tailing factor;
N: Efficiency;
For a good shape peak, tailing factor of 1, high efficiency, and narrow peak width are preferred.

The extraction of nitroarenes included two steps. The first step was to extract the nitroarenes into solution. The second step was to reduce the nitroarenes into corresponding aminoarenes so that they can be detected. Each step had its own clean-up stage to reduce the interference as much as possible.

In order to ensure that the designed extraction, reduction and clean-up procedures are working, experiments with standards were carried out. Results indicated that SCX (strong cation exchange, propylsulfonic acid) cartridges can not only get rid of interfering aromatic amine in the first clean-up step, but can also separate target analytes from other interferences in the second clean-up step, since standards were held tight on the cartridge. Different bases at different concentrations were investigated for their capability to elute the on-hold standards off the cartridge with high recovery. Ammonium hydroxide methanol solution, sodium hydroxide ethanol solution, sodium hydroxide aqueous solution and tetraethylamine (TEA) methanol solution were all investigated. The 30% TEA methanol solution was observed to give superior results, namely, a 80%–90% recovery.

Reduction of nitroarenes to corresponding aminoarenes was shown to give the best recovery, 83%–85%, when glacial acetic acid was selected from amongst different concentrations of glacial, hydrochloric, and formic acids investigated for use in combination with zinc dust. However, the same amount of water as of acetic acid was added such that so that no amide, a side compound that decreases the recovery, was produced.

The extraction of standards spiked onto cigarette smoke condensate from Kentucky Reference cigarettes (KRC-1R4F CSC matrix) exhibits 63.4%–71.3% recoveries.

The extraction, detection, and quantification methods was demonstrated to provide satisfactory results with standards of all five target analytes. The methods may be used to determine whether nitroarenes are produced in cigarette smoke condensates.

Reduction in Catechol and Phenol Levels

Experiments were conducted to compare the levels of catechol and phenol in smoke from cigarettes containing tobacco incorporating palladium particles and magnesium nitrate to those of comparable cigarettes not containing the catalyst system. A catalyst system was prepared as described in the first Example, and applied to similar blends to those used above. The tobacco containing the catalyst system was fashioned into cigarettes. Comparable cigarettes were fashioned from tobacco without the catalyst system. As the data in Tables 13–16 demonstrate, substantial reductions in both phenol and catechol levels were observed in cigarettes containing the catalyst system. The FTC smoking protocol and the Massachusetts protocol, both well known in the art, were used in this experiment

TABLE 13

Control Cigarettes - FTC Method

| 5 cigs./pad | | CSC wt. (g) | CSC/cig. (mg) | Area | Con. (ng/μl) | Con. (ng/μl) | Con. (μg/cig) | Average | STDEV | % CV |
|---|---|---|---|---|---|---|---|---|---|---|
| KRC-072501-01 | catechol | 0.048 | 9.6 | 120.42 | 4.953 | 2.477 | 49.53 | 44.123 | 4.831 | 10.95 |
| | phenol | | | 31.721 | 0.618 | 0.309 | 6.180 | 6.030 | 0.210 | 3.483 |
| KRC-072501-02 | catechol | 0.047 | 9.4 | 103.90 | 4.261 | 2.131 | 42.61 | | | |
| | phenol | | | 31.432 | 0.612 | 0.306 | 6.120 | | | |
| KRC-072501-03 | catechol | 0.045 | 9.0 | 98.207 | 4.023 | 2.012 | 40.23 | | | |
| | phenol | | | 29.656 | 0.579 | 0.290 | 5.790 | | | |

catechol y = 23.88275x + 2.13633 (inj. 10 μl)
phenol y = 52.59205x − 0.773268 (inj. 10 μl)

TABLE 14

Control Cigarettes - Mass. Method

| 2 cigs./pad | | | CSC wt. (g) | CSC/cig. (mg) | Area | Con. (ng/μl) | Con. (ng/μl) | Con. (μg/cig) | Average | STDEV | % CV |
|---|---|---|---|---|---|---|---|---|---|---|---|
| KRC-080701-04 | Injection 1 | catechol | 0.044 | 22 | 187.68 | 8.084 | 2.021 | 101.05 | 100.01 | 1.476 | 1.476 |
| | | phenol | | | 62.036 | 1.255 | 0.314 | 15.688 | 15.538 | 0.212 | 1.365 |
| | Injection 2 | catechol | 0.044 | 22 | 183.8 | 7.917 | 1.979 | 98.963 | | | |
| | | phenol | | | 60.801 | 1.231 | 0.308 | 15.388 | | | |
| KRC-080701-05 | Injection 1 | catechol | 0.046 | 23 | 187.68 | 8.084 | 2.021 | 101.05 | 100.71 | 0.486 | 0.483 |
| | | phenol | | | 60.186 | 1.218 | 0.305 | 15.225 | 15.200 | 0.035 | 0.233 |
| | Injection 2 | catechol | 0.046 | 23 | 186.39 | 8.029 | 2.007 | 100.36 | | | |
| | | phenol | | | 59.977 | 1.214 | 0.304 | 15.175 | | | |
| KRC-080701-06 | Injection 1 | catechol | 0.045 | 22.5 | 176.51 | 7.602 | 1.901 | 95.025 | 95.075 | 0.071 | 0.074 |
| | | phenol | | | 51.878 | 1.052 | 0.263 | 13.150 | 13.144 | 0.009 | 0.067 |
| | Injection 2 | catechol | 0.045 | 22.5 | 176.69 | 7.61 | 1.903 | 95.125 | | | |
| | | phenol | | | 51.861 | 1.051 | 0.263 | 13.138 | | | |

catechol y = 23.15112x + 0.518686 (inj. 10 μl)
phenol y = 49.88311x − 0.585298 (inj. 10 μl)

TABLE 15

Cigarettes with Catalyst System - FTC Method

| 5 cigs./pad | | CSC wt. (g) | CSC/cig. (mg) | Area | Con. (ng/μl) | Con. (ng/μl) | Con. (μg/cig) | Average | STDEV | % CV | % reduction |
|---|---|---|---|---|---|---|---|---|---|---|---|
| PG-19-059-10 | catechol | 0.074 | 14.8 | 135.84 | 5.845 | 2.923 | 58.450 | 58.377 | 0.683 | 1.170 | 28.53 |
| | phenol | | | 74.325 | 1.502 | 0.751 | 15.020 | 14.757 | 0.6559 | 4.445 | 47.50 |
| PG-19-059-11 | catechol | 0.069 | 13.8 | 133.99 | 5.766 | 2.883 | 57.660 | | | | |
| | phenol | | | 69.293 | 1.401 | 0.701 | 14.010 | | | | |
| PG-19-059-12 | catechol | 0.067 | 13.4 | 137.16 | 5.902 | 2.951 | 59.020 | | | | |
| | phenol | | | 75.418 | 1.524 | 0.762 | 15.240 | | | | |
| PG-19-054-10 | catechol | 0.053 | 10.6 | 103.23 | 4.437 | 2.219 | 44.370 | 41.723 | 2.322 | 5.565 | |
| | phenol | | | 38.967 | 0.793 | 0.397 | 7.930 | 7.747 | 0.163 | 2.099 | |
| PG-19-054-11 | catechol | 0.046 | 9.2 | 93.20 | 4.003 | 2.002 | 40.030 | | | | |
| | phenol | | | 37.769 | 0.769 | 0.385 | 7.690 | | | | |
| PG-19-054-12 | catechol | 0.055 | 11 | 94.901 | 4.077 | 2.039 | 40.770 | | | | |
| | phenol | | | 37.419 | 0.762 | 0.381 | 7.620 | | | | |

TABLE 16

Cigarettes with Catalyst System - Mass. Method

| 2 cigs./pad | | CSC wt. (g) | CSC/cig. (mg) | Area | Con. (ng/μl) | Con. (ng/μl) | Con. (μg/cig) | Average | STDEV | % CV | % reduction |
|---|---|---|---|---|---|---|---|---|---|---|---|
| PG-19-059-01 | catechol | 0.068 | 34 | 255.62 | 11.019 | 5.510 | 137.738 | 134.588 | 9.189 | 6.828 | 25.71 |
| | phenol | | | 73.246 | 1.48 | 0.740 | 18.500 | 16.533 | 1.729 | 10.460 | 43.01 |

TABLE 16-continued

Cigarettes with Catalyst System - Mass. Method

| 2 cigs./pad | | CSC wt. (g) | CSC/cig. (mg) | Area | Con. (ng/μl) | Con. (ng/μl) | Con. (μg/cig) | Average | STDEV | % CV | % reduction |
|---|---|---|---|---|---|---|---|---|---|---|---|
| PG-19-059-02 | catechol | 0.06 | 30 | 230.62 | 9.939 | 4.970 | 124.238 | | | | |
| | phenol | | | 60.278 | 1.220 | 0.610 | 15.250 | | | | |
| PG-19-059-03 | catechol | 0.074 | 37 | 263.12 | 11.343 | 5.672 | 141.788 | | | | |
| | phenol | | | 62.654 | 1.268 | 0.634 | 15.850 | | | | |
| PG-19-054-01 | catechol | 0.042 | 21 | 369.37 | 15.932 | 3.983 | 99.575 | 99.985 | 2.151 | 2.152 | |
| | phenol | | | 75.446 | 1.524 | 0.381 | 9.525 | 9.423 | 0.591 | 6.272 | |
| PG-19-054-11 | catechol | 0.043 | 21.5 | 363.78 | 15.691 | 3.923 | 98.069 | | | | |
| | phenol | | | 78.882 | 1.593 | 0.398 | 9.956 | | | | |
| PG-19-054-03 | catechol | 0.045 | 22.5 | 379.5 | 16.37 | 4.093 | 102.313 | | | | |
| | phenol | | | 69.566 | 1.406 | 0.352 | 8.788 | | | | |

catechol y = 23.15112x + 0.518686 (inj. 10 μl)
phenol y = 49.88311x − 0.585298 (inj. 10 μl)

Determination of Phenolic Compounds

Phenolic compounds in mainstream (MS) smoke have been detected with the use of High Performance Liquid Chromatography (HPLC). The method utilizes certain features of published methods, including: Risner et al., "A High Performance Liquid Chromatographic Determination of Major Phenolic Compounds in Tobacco Smoke" Journal of Chromatographic Science, Vol. May 1990, 239; and Adams et al., "Carcinogenic agents in cigarette smoke and the influence of nitrate on their formation" Carcinogenesis, Vol. 5 no. 2 194, 221, the contents of which are incorporated herein by reference in their entireties.

Mainstream smoke obtained using standard smoking methods was collected on a glass fiber filter pad. After smoking, the filter pad was extracted and analyzed for phenolic compounds. The HPLC method used selective fluorescence detection for the determination of hydroquinone, resorcinol, catechol, phenol, o-cresol, m-cresol, and p-cresol. The seven phenolic compounds were separated by gradient elution. The peaks of m-cresol and p-cresol overlapped, and were therefore not able to be separated.

In order to separate the phenolic compounds, a gradient elution system was used. This system ensured that the seven compounds were separated for proper quantification. The elution system is documented in Table 17. Suitable A and B solutions include 100% Acetonitrile a 25 mM $Na_2HPO_4$ aqueous solution, respectively, however in certain embodiments other solutions may be preferred.

TABLE 17

Gradient Profile for Separation

| Time (min) | % A | % B | Flow (ml/min) |
|---|---|---|---|
| 0 | 95 | 5 | 1 |
| 30 | 70 | 30 | 1 |
| 35 | 70 | 30 | 1 |
| 40 | 0 | 100 | 1 |
| 45 | 95 | 5 | 1 |
| 50 | 95 | 5 | 1 |

A selective florescence profile was created for the quantification of the phenolic compounds. Each analyte has a specific excitation and emission wavelength. The Florescence detector used the selective florescence profile listed in Table 18.

TABLE 18

Selective Florescence Profile

| Time (min) | Excitation (nm) | Emission (nm) |
|---|---|---|
| 0 | 304 | 338 |
| 8 | 284 | 313 |
| 11 | 280 | 325 |
| 16 | 274 | 298 |
| 25 | 285 | 310 |

Figure 5:
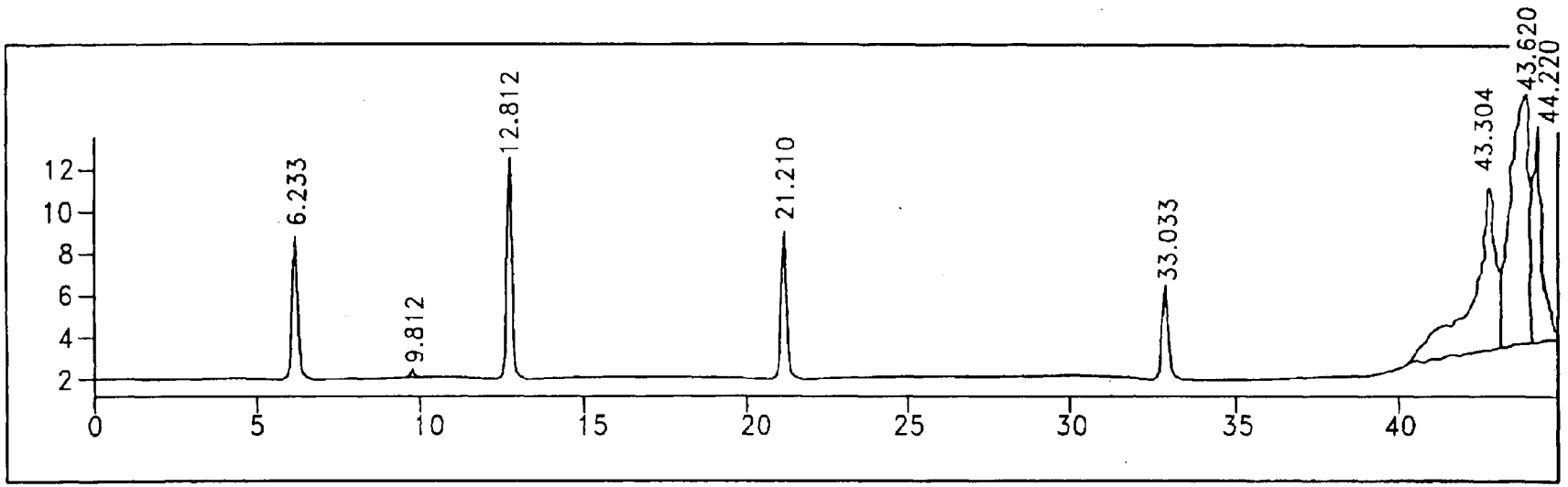
FIG. 5 is a typical HPLC chromatogram for PAH analysis, from left to right: hydroquinone, resourcinol, catechol, phenol, and o-cresol.

FIG. 5 illustrates is a typical chromatogram generated from the HPLC instrument. The peaks, from left to right, correspond to hydroquinone, resourcinol, catechol, phenol, and o-cresol. Each peak, once separated, generates an area corresponding to the luminescence (LU). The area is then converted into a concentration in ng/μL. By implementing a shorter column, run time could be reduced by about 35% or more, and solvent usage could be reduced.

Reduction of Volatile Gases

The effect of the palladium catalyst system on volatile gases, such as NO, HCN and $CH_3CN$, during the smoking process was investigated. Two production cigarettes were prepared, a baseline cigarette (no catalyst) and a production cigarette (containing the catalyst, similar to the OMNI Full Flavor King Size), to determine what kind of effect the catalyst system had on volatiles. A leading competitor's full flavor and light cigarettes were also tested, as well as a Kentucky Reference cigarette, IR4F, which permitted comparison of the production cigarette's volatile levels to the competitor's levels. These cigarettes were smoked on a single port smoking machine provided by K. C. Automation. Downstream from the cigarette port was incorporated a residual gas analyzer (RGA) from MKS Instruments. The RGA is a self-contained mass spectrometer configured to analyze the mainstream smoke every 0.5 seconds for NO, HCN, and $CH_3CN$.

Analyzing the volatile gases produced during the smoking process is a difficult process, since it is not possible to collect them on the Cambridge pads. It is therefore common practice to trap volatiles in an alcohol trap, such as isopropanol, downstream from the cigarette. Once the volatiles have been trapped in the alcohol, it is possible, with some difficulty, to extract the volatiles using a GC/MS and a variable temperature cryogenic cooler. To avoid the difficulty associated with this method, a new system was designed for analyzing volatiles in cigarette smoke. As stated above, a RGA was attached to a single port smoking machine, which permitted direct sampling of the mainstream smoke as well as side stream smoke. The RGA permits analysis of the cigarette smoke while the cigarette is smoking instead of in a different step, as in the conventional method discussed above.

Figure 6:
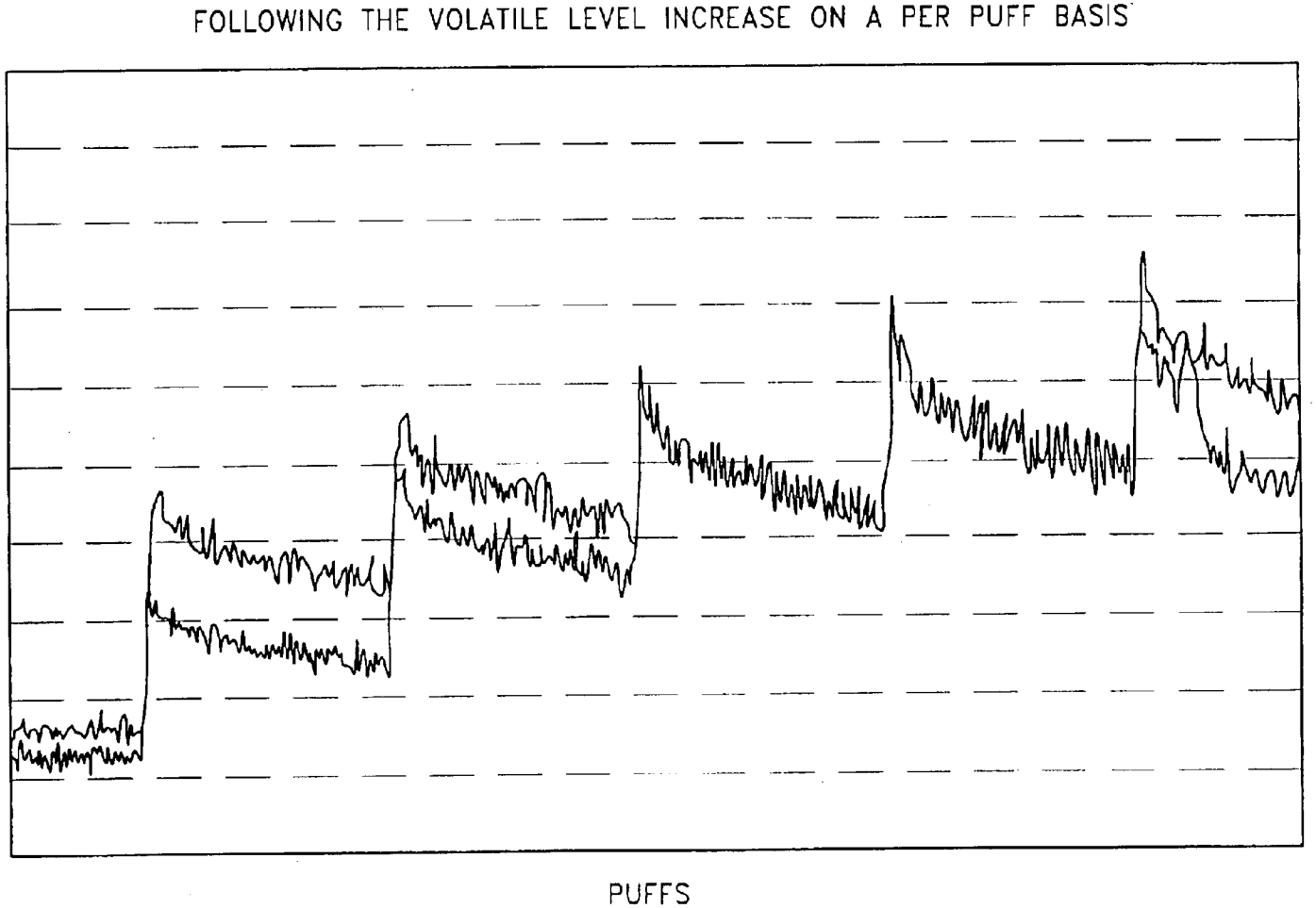
FIG. 6 illustrates the increase in volatile level on a per puff basis as measured using a residual gas analyzer.

The RGA instrument is a stand-alone mass spectrometer that is specifically set up to detect certain volatiles, including nitric oxide, hydrogen cyanide, and acetonitrile. The RGA can, however, be readily customized to search for any volatile with an atomic weight below 200 amu. As the cigarette is smoked, the mainstream gas passes through a Cambridge pad, which removes any particulate matter, then down towards the exhaust port. The RGA's capillary tube is attached to the exhaust port, which allows very small aliquots of the smoke to be sampled every 0.5 seconds. This frequent data collection makes it possible to actually see the volatile levels increase as the cigarette is puffed, as illustrated in FIG. 6. Once the cigarette has been smoked, the volatile data can then be analyzed, as shown in Table 19. PG-19-081 is a baseline Woods I blend containing no catalyst, and incorporating a cellulose acetate filter. PG-19-090 is a Woods I blend, palladium treated with a 30% reduction in nitrate, made with a 409 paper, and incorporating a cellulose acetate-charcoal-cellulose acetate filter.

TABLE 19

Comparison of Volatiles

| | PG-19-081 | PG-19-090 | Marlboro | Marl. Lts. | 1R4F |
|---|---|---|---|---|---|
| NO | 0.0248 | 0.0434 | 0.0207 | 0.0132 | 0.0180 |
| HCN | 0.0340 | 0.0210 | 0.0320 | 0.0174 | 0.0186 |
| $CH_3CN$ | 0.0209 | 0.0102 | 0.0176 | 0.0095 | 0.0132 |

As shown in Table 19, the baseline cigarette, PG-19-081, compares very closely with the Marlboro full flavor in all three volatiles studied. It should be noted that attempts were made to study several other volatiles, including benzene, toluene, dimethyl nitrosamine, and several nitroalkanes, but to date none of this compounds have ever been observed using this method. When the catalyst was present in the cigarette, as in PG-19-090, an increase in the NO level was seen, which was due to the increased nitrate level, but the HCN and $CH_3CN$ levels were reduced by 35.2% and 51.2%. Direct comparison of PG-19-090 to the Marlboro full flavor showed a two-fold increase in the NO level for the full flavor PG-19-090 cigarette. Despite this increase in NO, the full flavor PG-19-090 cigarette had HCN and $CH_3CN$ levels significantly lower (34.4% and 42.1% respectively) than the Marlboro full flavor, and were much closer to the amounts found for Marlboro Lights and 1R4Fs.

The data demonstrate that in addition to reducing the PAH levels, the catalyst system also yields a major reduction of HCN and $CH_3CN$ concentrations. As expected, the NO concentration was elevated due to the addition of nitrate to the catalyst system. The higher NO concentration may make the task of producing a pleasurable tasting cigarette more challenging. It may be possible to reduce the nitrate level in the catalyst system without reducing the catalyst's effectiveness in reducing PAHs, thereby reducing the NO concentration. It may also be possible to reduce NO concentration without making changes to the catalyst system by changing the cigarette's construction, for example, by using a different paper or filter. By changing the porosity of the cigarette paper, bum rate and ventilation may be changed, which may possibly reduce the NO concentration. Also, there are numerous NO scavengers that may be incorporated into the filter cavity, which may prove to be very effective in extracting NO from mainstream smoke.

Reduction in Volatiles by Charcoal Filter

Experiments were conducted to compare the levels of reduction of various gas phase components from cigarette smoke by cavity filters having different fill levels. Experiments were conducted using Baumgartner CAVIFLEX filters. With the CAVIFLEX filter, the cavity may be filled to almost 100% of volume, typically 5 to 95% of volume, with carbon or other types of granules. When the cavity is filled to 30 capacity, the smoke passes through all of the carbon bed resulting in a highly efficient vapor phase adsorption. To optimize and adjust the amount of vapor phase retained by the filter, certain inert materials or inactivated carbon can be mixed with granules of activated carbon in the cavity. Examples of low cost granular inert material include semolina (a milled product of durum wheat) and inert carbon.

Figure 7:
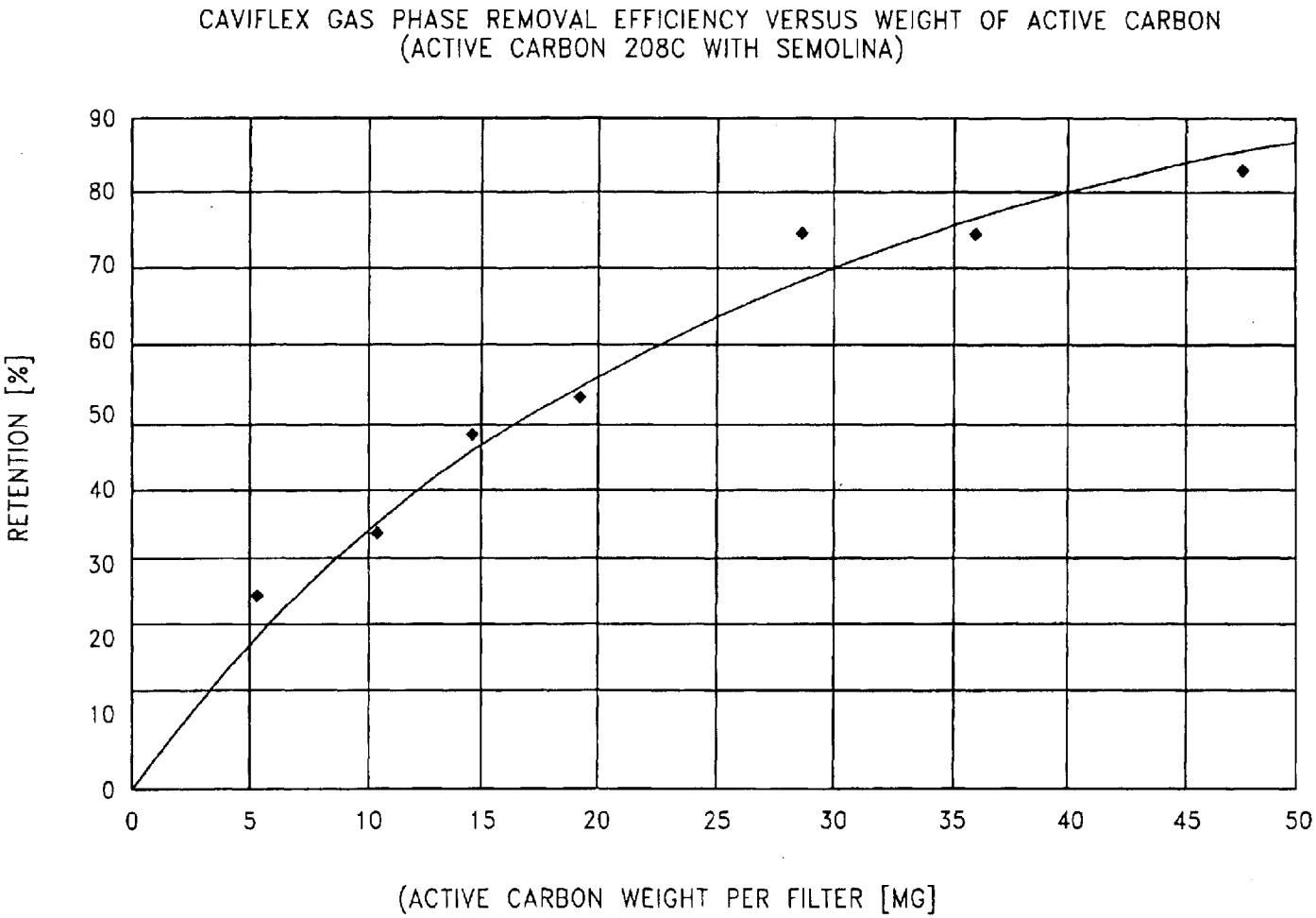
FIG. 7 illustrates the gas phase removal efficiency of CAVIFLEX filters containing different weights of active carbon 208C mixed with semolina.
Figure 8:
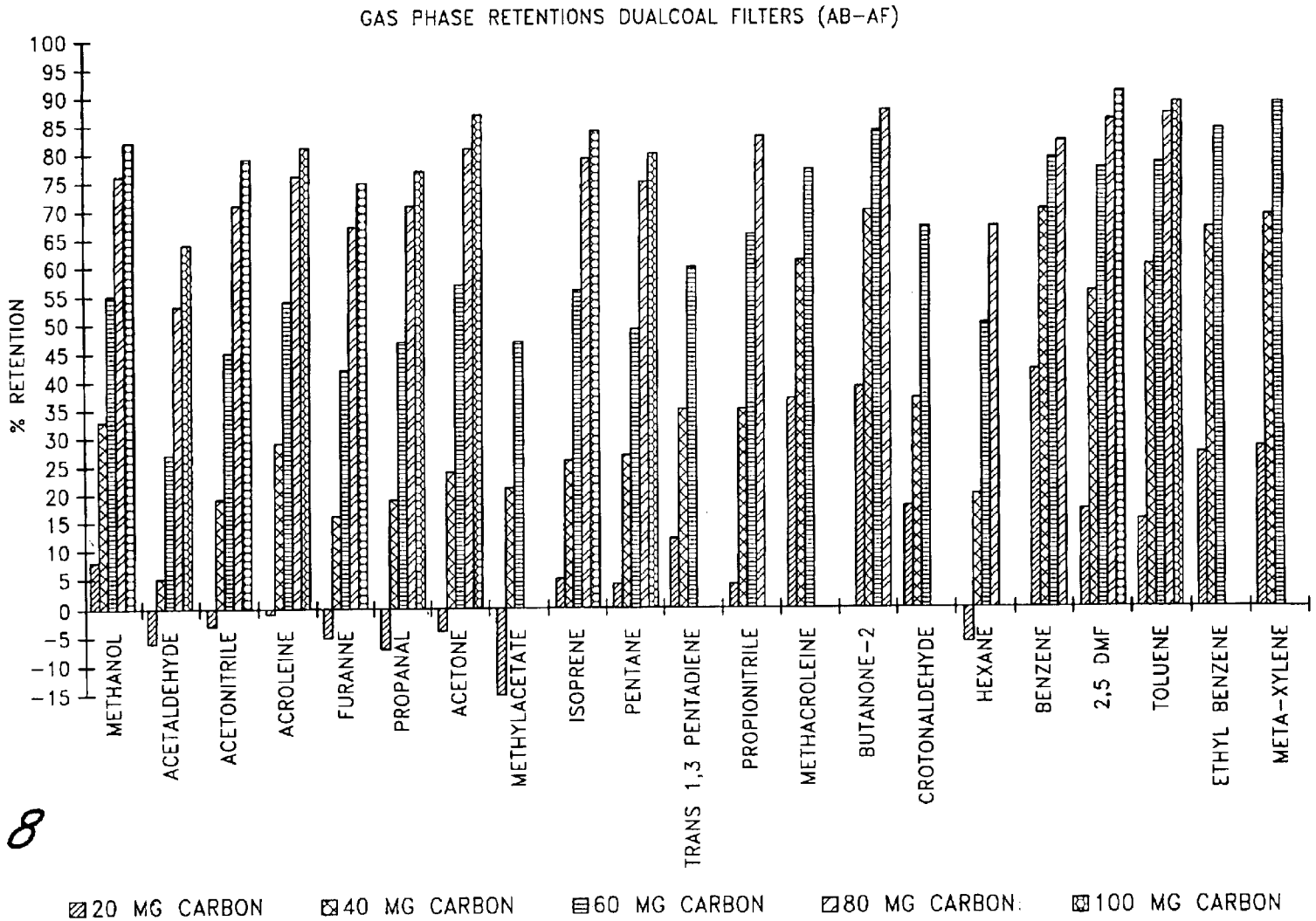
FIG. 8 provides gas phase retention for dual coal filters containing 20, 40, 60, 80, and 100 mg carbon, respectively.

FIG. 7 illustrates the gas phase removal efficiency of CAVIFLEX filters containing different weights of active carbon 208C mixed with semolina. As the weight of active carbon in the filter increases, a corresponding increase in retention of gas phase components is observed. Table 20 provides data concerning reduction in levels of various volatile components by a reference cigarette, and cigarettes equipped with CAVIFLEX filters containing 5 mg, 10 mg, 15 mg, 20 mg, 30 mg, 40 mg, and 50 mg activated carbon. FIG. 8 provides gas phase retention for dual coal filters containing 20, 40, 60, 80, and 100 mg carbon, respectively.

TABLE 20

CAVIFLEX Gas Phase Removal Efficiency for Various Weights of Active Carbon

| Compounds name | Reference μg/cig. | 5 mg % retention | 10 mg % retention | 15 mg % retention | 20 mg % retention | 30 mg % retention | 40 mg % retention | 50 mg % retention |
|---|---|---|---|---|---|---|---|---|
| METHANOL | 142.8 | 4 | −13 | 24 | 16 | 48 | 40 | 57 |
| ACETALDEHYDE | 1374.0 | 18 | 23 | 34 | 39 | 55 | 54 | 70 |
| ACROLEINE | 118.1 | 27 | 35 | 51 | 55 | 72 | 73 | 82 |
| FURANNE | 42.8 | 22 | 34 | 46 | 50 | 68 | 69 | 81 |
| PROPANAL | 81.6 | 24 | 34 | 47 | 52 | 69 | 70 | 81 |
| ACETONE | 419.2 | 22 | 34 | 49 | 52 | 71 | 71 | 81 |
| METHYL ACETATE | 50.1 | 20 | 34 | 46 | 47 | 69 | 69 | 60 |
| ISOPRENE | 509.3 | 19 | 40 | 47 | 53 | 72 | 74 | 83 |
| PENTANE | 41.4 | 18 | 31 | 41 | 45 | 70 | 68 | 93 |
| 1-3 PENTADIENE | 17.6 | 25 | 41 | 53 | 57 | 76 | 77 | 86 |
| METHACROLEINE | 14.6 | 29 | 45 | 57 | 64 | 83 | 87 | 95 |
| ISOBUTYRALDEHYDE | 23.5 | 25 | 51 | 51 | 56 | 75 | 79 | 90 |
| BUTANONE-2 | 111.0 | 27 | 41 | 56 | 57 | 75 | 76 | 84 |

TABLE 20-continued

| CAVIFLEX Gas Phase Removal Efficiency for Various Weights of Active Carbon | | | | | | | | |
|---|---|---|---|---|---|---|---|---|
| Compounds name | Reference μg/cig. | 5 mg % retention | 10 mg % retention | 15 mg % retention | 20 mg % retention | 30 mg % retention | 40 mg % retention | 50 mg % retention |
| BENZENE | 68.8 | 27 | 43 | 55 | 58 | 77 | 77 | 87 |
| 2,5 DMF | 28.8 | 13 | 36 | 49 | 49 | 71 | 71 | 83 |
| TOLUENE | 92.2 | 34 | 51 | 65 | 63 | 82 | 82 | 89 |
| ETHYL BENZENE | 10.5 | 45 | 51 | 72 | 76 | 93 | 92 | 100 |
| META-XYLENE | 18.1 | 37 | 46 | 66 | 51 | 91 | 93 | 100 |
| HYDROCYANURIC ACID | | 22 | 9 | 27 | 42 | 71 | 66 | 67 |
| ACETONITRILE | 173.8 | 57 | 51 | 66 | 72 | 87 | 87 | 86 |
| ACRYLONITRILE | 19.6 | 19 | 13 | 37 | 52 | 76 | 78 | 80 |
| PROPIONITRILE | 35.1 | 22 | 21 | 45 | 55 | 79 | 80 | 80 |
| METHACRYLONITRILE | 4.8 | 22 | 26 | 44 | 57 | 79 | 83 | 83 |
| ISOBUTYRONITRILE | 11.1 | 23 | 26 | 47 | 59 | 81 | 82 | 82 |
| MEAN - TOTAL | | 25 | 33 | 49 | 53 | 75 | 75 | 83 |

Figure 9:
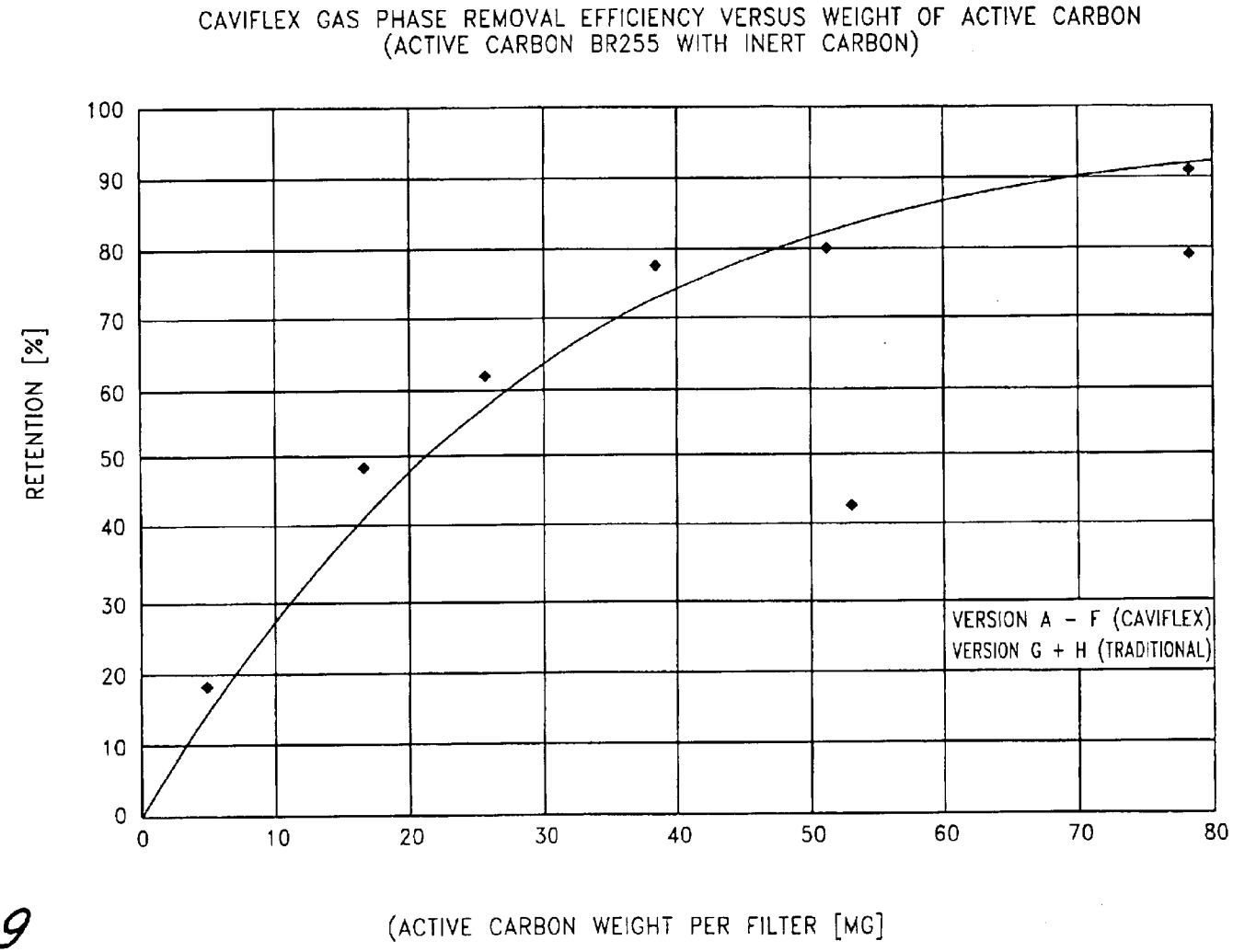
FIG. 9 illustrates the gas phase removal efficiency of the different versions of the CAVIFLEX filters containing active carbon BR255 mixed with inert carbon compared to traditional charcoal filters.

Table 21 provides data concerning reduction in levels of various volatile components by a reference cigarette, and cigarettes equipped with CAVIFLEX filters containing 4% (or 5 mg) activated carbon—Version A, 12% (or 16 mg) activated carbon—Version B, 20% (or 26 mg) activated carbon—Version C, 30% (or 39 mg) activated carbon—Version D, 40% (or 52 mg) activated carbon—Version E, 60% (or 78 mg) activated carbon—Version F. Table 22 provides data concerning reduction in levels of various volatile components by a reference cigarette, and cigarettes equipped with traditional filters containing 52 mg activated carbon—Version G, and 78 mg activated carbon—Version H. FIG. 9 illustrates the gas phase removal efficiency of the different versions of the CAVIFLEX filters containing active carbon BR255 mixed with inert carbon (Versions A through F). Again, as the weight of active carbon in the filter increases, a corresponding increase in retention of gas phase components is observed. FIG. 9 includes comparison data for traditional charcoal filters (Versions G and H). On a carbon weight per filter basis, the CAVIFLEX filter exhibits a greater gas phase removal efficiency than the traditional charcoal filter.

TABLE 21

| CAVIFLEX Gas Phase Removal Efficiency for Various Weights of Active Carbon | | | | | | | |
|---|---|---|---|---|---|---|---|
| Compounds | reference | Version A 4% (5 mg) | | Version B 12% (16 mg) | | Version C 20% (26 mg) | |
| name | μg/cig | μg/cig | % retention | μg/cig | % retention | μg/cig | % retention |
| METHANOL | 239.2 | 239.0 | 0 | 210.4 | 12 | 127.5 | 47 |
| ACETALDEHYDE | 1761.7 | 1543.4 | 12 | 1112.9 | 37 | 870.2 | 51 |
| ACETONITRILE | 104.9 | 95.3 | 9 | 64.4 | 39 | 42.2 | 60 |
| ACROLEINE | 133.2 | 92.8 | 30 | 55.5 | 58 | 43.5 | 67 |
| FURANNE | 38.8 | 30.6 | 21 | 19.2 | 51 | 16.1 | 59 |
| PROPANAL | 114.8 | 88.8 | 23 | 57.3 | 50 | 44.8 | 61 |
| ACETONE | 304.4 | 246.3 | 19 | 151.7 | 50 | 109.1 | 64 |
| METHYLACETATE | 44.6 | 35.4 | 21 | 23.1 | 48 | 17.5 | 61 |
| ISOPRENE | 660.0 | 463.1 | 30 | 260.1 | 61 | 201.6 | 69 |
| PENTANE | 24.8 | 21.1 | 15 | 13.3 | 46 | 10.1 | 59 |
| 1,3 PENTADIENE | 40.3 | 30.5 | 24 | 19.8 | 51 | 15.0 | 63 |
| PROPIONITRILE | 19.6 | 16.5 | 16 | 10.0 | 49 | 7.3 | 63 |
| BUTANONE-2 | 78.0 | 63.1 | 19 | 38.5 | 51 | 27.1 | 65 |
| CROTONALDEHYDE | 21.0 | 15.5 | 26 | 10.2 | 51 | 8.1 | 61 |
| HEXANE | 14.0 | 12.7 | 9 | 6.9 | 51 | 5.2 | 63 |
| BENZENE | 61.3 | 46.3 | 24 | 27.5 | 55 | 20.2 | 67 |
| 2,5 DMF | 21.5 | 17.5 | 19 | 9.8 | 54 | 7.4 | 66 |
| TOLUENE | 69.8 | 57.0 | 18 | 33.8 | 52 | 23.5 | 66 |
| ETHYLBENZENE | 8.6 | 7.1 | 17 | 5.0 | 42 | 2.9 | 66 |
| META-XYLENE | 9.8 | 8.9 | 9 | 5.4 | 45 | 3.0 | 69 |
| MEAN - TOTAL | | | 18 | | 48 | | 62 |
| Compounds | reference | Version D 30% (39 mg) | | Version E 40% (52 mg) | | Version F 60% (78 mg) | |
| name | μg/cig | μg/cig | % retention | μg/cig | % retention | μg/cig | % retention |
| METHANOL | 239.2 | 110.4 | 54 | 81.2 | 66 | 55.7 | 77 |
| ACETALDEHYDE | 1761.7 | 607.1 | 66 | 526.5 | 70 | 306.8 | 83 |
| ACETONITRILE | 104.9 | 31.7 | 70 | 26.2 | 75 | 13.8 | 87 |
| ACROLEINE | 133.2 | 25.5 | 81 | 22.1 | 83 | 12.3 | 91 |
| FURANNE | 38.8 | 10.1 | 74 | 9.4 | 76 | 5.6 | 86 |
| PROPANAL | 114.8 | 27.8 | 76 | 24.1 | 79 | 14.2 | 88 |
| ACETONE | 304.4 | 65.0 | 79 | 54.1 | 82 | 23.2 | 92 |

TABLE 21-continued

| CAVIFLEX Gas Phase Removal Efficiency for Various Weights of Active Carbon | | | | | | | |
|---|---|---|---|---|---|---|---|
| METHYLACETATE | 44.6 | 0.0 | 100 | 9.6 | 78 | 5.6 | 87 |
| ISOPRENE | 660.0 | 115.9 | 82 | 111.7 | 83 | 49.4 | 93 |
| PENTANE | 24.8 | 6.9 | 72 | 6.2 | 75 | 3.9 | 84 |
| 1,3 PENTADIENE | 40.3 | 10.6 | 74 | 9.6 | 76 | 0.0 | 100 |
| PROPIONITRILE | 19.6 | 4.5 | 77 | 4.0 | 80 | 0.0 | 100 |
| BUTANONE-2 | 78.0 | 17.5 | 78 | 14.6 | 81 | 7.6 | 90 |
| CROTONALDEHYDE | 21.0 | 5.4 | 74 | 5.4 | 74 | 0.0 | 100 |
| HEXANE | 14.0 | 4.6 | 67 | 3.1 | 78 | 0.0 | 100 |
| BENZENE | 61.3 | 12.8 | 79 | 11.0 | 82 | 7.3 | 88 |
| 2,5 DMF | 21.5 | 4.7 | 78 | 3.8 | 82 | 3.2 | 85 |
| TOLUENE | 69.8 | 15.5 | 78 | 14.3 | 80 | 8.3 | 88 |
| ETHYLBENZENE | 8.6 | 0.0 | 100 | 0.0 | 100 | 0.0 | 100 |
| META-XYLENE | 9.8 | 0.0 | 100 | 0.0 | 100 | 0.0 | 100 |
| MEAN - TOTAL | | | 78 | | 80 | | 91 |

TABLE 22

Gas Phase Removal Efficiency for Traditional Filters

| Compounds | Reference | Version G 52 mg | | Version H 78 mg | |
|---|---|---|---|---|---|
| name | μg/cig | μg/cig | % retention | μg/cig | % retention |
| METHANOL | 239.2 | 152.5 | 36 | 89.2 | 63 |
| ACETALDEHYDE | 1761.7 | 1122.2 | 36 | 522.6 | 70 |
| ACETONITRILE | 104.9 | 62.3 | 41 | 28.1 | 73 |
| ACROLEINE | 133.2 | 67.9 | 49 | 23.9 | 82 |
| FURANNE | 38.8 | 21.7 | 44 | 9.9 | 74 |
| PROPANAL | 114.8 | 64.5 | 44 | 26.4 | 77 |
| ACETONE | 304.4 | 166.9 | 45 | 59.5 | 80 |
| METHYLACETATE | 44.6 | 25.3 | 43 | 0.0 | 100 |
| ISOPRENE | 660.0 | 352.4 | 47 | 111.2 | 83 |
| PENTANE | 24.8 | 13.9 | 44 | 7.2 | 71 |
| 1,3 PENTADIENE | 40.3 | 22.5 | 44 | 10.4 | 74 |
| PROPIONITRILE | 19.6 | 11.1 | 43 | 4.4 | 78 |
| BUTANONE-2 | 78.0 | 43.1 | 45 | 16.8 | 78 |
| CROTONALDEHYDE | 21.0 | 12.0 | 43 | 5.3 | 75 |
| HEXANE | 14.0 | 7.9 | 44 | 4.5 | 68 |
| BENZENE | 61.3 | 34.3 | 44 | 12.2 | 80 |
| 2,5 DMF | 21.5 | 11.2 | 48 | 5.2 | 76 |
| TOLUENE | 69.8 | 39.8 | 43 | 15.5 | 78 |
| ETHYLBENZENE | 8.6 | 4.9 | 43 | 0.0 | 100 |
| META-XYLENE | 9.8 | 6.0 | 39 | 0.0 | 100 |
| MEAN - TOTAL | | | 43 | | 79 |

In a preferred embodiment, a cigarette containing tobacco treated with a palladium catalyst system is equipped with a filter incorporating a 100% carbon filled cavity. Table 23 lists various volatile compounds present in mainstream smoke from a typical conventional cigarette and the typical percent decrease observed in those compounds when passed through a filter incorporating a 100% carbon filled cavity.

TABLE 23

Compounds In Mainstream Smoke Removed by 100% Carbon Filled Cavity

| Compound | Percent Decrease* |
|---|---|
| Methanol | 77 |
| Acetaldehyde | 83 |
| Acroleine | 87 |
| Furanne | 91 |
| Acetone | 91 |
| Propanaal | 86 |
| Hexane | 100 |
| Methyl acetate | 87 |
| Acetone | 88 |
| Issoprene | 93 |

TABLE 23-continued

Compounds In Mainstream Smoke Removed by 100% Carbon Filled Cavity

| Compound | Percent Decrease* |
|---|---|
| Pentane | 84 |
| 1,3-pentanediene | 100 |
| Methacroleine | 95 |
| Isobutyraldehyde | 90 |
| Butanone-2 | 90 |
| Benzene | 88 |
| 2,5-dimethylformamide | 85 |
| Toluene | 89 |
| Ethylbenzene | 100 |
| Metaxylene | 100 |
| Crotonaldehyde | 100 |
| Acetonitrile | 60 |
| Hydrogen cyanide | 100 |
| AcryInitrile | 80 |
| Propionitrile | 80 |
| Methacrylonitrile | 83 |
| Isobutyronitrile | 82 |

*Research data from Baumgartner

Reduction in PAH, TSNA, and Phenol Levels

Experiments were conducted to compare the levels of selected PAHs (including phenanthrene, 2-methylanthracene, pyrene, chrysene, benzo[b/k]fluoranthene, and benzo[a]pyrene), TSNAs (including N'-nitrosonornicotine (NNN), 4-(N-nitrosomethylamino)-1-(3-pyridyl)-1-butanone (NNK), N'-nitrosoanatabine (NAT), and N'-nitrosoanabasine (NAB)), carbazole, catechol and phenol in smoke from cigarettes containing tobacco incorporating palladium particles and magnesium nitrate to those of comparable cigarettes not containing the catalyst system. A catalyst system was prepared as described in the first Example, and applied to a commercial tobacco blend. The tobacco containing the catalyst system was fashioned into king sized cigarettes. Comparable cigarettes were fashioned from tobacco without the catalyst system. As the data in Table 24 demonstrates, substantial reductions in the levels of PAHs, carbazole, catechol, and phenol were observed in both mainstream and sidestream smoke from cigarettes containing the catalyst system. Reductions in the level of 4-(N-nitrosomethylamino)-1-(3-pyridyl)-1-butanone (NNK) were observed.

TABLE 24

Carcinogen Levels in Cigarettes with and Without Catalyst System

| | | | | PAHs(ng/cig) | | | | | | | |
|---|---|---|---|---|---|---|---|---|---|---|---|
| Cigarette | Code | Type | CSC (mg) | phenanthrene | 2-methylanthracene | pyrene | chrysene | benzo [b/k] fluoranthrene | BaP | carbazole | |
| FF-KS, Reg. | PG-19- | main | 12.1 | 83.03 | 28.48 | 23.20 | 12.39 | 5.52 | 4.49 | 325.00 | value |
| Catalyst, CA-C-CA | 082 | | 2.5 | 2.96 | 4.14 | 1.74 | 6.90 | 2.37 | 2.45 | 3.86 | % CV |
| 100% (AP200), | | | 14.2% | 46.54 | 37.77 | 30.16 | 12.84 | 17.04 | 19.05 | No Change | % dec. |
| 917 paper | | side | 29.11 | 1805.44 | 401.50 | 277.94 | 225.42 | 60.36 | 42.28 | — | value |
| | | | 0.84 | 6.08 | 6.93 | 7.95 | 4.19 | 5.80 | 4.31 | — | % CV |
| | | | — | No Change | No Change | No Change | No Change | No Change | No Change | — | % dec. |
| FF-KS, Reg. | PG-19- | main | 12.92 | 79.03 | 27.75 | 22.82 | 11.81 | 5.79 | 4.65 | — | value |
| Catalyst, CA-C-CA | 086 | | 1.29 | 1.38 | 1.54 | 2.14 | 2.65 | 0.70 | 1.52 | — | % CV |
| 100% (AP200), | | | 8.1% | 49.12 | 39.37 | 31.31 | 16.88 | 12.90 | 16.11 | — | % dec. |
| 409 paper | | | | | | | | | | | |
| LT-KS, Reg. | PG-19- | main | 9.64 | 64.60 | 22.95 | 18.40 | 9.57 | 4.42 | 3.77 | — | value |
| Catalyst, CA-C-CA | 084 | | 0.60 | 1.46 | 0.81 | 0.68 | 1.02 | 1.61 | 3.22 | — | % CV |
| 70% (AP300), 917 | | | 31.0% | 58.41 | 49.84 | 44.62 | 32.67 | 33.50 | 31.97 | — | % dec. |
| paper | | | | | | | | | | | |
| ULT-KS, Reg. | PG-19- | main | 6.51 | 52.14 | 19.00 | 15.20 | 8.19 | 3.87 | 3.24 | — | value |
| Catalyst, C | 085 | | 2.12 | 1.87 | 5.52 | 1.22 | 3.37 | 4.80 | 1.36 | — | % CV |
| impreg-nated CA | | | 53.7% | 66.43 | 58.48 | 54.24 | 42.40 | 41.80 | 41.48 | — | % dec. |
| (laser air | | | | | | | | | | | |
| diluted, AP300), | | | | | | | | | | | |
| 409 paper | | | | | | | | | | | |
| FF-KS, Catalyst | PG-19- | main | 12.68 | 83.34 | 27.86 | 23.55 | 12.40 | 5.80 | 4.57 | 305.85 | value |
| (30% redu in | 087 | | 0.86 | 2.26 | 2.80 | 2.81 | 3.36 | 1.18 | 0.19 | 1.22 | % CV |
| N03), CA-C-CA | | | 9.8% | 46.34 | 39.12 | 29.10 | 12.76 | 12.79 | 17.49 | No Change | % dec. |
| 100% (AP200), | | | | | | | | | | | |
| 917 paper | | side | 28.22 | 1689.40 | 382.08 | 257.91 | 207.82 | 57.98 | 40.05 | — | value |
| | | | 0.68 | 4.70 | 6.22 | 4.44 | 8.95 | 3.93 | 3.44 | — | % CV |
| | | | — | No Change | No Change | No Change | No Change | No Change | No Change | — | % dec. |
| Baseline: No | PG-19- | main | 14.05 | 155.32 | 45.76 | 33.22 | 14.21 | 6.65 | 5.54 | 316.23 | value |
| Catalyst, CA | 081 | | 3.55 | 10.05 | 1.61 | 1.42 | 3.85 | 5.37 | 1.89 | 4.59 | % CV |
| filter, 409 paper | | | — | — | — | — | — | — | — | — | % dec. |

| | | | TSNAs (ng/cig) | | | | Phenols (μg/cig) | | |
|---|---|---|---|---|---|---|---|---|---|
| Cigarette | Code | Type | NNN | NAT | NAB | NNK | Catechol | Phenol | |
| FF-KS, Reg. | PG-19- | main | 70 | 20 | 200 | 50 | 53.58 | 8.653 | value |
| Catalyst, CA-C-CA | 082 | | — | — | — | — | — | — | % CV |
| 100% (AP200), | | | — | — | — | — | 18.23 | 43.764 | % dec. |
| 917 paper | | side | — | — | — | — | — | — | value |
| | | | — | — | — | — | — | — | % CV |
| | | | — | — | — | — | — | — | % dec. |
| FF-KS, Reg. | PG-19- | main | — | — | — | — | — | — | value |
| Catalyst, CA-C-CA | 086 | | — | — | | — | — | — | % CV |
| 100% (AP200), | | | — | — | — | — | — | — | % dec. |
| 409 paper | | | | | | | | | |
| LT-KS, Reg. | PG-19- | main | — | — | — | — | — | — | value |

TABLE 24-continued

| Carcinogen Levels in Cigarettes with and Without Catalyst System | | | | | | | | | |
|---|---|---|---|---|---|---|---|---|---|
| Catalyst, CA-C-CA | 084 | | — | — | | — | — | — | % CV |
| 70% (AP300),917 | | | — | — | — | — | — | — | % dec. |
| paper | | | | | | | | | |
| ULT-KS, Reg. | PG-19- | main | — | — | — | — | — | — | value |
| Catalyst, C | 085 | | — | — | — | — | — | — | % CV |
| impreg-nated CA | | | — | — | — | — | — | — | % dec. |
| (laser air | | | | | | | | | |
| diluted, AP300), | | | | | | | | | |
| 409 paper | | | | | | | | | |
| FF-KS, Catalyst | PG-19- | main | | | | | 53.64 | 9.283 | value |
| (30% redu in | 087 | | | | | | | | % CV |
| N03), CA-C-CA | | | −25% | −27% | −24% | No | 18.14 | 39.67 | % dec. |
| 100% (AP200), | | | | | | Change | | | |
| 917 paper | | side | — | — | — | — | | — | value |
| | | | — | — | — | — | — | — | % CV |
| | | | — | — | — | — | — | — | % dec. |
| Baseline: No | PG-19- | main | — | — | — | 90 | 65.53 | 15.39 | value |
| Catalyst, CA | 081 | | — | — | — | — | — | — | % CV |
| filter, 409 paper | | | — | — | — | — | — | — | % dec. |

Experiments were conducted to compare the level of the tobacco specific nitrosamine NNK in the sidestream smoke of an Omni cigarette containing a palladium catalyst system and a commercially available Marlboro cigarette. The catalyst system produced a reduction of about 25% in the level of NNK in sidestream smoke over the baseline value. The level of NNK in the sidestream smoke of the Omni cigarette was measured at 900 ng/cigarette compared to 1,200 ng/cigarette in the sidestream smoke of the Marlboro cigarette. The data suggest that the catalyst system of preferred embodiments may substantially reduce the levels of certain carcinogens in sidestream smoke, thereby reducing the level of exposure to such carcinogens of individuals exposed to secondhand smoke from cigarettes employing the catalyst system.

Experiments were conducted to compare the levels of various compounds in a cigarette incorporating a palladium catalyst system (identified by the BIO designation in the sample code), a Kentucky Reference cigarette (identified by the KRC designation in the sample code), and a Marlboro cigarette (identified by the MRC designation in the sample code. Results of these experiments are provided in Tables 25–43. Unless otherwise specified, the measurements were obtained for mainstream smoke.

Tables 25 and 26 provide a comparison of catechol, phenol and tar levels in the three cigarettes. The cigarette including a palladium catalyst system displayed a substantial reduction in catechol, phenol and tar levels over both the Kentucky Reference and Marlboro cigarettes. Table 27 provides cigarette smoke condensate levels for the cigarette containing the catalyst system. Tables 28, 29, and 30 provide TSNA levels for the cigarette containing the catalyst system. Table 31 provides cigarette smoke condensate levels for the Marlboro cigarette. Tables 32, 33, and 34 provide TSNA levels for the cigarette containing the catalyst system. Table 33 provides additional cigarette smoke condensate levels for the cigarette containing the catalyst system. Tables 36 and 37 provide PAH levels for the cigarette containing the catalyst system. Table 38 provides additional cigarette smoke condensate levels for the Marlboro cigarette. Tables 39 amd 40 provide PAH levels for the Marlboro cigarette. Table 41 provides cigarette smoke condensate levels in sidestream smoke for the cigarette containing the catalyst system. Tables 42 and 43 provides PAH levels in sidestream smoke for the cigarette containing the catalyst system.

TABLE 25

Comparison of Catechol and Phenol Levels

| SAMPLE | | AVG CIG WGT (G) | # OF CIG | PUFF | CSC WGT (G) | CSC (MG) PER CIG | AVG CSC (MG) PER CIG | CATECHOL UG PER CIG | CATECHOL STAN DEV | CATECHOL % CV | CATECHOL UG/ CSC (MG) | PHENOL UG PER CIG | PHENOL STAN DEV | PHENOL % CV | PHENOL UG/ CSC (MG) |
|---|---|---|---|---|---|---|---|---|---|---|---|---|---|---|---|
| BIO-54-020 | 1 | 1.0093 | 10 | 5.44 | 0.107 | 10.7 | 10.5 | 46.079 | 1.054 | 2.29 | 4.38852 | 5.267 | 0.3 | 5.69 | 0.502 |
| | 2 | 0.9838 | 10 | 5.28 | 0.105 | 10.5 | | | | | | | | | |
| | 3 | 1.0039 | 10 | 5.305 | 0.103 | 10.3 | | | | | | | | | |
| KRC-101801 | 1 | 1.004 | 10 | 6.5 | 0.146 | 14.6 | 15.133 | 72.81 | 2.171 | 2.98 | 4.8112 | 14.94 | 0.35 | 2.34 | 0.987 |
| | 2 | 1.017 | 10 | 6.58 | 0.148 | 14.8 | | | | | | | | | |
| | 3 | 1.0201 | 10 | 6.73 | 0.16 | 16 | | | | | | | | | |
| MRC-101801 | 1 | 0.9109 | 10 | 6.25 | 0.123 | 12.3 | 12.4 | 58.222 | 3.191 | 5.48 | 4.69532 | 10.91 | 0.65 | 5.96 | 0.88 |
| | 2 | 0.9301 | 10 | 6.2 | 0.13 | 13 | | | | | | | | | |
| | 3 | 0.9263 | 10 | 6.3 | 0.119 | 11.9 | | | | | | | | | |

| | KRC-101801 | MRC-10180 |
|---|---|---|
| CATECHOL REDUCTION: | 36.712 | 20.855463 |
| PHENOL REDUCTION: | 64.737 | 51.715535 |
| TAR REDUCTION: | 30.617 | 15.322581 |

TABLE 26

Comparison of Catechol and Phenol Levels

| | | CATECHOL CONC (NG/UL) | PHENOL CONC (NG/UL) | STD INJ VOL (UL) | SAM INJ VOL (UL) | CATECHOL CONC (UG/# OF CIG) | PHENOL CONC (UG/# OF CIG) | 3Methyl Recov | Int Std Recov | 3 Methyl |
|---|---|---|---|---|---|---|---|---|---|---|
| BIO-54-020 | 1 | 9.25315 | 1.01119 | 10 | 20 | 46.26575 | 5.05595 | 33.206 | 99.56 | 33.35 |
| | 2 | 94.0559 | 1.12214 | 10 | 20 | 47.02795 | 5.6107 | 33.538 | 100.56 | |
| | 3 | 8.98894 | 1.02712 | 10 | 20 | 44.9447 | 5.1356 | 33.565 | 100.64 | |
| KRC-101801 | 1 | 14.06301 | 3.03592 | 10 | 20 | 70.21505 | 15.1796 | 35.125 | 105.32 | |
| | 2 | 14.76777 | 2.9072 | 10 | 20 | 73.83885 | 14.536 | 34.333 | 102.94 | |
| | 3 | 14.85493 | 3.0194 | 10 | 20 | 74.27465 | 15.097 | 34.465 | 103.34 | |
| MRC-101801 | 1 | 11.5452 | 2.10992 | 10 | 20 | 57.726 | 10.5496 | 34.156 | 102.41 | |
| | 2 | 12.32629 | 2.33192 | 10 | 20 | 61.63145 | 11.6596 | 34.711 | 104.07 | |
| | 3 | 11.06166 | 2.10364 | 10 | 20 | 55.3083 | 10.5182 | 34.64 | 103.86 | |

FTC METHOD

| | | | |
|---|---|---|---|
| Sample Name | BIO-54-020 | KRC-1R3F | MRC-SOFT PACK |
| Blend | WOODSI | | |
| Filter Type | CA | | |
| | 100% | | |
| | CA | | |
| Cigarette paper | 15460 | | |
| Cigarette Type | FF KS | | |
| Additives (e.g. catalyst) | CATALYST | | |
| Conditioning Time (hours) | 24 | 24 | 24 |
| Temperature (° F.) | 75 | 74 | 74 |
| Relative Humidity (%) | 51 | 51 | 51 |

TABLE 27

CSC Levels of Cigarette With Catalyst System

| | | | Smoke Room Conditions: | |
|---|---|---|---|---|
| | | | Deg. F. 74.3 | % RH 52 |
| | BIO-54-020-04 | BIO-54-020-05 | BIO-54-020-06 | |
| CSC(mg)-10 cig. | 10.1 | 8.6 | 11 | |
| Puffs | 5.39 | 5.4 | 5.5 | |
| Avg. Wt. (g) | 1.005 | 1.005 | 1.003 | |

TABLE 28

TSNA Levels of Cigarette With Catalyst System

| | Est. Conc. (ng/ml)/10 cigs | | | | | |
|---|---|---|---|---|---|---|
| | BIO-54-020-04 | | BIO-54-020-05 | | BIO-54-020-06 | |
| | Run 1 | Run 2 | Run 1 | Run 2 | Run 1 | Run 2 |
| NNN | 931.5 | 855 | 789.5 | 831.2 | 879.1 | 853.1 |
| NAT | 855.4 | 779.1 | 751.6 | 802.2 | 793.8 | 772.6 |
| NAB | 159.5 | 129.8 | 134.9 | 142.2 | 139.7 | 138.1 |
| NNK | 388.2 | 337 | 327.3 | 372.7 | 357.6 | 358.6 |

TABLE 29

TSNA Levels of Cigarette With Catalyst System

| | Est. Conc. ng/cigarette | | | | | | | | | Est. Conc. ng/cigarette | | |
|---|---|---|---|---|---|---|---|---|---|---|---|---|
| | BIO-54-020-04 | | | BIO-54-020-05 | | | BIO-54-020-06 | | | | St Dev | % cv |
| | Run 1 | Run 2 | Avg. | Run 1 | Run 2 | Avg. | Run 1 | Run 2 | Avg. | Avg. of 3 samples | of 3 samples | of 3 samples |
| NNN | 186 | 171 | 179 | 158 | 166 | 162 | 176 | 171 | 174 | 172 | 9 | 5.23 |
| NAT | 171 | 156 | 164 | 150 | 160 | 155 | 159 | 155 | 157 | 159 | 5 | 3.14 |
| NAB | 31.9 | 26 | 29 | 27 | 28.4 | 27.7 | 27.9 | 27.6 | 27.8 | 28.2 | 0.7 | 2.48 |
| NNK | 77.6 | 67.4 | 72.5 | 65.5 | 74.5 | 70 | 71.5 | 71.7 | 71.6 | 71 | 1 | 1.41 |

TABLE 30

TSNA Levels of Cigarette With Catalyst System

| | Est. Conc. ng/mg csc/cigarette | | | | | | | | | Est. Conc. ng/mg csc/cigarette | | |
|---|---|---|---|---|---|---|---|---|---|---|---|---|
| | BIO-54-020-04 | | | BIO-54-020-05 | | | BIO-54-020-06 | | | Avg. | St Dev | % cv |
| | Run 1 | Run 2 | Avg. | Run 1 | Run 2 | Avg. | Run 1 | Run 2 | Avg. | of 3 samples | of 3 samples | of 3 samples |
| NNN | 18.45 | 16.93 | 17.69 | 18.36 | 19.33 | 18.85 | 15.98 | 15.51 | 15.75 | 17.43 | 1.57 | 9.01 |
| NAT | 16.94 | 15.43 | 16.19 | 17.479 | 18.66 | 18.07 | 14.43 | 14.05 | 14.24 | 16.17 | 1.92 | 11.87 |
| NAB | 3.158 | 2.57 | 2.864 | 3.137 | 3.307 | 1.222 | 2.54 | 2.511 | 2.526 | 2.871 | 0.348 | 12.12 |
| NNK | 7.687 | 6.673 | 7.18 | 7.612 | 8.667 | 8.14 | 6.502 | 6.52 | 6.511 | 7.277 | 0.819 | 11.25 |

TABLE 31

CSC Levels of Marlboro Cigarette

| | | | Oct. 19, 2001 Smoke Room Conditions: | |
|---|---|---|---|---|
| | | | Deg. F. | % RH |
| | | | 74.3 | 52 |
| | MRC-101901-04 | MRC-101901-05 | MRC-101901-06 | |
| CSC(mg) | 12.4 | 11.7 | 12.1 | |
| Puffs | n/a | 6.28 | 6.15 | |
| Avg. Wt. (g) | 0.9126 | 0.918 | 0.917 | |

TABLE 32

TSNA Levels of Marlboro Cigarette

| | Est. Conc. (ng/ml)/10 cig. | | | | | |
|---|---|---|---|---|---|---|
| | MRC-101901-04 | | MRC-101901-05 | | MRC-101901-06 | |
| | Run 1 | Run 2 | Run 1 | Run 2 | Run 1 | Run 2 |
| NNN | 884.7 | 879.9 | 854.4 | 916.3 | 870.9 | 848.1 |
| NAT | 658.6 | 639.2 | 626.6 | 679.2 | 688.5 | 646.1 |
| NAB | 86.4 | 88.5 | 87.1 | 89.7 | 84.3 | 78.4 |
| NNK | 584.8 | 578 | 541.3 | 598.4 | 576.7 | 561.5 |

TABLE 33

TSNA Levels of Marlboro Cigarette

| | Est. Conc. ng/cigarette | | | | | | | | | Est. Conc. ng/cigarette | | |
|---|---|---|---|---|---|---|---|---|---|---|---|---|
| | MRC-101901-04 | | | MRC-101901-05 | | | MRC-101901-06 | | | Avg. | St Dev | % cv |
| | Run 1 | Run 2 | Avg. | Run 1 | Run 2 | Avg. | Run 1 | Run 2 | Avg. | of 3 samples | of 3 samples | of 3 samples |
| NNN | 177 | 176 | 177 | 171 | 183 | 177 | 174 | 170 | 172 | 175 | 3 | 1.71 |
| NAT | 132 | 128 | 130 | 125 | 136 | 131 | 138 | 129 | 134 | 132 | 2 | 1.52 |
| NAB | 17.3 | 17.7 | 17.5 | 17.4 | 17.9 | 17.7 | 16.9 | 15.7 | 16.3 | 17.2 | 0.8 | 4.65 |
| NNK | 117 | 115.6 | 116.3 | 108.3 | 119.7 | 114 | 115.3 | 112.3 | 113.8 | 115 | 1 | 0.87 |

TABLE 34

TSNA Levels of Marlboro Cigarette

| | Est. Conc. ng/mg csc/cigarette | | | | | | | | | Est. Conc. ng/cigarette | | |
|---|---|---|---|---|---|---|---|---|---|---|---|---|
| | MRC-101901-04 | | | MRC-101901-05 | | | MRC-101901-06 | | | Avg. | St Dev | % cv |
| | Run 1 | Run 2 | Avg. | Run 1 | Run 2 | Avg. | Run 1 | Run 2 | Avg. | of 3 samples | of 3 samples | of 3 samples |
| NNN | 14.27 | 14.19 | 14.23 | 14.61 | 15.66 | 15.14 | 14.4 | 14.02 | 14.21 | 14.53 | 0.53 | 3.65 |
| NAT | 10.62 | 10.31 | 10.47 | 10.711 | 11.61 | 11.16 | 11.38 | 10.68 | 11.03 | 10.89 | 0.37 | 3.4 |
| NAB | 1.394 | 1.427 | 1.411 | 1.489 | 1.533 | 1.511 | 1.393 | 1.296 | 1.345 | 1.422 | 0.084 | 5.91 |
| NNK | 9.432 | 9.323 | 9.378 | 9.253 | 10.229 | 9.741 | 9.532 | 9.281 | 9.407 | 9.509 | 0.202 | 2.12 |

TABLE 35

CSC Levels of Cigarette With Catalyst System

| Original Tobacco/ Spray Batch | Cigarette Batch | Extraction Code | mg of CSC | # of cigarettes | mg of CSC/ cigarette |
|---|---|---|---|---|---|
| BIO-54-020-01 | BIO-54-020-01 | BIO-75-005-04 | 452 | 40 | 11.30 |
| | BIO-54-020-02 | BIO-75-005-05 | 461 | 40 | 11.53 |
| | BIO-54-020-03 | BIO-75-005-06 | 452 | 40 | 11.30 |

TABLE 36

PAH Levels of Cigarette With Catalyst System versus Marlboro Cigarette

| Key Compounds: | ng/cigarette, corrected for % recovery | Stnd. Dev. | compared to 1888 MRC-101901 | % reduction | error |
|---|---|---|---|---|---|
| phenanthrene | 66.51 | 1.47 | Reduction | 29.92 | 1.59 |
| 2-methylanthracene | 26.87 | 0.10 | Reduction | 35.71 | 0.64 |
| pyrene | 19.23 | 0.18 | Reduction | 24.88 | 0.86 |
| chrysene | 10.26 | 0.08 | Reduction | 23.93 | 1.64 |
| benzo[b/k]fluoranthene | 6.51 | 0.15 | Reduction | 4.95 | 0.15 |
| benzo[a]pyrene | 6.91 | 0.06 | Reduction | 7.14 | 0.08 |

TABLE 37

PAH Levels of Cigarette With Catalyst System

| % recoveries# | BIO-75-005-04 | BIO-75-005-05 | BIO-75-005-06 |
|---|---|---|---|
| D8-acenaphthylene | 69.6 | 70.7 | 80.9 |
| D10-fluorene | 76.1 | 77.4 | 87.9 |
| D10-phenanthrene | 84.1 | 87.0 | 96.5 |
| D10-anthracene | 84.6 | 91.5 | 105.5 |
| D8-carbazole | N.D. | N.D. | N.D. |
| D10-fluorathene | 95.5 | 95.5 | 106.8 |
| D10-pyrene | 92.1 | 94.0 | 103.7 |
| D12-benzo(a)anthracene | 117.4 | 120.5 | 133.8 |
| D12-chrysene | 99.7 | 103.1 | 112.9 |
| D12-benzo(a)pyrene | 115.8 | 117.4 | 134.0 |

TABLE 39

PAH Levels of Marlboro Cigarette

| Key Compounds: | ng/cigarette, corrected for % recovery | Stnd. Dev. |
|---|---|---|
| phenanthrene | 94.90 | 4.59 |
| 2-methylanthracene | 41.80 | 0.73 |
| pyrene | 25.59 | 0.86 |
| chrysene | 13.48 | 0.92 |
| benzo[b/k]fluoranthene | 6.85 | 0.13 |
| benzo[a]pyrene | 7.44 | 0.05 |

TABLE 38

CSC Levels of Marlboro Cigarettes

| Original Tobacco/ Spray Batch | Cigarette Batch | Extraction Code | mg of CSC | # of cigarettes | mg of CSC/ cigarette |
|---|---|---|---|---|---|
| MRC-SOFT PACK | MRC-101901-01 | MRC-75-005-01 | 520 | 40 | 13.00 |
| | MRC-101901-02 | MRC-75-005-02 | 509 | 40 | 12.73 |
| | MRC-101901-03 | MRC-75-005-03 | 528 | 40 | 13.40 |

TABLE 40

PAH Levels of Marlboro Cigarette

| % recoveries# | MRC-75-005-01 | MRC-75-005-02 | MRC-75-005-03 |
|---|---|---|---|
| D8-acenaphthylene | 97.7 | 78.1 | 93.1 |
| D10-fluorene | 106.2 | 87.6 | 103.4 |
| D10-phenanthrene | 111.8 | 95.2 | 111.6 |
| D10-anthracene | 112.2 | 102.4 | 117.6 |
| D8-carbazole | N.D. | N.D. | N.D. |
| D10-fluorathene | 122.6 | 106.1 | 124.1 |
| D10-pyrene | 120.2 | 103.5 | 120.8 |
| D12-benzo(a)anthracene | 155.2 | 135.1 | 158.0 |
| D12-chrysene | 134.8 | 113.9 | 134.4 |
| D12-benzo(a)pyrene | 168.1 | 146.0 | 174.9 |

TABLE 41

CSC Levels of Cigarette with Catalyst System - Sidestream Smoke

| Original Tobacco/ Spray Batch | Cigarette Batch | Extraction Code | mg of CSC | # of cigarettes | mg of CSC/ cigarette |
|---|---|---|---|---|---|
| BIO-54-020-01 | BIO-54-020-101 | BIO-40-071-01 | 78 | 3 | 26.00 |
| | BIO-54-020-102 | BIO-40-071-02 | 75 | 3 | 25.00 |
| | Blank | BIO-40-071-03 | | | |
| | BIO-54-020-103 | BIO-40-071-04 | 79 | 3 | 26.33 |

TABLE 42

PAH Levels of Cigarette with Catalyst System - Sidestream Smoke

| Key Compounds: | ng/cigarette, corrected for % recovery | Stnd. Dev. | compared to 1135-MRC-40-023-01 | % reduction | error |
|---|---|---|---|---|---|
| phenanthrene | 1244.11 | 117.25 | Reduced | 52.85 | 8.18 |
| 2-methylanthracene | 321.10 | 18.70 | Reduced | 45.53 | 5.45 |
| pyrene | 193.01 | 13.25 | Reduced | 51.18 | 6.18 |
| chrysene | 164.92 | 6.94 | Reduced | 60.94 | 6.99 |
| benzo[b/k]fluoranthene | 59.18 | 4.72 | Reduced | 48.86 | 6.95 |
| benzo[a]pyrene | 50.88 | 0.65 | Reduced | 29.93 | 1.90 |

TABLE 43

PAH Levels of Cigarette with Catalyst System - Sidestream Smoke

| % recoveries# | BIO-40-071-01 | BIO-40-071-02 | BIO-40-071-03 | BIO-40-071-04 |
|---|---|---|---|---|
| D8-acenaphthylene | 57.5 | 61.8 | 26.1 | 69.6 |
| D10-fluorene | 66.3 | 70.9 | 44.1 | 78.9 |
| D10-phenanthrene | 77.5 | 83.4 | 67.1 | 90.1 |
| D10-anthracene | 74.7 | 80.4 | 41.9 | 87.1 |
| D8-carbazole | N.D. | N.D. | N.D. | N.D. |
| D10-fluorathene | 88.5 | 95.4 | 81.1 | 102.3 |
| D10-pyrene | 84.4 | 90.2 | 74.6 | 96.7 |
| D12-benzo(a)anthracene | 114.7 | 115.5 | 79.4 | 125.6 |
| D12-chrysene | 92.6 | 97.3 | 83.8 | 105.1 |
| D12-benzo(a)pyrene | 104.2 | 110.3 | 33.3 | 117.7 |

The above description provides several methods and materials of the present invention. This invention is susceptible to modifications in the methods and materials, such as the choice of catalyst, smokable material, filter, and the like, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

Every patent and other reference mentioned herein is hereby incorporated by reference in its entirety.

What is claimed is:

1. A method of making a smoking composition that comprises a smokable material and exhibits a reduction in at least one component arising from pyrolytic reactions of the smokable material, said method comprising the steps of:

providing said smokable material;

applying a casing solution to the smokable material; thereafter applying a plurality of metallic or carbonaceous catalytic particles to the smokable material in a form separate from the casing solution; and applying a nitrate or nitrite source in a form separate from the casing solution and in a form separate from the plurality of metallic or carbonaceous catalytic particles to the smokable material, before, after or simultaneously with applying the plurality of particles but after applying the casing solution, whereby a smoking composition is obtained.

2. The method of claim 1, wherein the catalytic particles have a mean average particle size or mode average particle size of greater than or equal to about 0.5 $\mu$m.

3. The method of claim 1, wherein the catalytic particles have a mean average particle size or mode average particle size of greater than or equal to about 20 $\mu$m.

4. The method of claim 1, wherein the smokable material comprises tobacco.

5. The method of claim 4, wherein the tobacco has a reduced nicotine content or a negligible nicotine content.

6. The method of claim 4, wherein the tobacco has a reduced content or a negligible content of at least one nitrosamine.

7. The method of claim 1, wherein the catalytic particles comprise at least one noble metal.

8. The method of claim 7, wherein the noble metal comprises palladium.

9. The method of claim 7, wherein the noble metal comprises crystalline palladium particles of from about 50 nm to about 200 nm in average diameter.

10. The method of claim 8, wherein the palladium is derived from ammonium tetrachloropalladate.

11. The method of claim 1, wherein the smoking composition comprises from about 500 ppm to about 1500 ppm metal or carbon in a form of catalytic particles.

12. The method of claim 1, wherein the smoking composition comprises from about 700 ppm to about 1000 ppm metal or carbon in the form of catalytic particles.

13. The method of claim 1, wherein the smoking composition comprises about 800 ppm metal or carbon in the form of catalytic particles.

14. The method of claim 1, wherein the nitrate or nitrite source comprises a nitrate salt or a nitrite salt.

15. The method of claim 14, wherein the nitrate salt comprises $Mg(NO_3)_2$-6H2O.

16. The method of claim 1, wherein the smoking composition comprises from about 0.6 wt. % to about 1.1 wt. % nitrogen in the form of a nitrate salt or a nitrite salt.

17. The method of claim 1, wherein the smoking composition comprises about 0.9 wt. % nitrogen in the form of a nitrate salt or a nitrite salt.

18. The method of claim 1, further comprising the step of:

fabricating the smoking composition into a cigarette.

19. The method of claim 1, further comprising the step of:

fabricating the smoking composition into a cigarette comprising a cavity filter, wherein the cavity filter is substantially filled with an active carbon or active charcoal.

20. The method of claim 19, wherein the cavity filter is approximately 100 vol % filled with an active carbon or active charcoal.

* * * * *